US005409144A

United States Patent [19]

Brown

[11] Patent Number: 5,409,144

[45] **Date of Patent: * Apr. 25, 1995**

[54] DISPENSING VALVE FOR PACKAGING

[75] Inventor: Paul E. Brown, Midland, Mich.

[73] Assignee: Liquid Molding Systems Inc., Midland, Mich.

[ * ] Notice: The portion of the term of this patent subsequent to May 25, 2010 has been disclaimed.

[21] Appl. No.: 119,814

[22] Filed: Sep. 10, 1993

Related U.S. Application Data

[63] Continuation-in-part of Ser. No. 804,086, Dec. 6, 1991, Pat. No. 5,213,236, Ser. No. 39,896, Mar. 30, 1993, Pat. No. 5,339,995, and Ser. No. 52,113, Apr. 23, 1993.

[51] Int. Cl.[6] ..... B67D 5/06

[52] U.S. Cl. ..... 222/185; 220/89.1; 220/203; 222/212; 222/490; 222/493; 222/494; 222/496; 222/497

[58] Field of Search ..... 222/92, 105, 181, 185, 222/206, 212, 215, 481.5, 490, 491, 492, 493, 494, 495, 496, 497; 220/89.1, 203, 205

[56] References Cited

U.S. PATENT DOCUMENTS

| | | | |
|---|---|---|---|
| 1,206,661 | 11/1916 | Booth . | |
| 1,825,553 | 9/1931 | Smith . | |
| 1,989,714 | 2/1935 | Statham | 221/60 |
| 2,175,052 | 10/1939 | Bull et al. | 221/60 |
| 2,758,755 | 8/1956 | Schafler | 222/213 |
| 3,342,379 | 9/1967 | Foley | 222/173 |
| 3,490,488 | 1/1970 | Grist | 220/203 |
| 4,057,177 | 11/1977 | Laauwe | 222/481.5 X |
| 4,166,553 | 9/1979 | Fraterrigo | 222/181 |
| 4,408,702 | 10/1983 | Horvath | 222/212 |
| 4,434,810 | 3/1984 | Atkinson | 137/493 |
| 4,470,523 | 9/1984 | Spector | 222/181 |
| 4,728,006 | 3/1988 | Drobish et al. | 222/181 |
| 4,749,108 | 6/1988 | Dornsbusch et al. | 222/212 |
| 4,779,766 | 10/1988 | Kinsley | 222/481.5 X |
| 4,928,861 | 5/1990 | Schiemann | 222/481.5 |
| 4,987,740 | 1/1991 | Coleman | 220/203 |
| 5,033,655 | 6/1991 | Brown | 222/212 |
| 5,071,017 | 12/1991 | Stull | 220/203 X |
| 5,115,950 | 5/1992 | Rohr | 220/494 |
| 5,271,531 | 12/1993 | Rohr et al. | 222/490 X |

FOREIGN PATENT DOCUMENTS

| | | |
|---|---|---|
| 996998 | 12/1951 | France . |
| 2128875 | 12/1972 | Germany . |
| 2609310 | 9/1976 | Germany . |
| 1046518 | 10/1966 | Switzerland . |
| 2098958 | 12/1982 | United Kingdom . |
| 0278125 | 8/1988 | United Kingdom . |
| 0395380 | 10/1990 | United Kingdom . |
| 145824 | 3/1962 | U.S.S.R. . |

*Primary Examiner*—Andres Kashnikow
*Assistant Examiner*—Joseph A. Kaufman
*Attorney, Agent, or Firm*—Price, Heneveld, Cooper, DeWitt & Litton

[57] ABSTRACT

A dispensing package is provided for fluid products such as liquid soaps, shampoos and conditioners, household detergents, cleaners, polishes, moisturizing creams, and the like, and includes a container with a self-sealing dispensing valve mounted therein. The valve includes a marginal flange, a valve head with a discharge orifice therein, and a connector sleeve having one end connected with the valve flange and the opposite end connected with the valve head adjacent a marginal edge thereof. The connector sleeve has a resiliently flexible construction, such that when pressure within the container raises above a predetermined amount, the valve head shifts outwardly in a manner which causes the connector sleeve to double over and extend rollingly.

58 Claims, 25 Drawing Sheets

DISPENSING VALVE FOR PACKAGING

CROSS REFERENCES TO RELATED APPLICATIONS

The present application is a continuation-in-part of commonly assigned, U.S. patent application Ser. No. 804,086, filed Dec. 6, 1991, entitled DISPENSING VALVE FOR PACKAGING (now U.S. Pat. No. 5,213,236), and related, similarly titled continuation-in-part application Ser. No. 039,896, now U.S. Pat. No. 5,339,995) filed Mar. 30, 1993, and continuation-in-part application Ser. No. 052,113, filed Apr. 23, 1993, which applications are hereby incorporated by reference.

BACKGROUND OF THE INVENTION

The present invention relates to product packaging, and in particular to a self-sealing valve for fluid products, and the like.

Many different types of packages or containers are presently available for packaging non-solid products of the type which are capable of flowing, such as fluid or fluidized materials, including liquids, pastes, powders, and the like, which substances are collectively and generically referred to herein as "fluids". Some such packages include a dispenser which permits a selected amount of fluid to be discharged from the package, and then reseals to close the package.

Self-sealing dispensing valves have been used in packaging for certain types of products, such as the container disclosed in U.S. Pat. No. 4,728,006 to Drobish et al, which is designed for shampoos, conditioners, and the like. However, such valves have been known to experience some types of sealing problems, and inconsistent dispensing characteristics, particularly when the packages are exposed to significant temperature variations.

Valves constructed from most conventional plastic materials cannot be used in at least certain types of packages, since they either react with or adulterate the product. For instance, in food packaging, care must be taken to avoid the use of valve materials which might contain any type of toxin. Furthermore, active ingredients in products can cause the valve to either embrittle or soften, thereby ruining the designed flow rate and/or self-sealing characteristics of the valve.

Liquid silicone rubber ("LSR") valves have recently been used in some types of packaging, and have proven particularly advantageous since the material is inherently quite inert, and will therefore not either adulterate or react with the packaged product. Examples of such packaging are provided in applicant's U.S. Pat. No. 5,033,655 to Brown. Although liquid silicone rubber possesses many attributes for use in packaging, it also has other characteristics which render such applications problematic. For example, the surfaces of liquid silicone rubber parts are extremely tacky or sticky, having a very high coefficient of friction. As a result, in attempting to attach a dispensing valve to a container by a conventional threaded collar arrangement, the surfaces of the valve flange will stick tightly to the adjacent surfaces of the container and collar before the collar can be tightened securely enough to create a leak-resistant seal. Tightening of the collar often causes the valve flange, as well as the entire valve to distort from its designed shape, thereby preventing the formation of a secure seal, and/or changing the intended dispensing and sealing characteristics of the valve.

Another drawback associated with the use of liquid silicone rubber in dispensing valves for product packaging is that there is presently no available adhesive capable of connecting the valve to a container in a manner that will withstand the operating pressures to which the valve and container are repeatedly subjected. The unique imperforate nature of the surfaces of the liquid silicone rubber valve precludes the use of conventional adhesives. Hence, the attachment of the liquid silicone rubber valve to a container in a manner that will not leak, and will withstand repeated pressurization and depressurization of the dispensing package is an important consideration.

Another problem experienced with prior dispensing packages relates to achieving a proper design balance between the package container, valve, and fluid product, so that the product can be repeatedly dispensed without requiring excess force, and will neatly discharge only that amount of product which is desired by the user, particularly in keeping with the type of product involved. For instance, when dispensing highly concentrated fluid products, such as hand soaps, and the like, the user will typically require only a small amount or dollop of soap per application to achieve satisfactory results. In contrast, when using other types of fluid products, such as skin moisturizers, tanning formulas, and the like, larger quantities of product are typically required by the user for each application. The ability of the valve to quickly and readily open in response to moderate pressure on the container is important, as is the ability of the valve to quickly and securely close when the pressure has been released. Also important is the amount of pressure which must be maintained on the container to sustain fluid through the valve once the valve is opened. The ability to quickly and accurately achieve a proper balance between all of these factors is very desirable in designing dispensing packages.

Some other problems encountered in such dispensing packaging include retaining the valve closed during transport, preventing the container walls from collapsing as product is dispensed, and other similar considerations.

SUMMARY OF THE INVENTION

One aspect of the present invention is a dispensing package for fluid products and the like, comprising a container having a dispensing valve mounted therein. The dispensing valve includes a marginal flange which seals about a discharge opening of the container, and a valve head with an orifice through which fluid product is dispensed. The valve includes a connector sleeve having one end connected with the valve flange, and an opposite end connected with the valve head. The connector sleeve is resiliently flexible, with a sidewall configured to shift the valve head outwardly to a fully extended position when pressure within the container is raised above a predetermined discharge pressure to open the orifice and dispense fluid product from the container. A valve stop is selectively connected with the container, and is positioned generally opposite the dispensing valve to positively prevent the valve head from shifting to the fully extended position to thereby retain the orifice fully closed.

Another aspect of the present invention is a dispensing valve for fluid products and the like, comprising a container having a dispensing valve mounted therein.

The dispensing valve includes a marginal flange which seals about a discharge opening of the container, and a valve head with an orifice through which fluid product is dispensed. The valve includes a connector sleeve having one end connected with the valve flange, and an opposite end connected with the valve head. The connector sleeve is resiliently flexible, with a sidewall configured to shift the valve head outwardly when pressure within the container is raised above a predetermined discharge pressure. A vent is mounted in the container, and permits ambient air to be drawn into the interior of the container after the fluid product is dispensed therefrom.

Yet another aspect of the present invention is a dispensing package for fluid products and the like, comprising a container having a dispensing valve mounted therein. The dispensing valve includes a marginal flange which seals about a discharge opening of the container, and a valve head with an orifice through which fluid product is dispensed. The valve includes a connector sleeve having a resiliently flexible construction, with one end connected with the valve flange, and an opposite end connected with the valve head. The connector sleeve has a sidewall configuration which extends to shift the valve head outwardly when pressure within the container is raised above a predetermined discharge pressure. The marginal flange portion of the valve includes opposite inner and outer faces which are curved, and diverge from one another to a flat outer marginal edge.

Yet another aspect of the present invention is a dispensing package for fluid product and the like, comprising a container having a dispensing valve mounted therein. The dispensing valve includes a marginal flange which seals about a discharge opening of the container, and a valve head with an orifice through which fluid product is dispensed. The valve includes a connector sleeve having a resiliently flexible construction, with one end connected with the valve flange, and an opposite end connected with the valve head. The connector sleeve has a sidewall configuration which extends to shift the valve head outwardly when pressure within the container is raised above a predetermined discharge pressure. The marginal flange portion of the valve includes opposite inner and outer faces which extend to an outer marginal edge.

The principle objects of the present invention are to provide a dispensing package which is capable of easily and neatly dispensing a wide variety of different types of fluid products. The dispensing package includes a self-sealing valve which is matched with both the container and the type of fluid product to be dispensed, so as to quickly and securely seal, yet readily and fully open when the user applies modest pressure to the container. The valve includes a resiliently flexible connector sleeve which is configured to double over and then extend rollingly, so as to apply a torque to the valve head which assists in opening the orifice. The connector sleeve has sufficient flexibility that pressure increases in the interior of the container, such as those caused by thermal expansion, are offset by shifting the valve head on the connector sleeve, so as to alleviate excess pressure on the orifice. The connector sleeve is also configured to provide sufficient flexibility that any misalignment and/or distortion of the valve flange when attached to the associated container are not transmitted to the valve head, thereby permitting unhindered opening and closing of the orifice. The connector sleeve is also configured to provide sufficient flexibility that shock impact forces, and the like applied to the container are absorbed by shifting the valve head on the connector sleeve, so as to avoid inadvertent opening of the valve orifice. The valve is configured to provide a generally constant flow rate therethrough, even when exposed to a relatively wide range of container pressures. For those products wherein a substantial amount of material is typically dispensed per application, the valve is configured such that once the orifice is shifted open, the amount of pressure required to maintain fluid flow through the orifice is reduced, so as to provide greater ease of operation, without sacrificing secure sealing of the valve. The dispensing package is extremely versatile, and particularly adapted for use in conjunction with bottom dispensing containers, and other similar packaging. The valve is very durable, while having reduced manufacturing costs, and an uncomplicated design. The overall package is efficient in use, economical to manufacture, capable of a long operating life, and particularly well adapted for many different proposed uses.

In addition to those advantages noted hereinabove, the present self-sealing valve can be used in conjunction with containers that have a resilient squeeze type of side-wall construction, as well as containers which have a collapsible sidewall construction. The configuration of the dispensing valve, particularly with respect to the resilient flexible connector sleeve, and associated valve head configuration, are such that the valve will shift to its fully closed position without requiring a negative pressure within the container. The valve may be provided with a uniquely shaped marginal flange, which has an outwardly projecting support edge area that facilitates conveying the valve, such as during assembly operations. Also, the dispensing valve may include a crown shaped valve head, which alleviates nesting during handling, and provides improved air suck back, without sacrificing desirable closing characteristics. The dispensing valve may also be used in conjunction with an improved bottom dispensing container, and may be provided with a valve stop having an inwardly projecting protuberance to positively retain the orifice in its fully closed position. The container may be provided with a venting system, and multiple valve flange and seat designs are available to securely mount the valve in an associated container.

These and other advantages of the invention will be further understood and appreciated by those skilled in the art by reference to the following written specification, claims and appended drawings.

BRIEF DESCRIPTION OF THE DRAWINGS

FIG. 23 is an enlarged, partially schematic, top plan view of a plurality of the valves illustrated in FIGS. 19–22, shown on a conveyor for translation to an assembly station or the like.

DETAILED DESCRIPTION OF THE PREFERRED EMBODIMENTS

Figure 1:
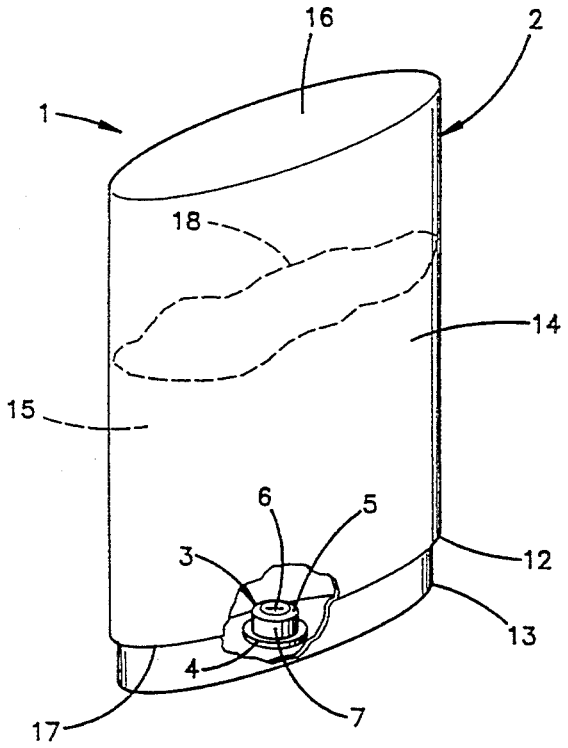
FIG. 1 is a perspective view of a dispensing package embodying the present invention, wherein a portion thereof has been broken away to reveal a self-sealing valve mounted in a bottom portion of an associated container.
Figure 2:
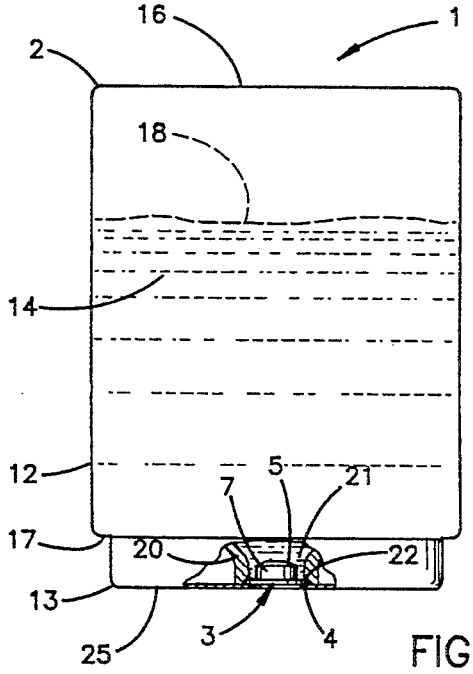
FIG. 2 is a side elevational view of the dispensing package, wherein a portion thereof has been broken away to reveal the valve, which is shown in a fully retracted and fully closed position.
Figure 3:
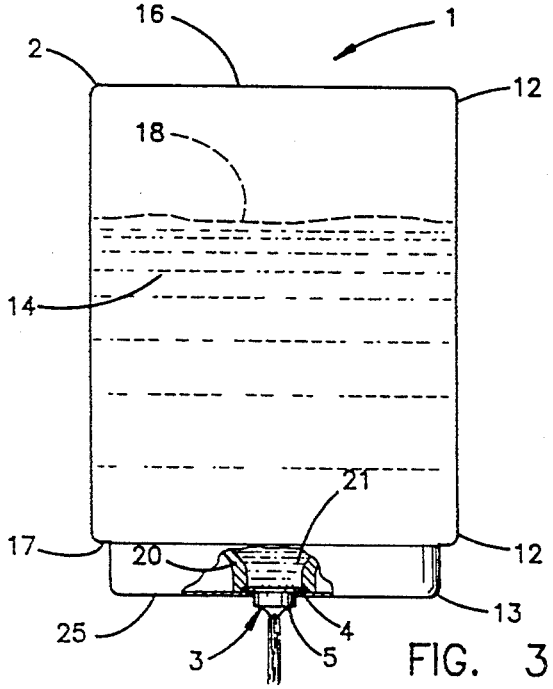
FIG. 3 is a side elevational view of the dispensing package, wherein a portion thereof has been broken away to reveal the valve, which is shown in a fully extended and fully open position.

For purposes of description herein, the terms "upper", "lower", "right", "left", "rear", "front", "vertical", "horizontal", and derivatives thereof shall relate to the invention as oriented in FIGS. 1–3. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a dispensing package embodying the present invention. Dispensing package i is particularly adapted for dispensing fluid products, such as liquid soaps, household cleaners, polishes, moisturizing creams, foodstuffs, and the like, and includes a container 2 with a unique self-sealing dispensing valve 3 mounted therein. Valve 3 includes a marginal flange portion 4, a valve head portion 5 with a discharge orifice 6 therein, and a connector sleeve portion 7, having one end area connected with valve flange portion 4, and the opposite end area connected with valve head portion 5 adjacent a marginal area thereof. Connector sleeve portion 7 has a resiliently flexible construction, such that when pressure within container 2 is raised above a predetermined amount, valve head portion 5 shifts outwardly (FIGS. 8–15) in a manner which causes connector sleeve portion 7 to double over and then extend rollingly.

The illustrated container 2 (FIGS. 1–3) is particularly designed for bottom dispensing, and includes a generally flexible, oblong container body 12 supported on a substantially rigid base 13. Container body 12 is preferably integrally molded from an appropriate synthetic resin material or the like, so as to create a one-piece construction that includes oppositely oriented sidewalls 14 and 15, a top 16 and a bottom 17. The container sidewalls 14 and 15 are laterally flexible to pressurize and depressurize the interior of container 2, and preferably have sufficient resilience or stiffness that they automatically return to their original shape upon release of any external forces which are applied to container 2 to dispense a fluid product 18 therefrom.

Figure 7:
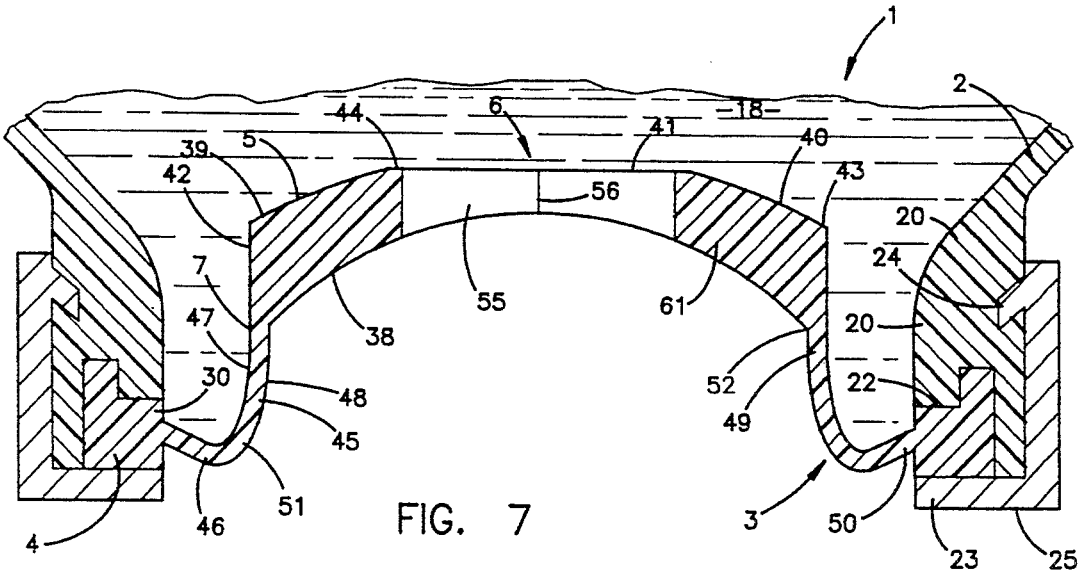
FIG. 7 is an enlarged, cross-sectional view of the valve installed in an associated container, with the valve shown in the fully closed and fully retracted position.
Figure 8:
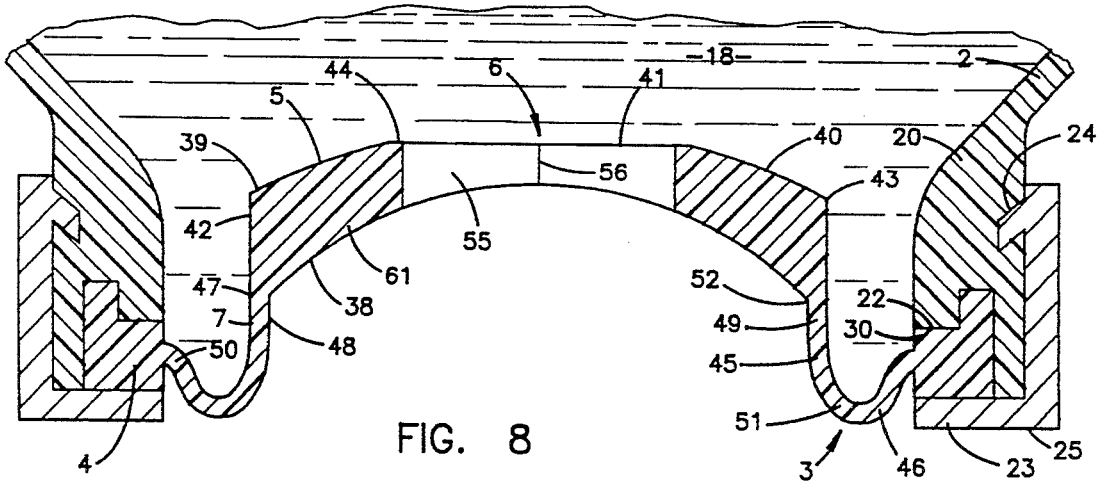
FIG. 8 is an enlarged, cross-sectional view of the valve installed in an associated container, with the valve shown in a fully closed, and partially retracted position.

The illustrated container bottom 17 (FIGS. 2 & 3) includes a downwardly opening neck 20, which defines a discharge opening 21 about which the marginal flange 4 of valve 3 is positioned. As best illustrated in FIG. 7 and 8, the free end of neck 20 includes an annularly shaped groove 22 having a general L-shaped longitudinal cross-sectional configuration, which is shaped to closely receive the marginal flange 4 of valve 3 therein. Container base 13 includes a valve retainer ring 23 positioned adjacent groove 22, and attached to container body 12 by a snap lock arrangement 24. Container base 13 (FIGS. 2 & 3) has a substantially flat bottom 25 adapted to abuttingly support dispensing package i on an associated surface, such as a countertop, sink, worksurface, or the like. Neck groove 22 is located inwardly of the bottom 25 of container base 13, so as to position valve 3 in a generally recessed condition within dispensing package 1, as explained in greater detail hereinafter. Container top 16 may be rounded or tapered to insure that container 2 is positioned in its upright orientation, as shown in FIGS. 1-3.

Figure 4:
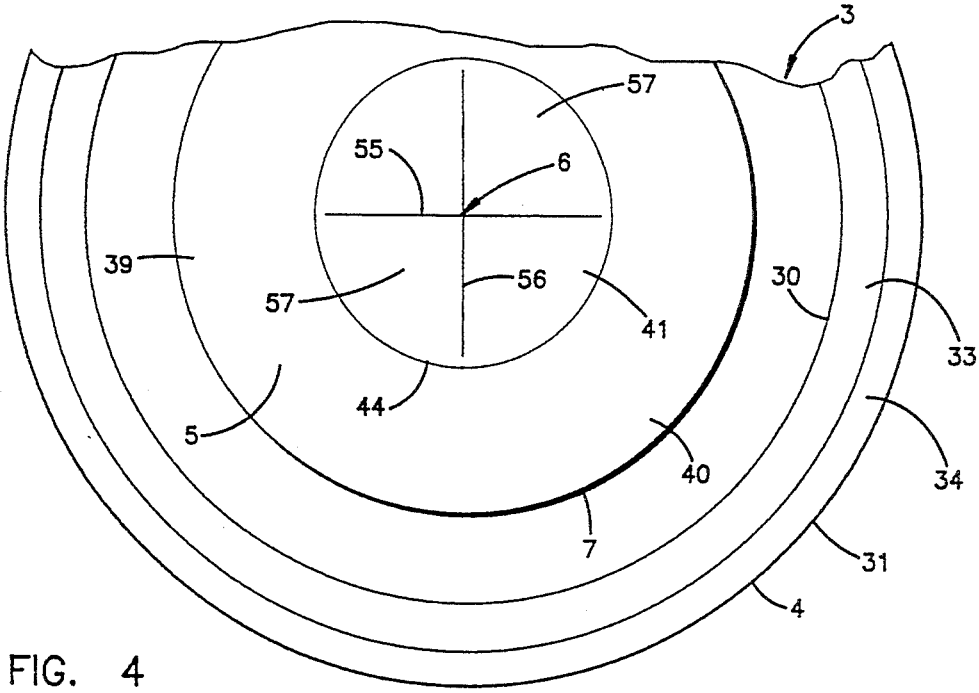
FIG. 4 is an enlarged, fragmentary top view of the valve.
Figure 5:
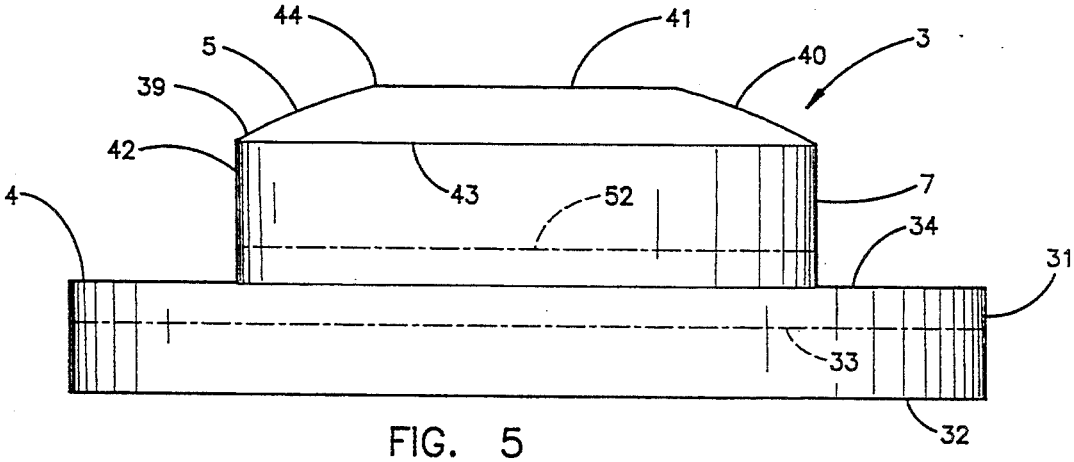
FIG. 5 is an enlarged, side elevational view of the valve.
Figure 6:
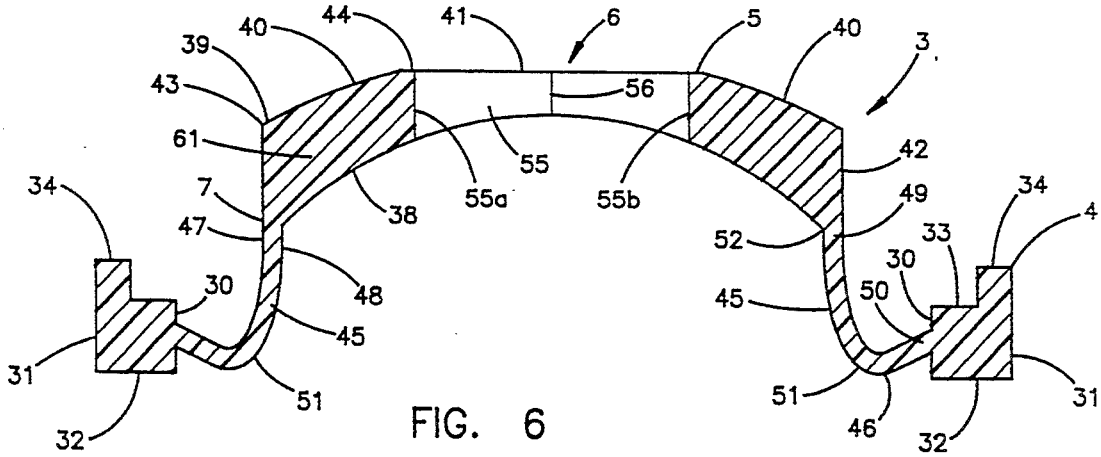
FIG. 6 is an enlarged, cross-sectional view of the valve.

With reference to FIGS. 4-6, the illustrated self-sealing dispensing valve 3 has an integrally formed, one-piece construction. Valve 3 is preferably molded from a resiliently flexible material, and in the illustrated example comprises a silicone rubber which is substantially inert so as to avoid reaction with and/or adulteration of the fluid product being packaged. In one working embodiment of the present invention, valve 3 is produced at relatively high speeds through the molding of liquid silicone rubber.

The illustrated marginal flange portion 4 (FIGS. 4-6) of valve 3 has an annular plan shape, and a substantially L-shaped cross-sectional configuration, comprising an inner edge 30, an outer edge 31, a bottom 32, and a top 33 with an outer rim 34 upstanding therefrom. Marginal valve flange 4 has substantial thickness between the bottom 32 and top 33 which is resiliently compressed upon attachment of retainer ring 23 to form a secure leak-resistant seal therebetween. The rim portion 34 of valve flange 4 positively locks valve 3 in neck groove 22 to prevent any radial movement therebetween.

The illustrated head portion 5 (FIGS. 4-6) of valve 3 has a circular plan shape, and a generally tapered construction which is thicker at the radially outside portion of valve head 5, and thinner at the radially inside portion thereof. This tapered construction assists in achieving the snap open/snap close action of valve 3, as described below. More specifically, in the illustrated example, valve head 5 has an exterior side or surface 38, which has an arcuately shaped side elevational configuration which opens or curves outwardly, toward the exterior of dispensing package 1, and is defined by a first, predetermined radius. Valve head exterior surface 38 extends continuously between the interior sidewalls of connector sleeve 7. Valve head 5 also includes an interior side or surface 39, which has a marginal portion 40 with an arcuately shaped side elevational configuration which opens or curved outwardly, toward the exterior of dispensing package 1, and is defined by a second predetermined radius. The radius of marginal portion 40 on interior surface 39 is larger than that of exterior surface 38, such that the two surfaces converge toward the center of valve head 5, and provide the above-noted inwardly tapered construction of valve head 5. The interior surface 39 of valve head 5 also includes a center portion 41, which has a circular plan shape, with a substantially planar or flat side elevational configuration, oriented generally perpendicularly to discharge orifice 6. The center portion 41 of valve head 5 assists in improving the opening and closing characteristic of valve 3, as set forth below. The outer perimeter of valve head 5 is defined by a circular marginal edge 42, which begins at the outer edge 43 of marginal portion 40, and extends outwardly therefrom with a slight outward taper, ultimately merging into connector sleeve 7. The intersection of the marginal portion 40 and the center portion 41 of valve head 5 defines a circular edge 44. The outside diameter of valve head 5, as measured along marginal edge 42 is substantially smaller than the inside diameter of marginal flange 4, as measured along inner edge 30. As explained in greater detail below, this spacing between valve head 5 and marginal flange 4 permits valve head 5 to shift freely in an axial direction through the center of marginal flange 4.

The illustrated connector sleeve portion 7 (FIGS. 4-6) of valve head 5 is in the form of a rolling diaphragm, having a hollow circular plan configuration, and a generally J-shaped longitudinal cross-sectional shape, comprising a cylindrical sidewall portion 45, and a radially outwardly extending base portion 46. Connector sleeve 7 has interior and exterior surfaces 47 and 48 respectively, which are spaced equidistantly apart along the length thereof, such that connector sleeve 7 has a substantially uniform thickness. One end portion 49 of connector sleeve 7 is connected with the exterior surface 38 of valve head 5 adjacent the marginal edge 42 thereof, and the opposite end portion 50 of connector sleeve 7 is connected with the inner edge 30 of marginal valve flange 4. The interior surface 47 of connector sleeve 7 adjacent end 49 is positioned substantially coplanar and contiguous with the marginal edge 42 of valve head 5, while the opposite end 50 of connector sleeve 7 is connected with marginal valve flange 7 at a medial portion of inner edge 30, such that the base portion 46 of connector sleeve 7 flares in a radially inwardly direction from marginal valve flange 46, and also protrudes outwardly toward the exterior of dispensing package 1 at an arcuate portion 51 of connector sleeve 7. The arcuately flared shape of connector sleeve portion 51 assists connector sleeve 7 in first doubling over, and then rollingly extending as valve head 5 shifts outwardly in the manner described in greater detail below. The marginal attachment point of end 49 of connector sleeve 7 to valve head 5, as well as its associated geometry, increases the effectiveness of torque forces which assist in snapping valve 3 open, as discussed hereinafter. The exterior surface 48 of sleeve side wall 45 at end 49 of connector sleeve 7 intersects the exterior surface 38 of valve head 5 at an angle which defines a circular edge 52. In the illustrated example, the exteriormost area of sleeve arcuate portion 51 is disposed substantially in-line with or slightly interior of the bottom 32 of marginal flange 4, so as to facilitate fabrication. The length of connector sleeve 7 is preferably selected sufficiently short to prevent the same from folding in behind valve head 5 when valve head 5 is in the fully extended position (FIGS. 10-14), thereby avoiding interference with the retraction of valve head 5, which is explained in detail below.

The illustrated one-piece valve 3 has a hat-shaped side elevational configuration in its original, normal condition, wherein valve head 5 assumes a generally concave shape. The resilient flexibility of connector sleeve 7 permits the same to double over and then extend rollingly in the manner described hereinafter. Connector sleeve 7 acts as a rolling diaphragm with valve head 5 mounted at the center thereof in a manner which permits valve head 5 to shift or float freely inwardly and outwardly in an axial direction with respect to the opening 21 in container neck 20.

In the illustrated example, discharge orifice 6 (FIGS. 4-6) has a cross-slit construction which includes two, intersecting linear slits 55 and 56 that extend through the opposite sides 38 and 39 of center portion 41. The illustrated slits 55 and 56 are oriented in a mutually perpendicular relationship, and have their opposite ends 55*a* and 55*b* positioned slightly inwardly from the outer edge 44 of center portion 41. Orifice slits 55 and 56 define four flaps or pedals 57 which flex inwardly and outwardly to selectively permit the flow of fluid product through valve 3. Slits 55 and 56 are preferably formed by slicing through the center portion 41 of valve head 5, without removing any substantial amount of material therefrom, so that the opposite side faces 58 and 59 (FIGS. 13 & 14) of valve flaps 57 closely seal against one another when discharge orifice 6 is in its normally, fully closed position. The length and location of slits 55 and 56 can be adjusted to vary the predetermined opening and closing pressures of valve 3, as well as other dispensing characteristics of dispensing package 1. The side faces 58 and 59 of each valve flap 57 intersect at their free ends to define an end edge 60. That portion of valve head 5 disposed between marginal portion 40, marginal edge 42, slit ends 55*a* & 55*b*, and exterior surface 38 defines a ring portion 61 of the valve head 5, which functions in the manner described in detail hereinafter.

It is to be understood that orifice 6 may assume many different shapes, sizes and/or configurations in accordance with those dispensing characteristics desired. For example, orifice 6 may comprise a single slit, particularly when smaller or narrower streams are desired. Orifice 6 may also include three or more slits, particularly when larger or wider streams are desired, and/or the fluid product contains aggregates, such as some types of salad dressings, and the like. Other forms of orifices 6, such as holes, duck bills, etc. may also be incorporated into valve 3.

Self-sealing dispensing valve 3 is preferably especially configured for use in conjunction with a particular container 2, and a specific type of fluid product, so as to achieve-the exact dispensing characteristics desired. For example, the viscosity and density of the fluid product are both important factors in designing the specific configuration of valve 3, as is the shape, size, and strength of container 2, particularly when dispensing package 1 is configured for bottom dispensing. The rigidity and durometer of the valve material, and size and shape of both valve head 5 and connector sleeve 7 are also important in achieving the desire dispensing characteristics, and should be carefully matched with both the container 2 and fluid material 18 to be dispensed therefrom.

One working embodiment of the present invention is particularly designed to dispense fluid household products therefrom, such as dishwasher detergents, liquid soap, moisturizing creams, foodstuffs, and the like. When such fluid product materials are to be dispensed from a blow molded, polypropylene container with valve 3 positioned at the bottom 4 thereof for bottom dispensing, one specific valve 3 found to be particularly suited is as follows. The outside and inside diameters of marginal valve flange 4 are 0.7000 and 0.5802 inches respectively, while the outside diameter of the marginal edge 42 of valve head 5 is 0.4391 inches, and the outside diameter of center portion 41 is around 0.2212 inches. The thickness of connector sleeve 7 is approximately 0.0130 inches, and has an overall height, as measured from the bottom 32 of marginal flange 4 to the edge 52 of valve head 5 of 0.1159 inches. The radius of valve head exterior surface 38 is 0.2900 inches, while the radius of the marginal portion 40 of interior surface 39 is 0.0350 inches. Hence, the total thickness of valve head 5 at marginal edge 42 is around 0.0778 inches and around 0.0350 inches at the middle of center portion 41. The overall height of valve 3, as measured from the bottom 32 of marginal flange 4 to the top of center portion 41 is approximately 0.2402 inches. Slits 55 and 56 have a length of around 0.2200 inches, and are centered squarely in valve center portion 41. The valve is molded integrally from a liquid silicone rubber of the type manufactured under the trademark "SILASTIC SR" by Dow Corning Corporation.

Experimental tests conducted on valves having the above-identified specific dimensions and characteristics indicate that valve 3 snaps open when exposed to a pressure inside container 2 equal to approximately 25–28 inches of water. That pressure which causes valve 3 to snap open is generally referred to herein as the predetermined dispensing or opening pressure. Valve 3 will automatically snap closed when the interior pressure of container 2 drops below a pressure equal to approximately 16–18 inches of water. That pressure which causes valve 3 to snap closed is generally referred to herein as the predetermined closing pressure. While the noted valve 3 is open, a substantially constant flow or stream of fluid product is discharged through orifice 6, even when extra pressure is exerted on container 2.

It is to be understood that according to the present invention, valve 3 may assume many different shapes and sizes, particularly in keeping with the type of container 2 and fluid product to be dispensed therefrom. The predetermined opening and closing pressures of valve 3 may be varied widely in accordance with those dispensing criteria desired for a particular product. Flow characteristics of the dispensed fluid product can also be adjusted substantially, such as for relatively wide column-like streams, thin needle-like streams, dollops, and the like.

In operation, dispensing package 1 functions in the following manner. Valve 3 normally assumes the inwardly protruding orientation illustrated in FIG. 7, wherein valve 3 remains substantially in its original molded shape without deformation, with connector sleeve 7 being fully retracted and discharge opening 6 being fully closed. When valve 3 is mounted in the bottom of container 2, as is shown in the illustrated bottom dispensing package 1, valve 3 is configured such that discharge orifice 6 will remain securely closed, even under the hydraulic head pressure applied thereto by the fluid product 18 when the container 2 is completely full.

When additional pressure is communicated with the interior of container 2, such as by manually flexing container sidewalls 14 and 15 inwardly, connector sleeve 7 functions as a rolling diaphragm, and permits valve head 5 to begin shifting axially outwardly toward the exterior of dispensing package i by doubling over connector sleeve 7, which then in turn, begins to extend outwardly in a rolling fashion, as illustrated in FIG. 8. The outwardly protruding J-shaped configuration of connector sleeve 7 assists in initiating this rolling motion of connector sleeve 7. The elastic deformation of connector sleeve 7 from its original molded shape (FIG. 7), generates a complex pattern of stresses within valve 3 which resiliently urges the same back into its original or normal configuration, which forces include an outwardly directed torque applied by connector sleeve 7 to valve head 5 adjacent marginal edge 42, which tends to resiliently urge discharge orifice 6 toward its open position, as described in greater detail below.

Figure 9:
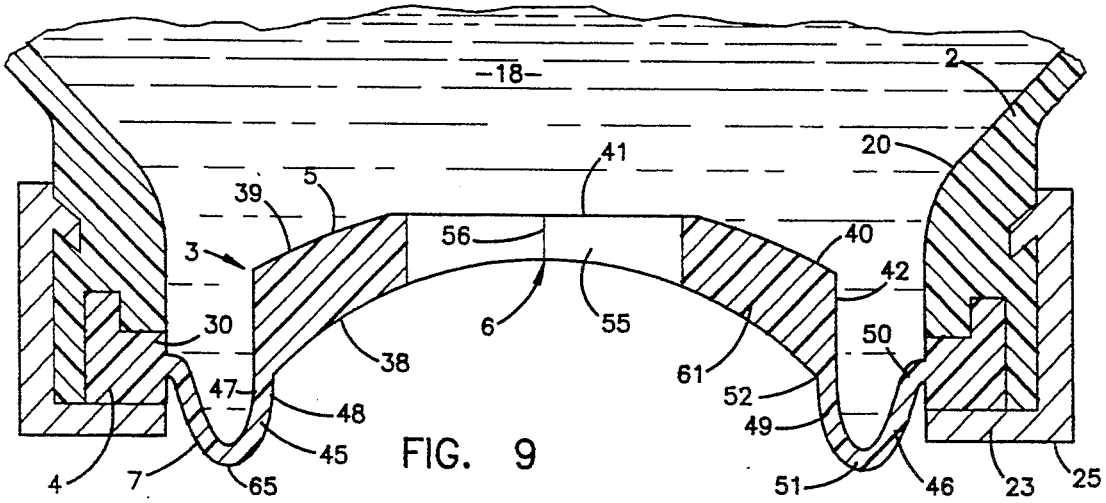
FIG. 9 is an enlarged, cross-sectional view of the valve installed in an associated container, with the valve shown in a fully closed and partially extended position.

When additional pressure is communicated with the interior of container 2, as illustrated in FIG. 9, valve head 5 continues to shift axially outwardly by rolling connector sleeve 7 over upon itself. The marginal edge 42 of valve head 5 passes through the center of marginal valve flange 4.

Figure 10:
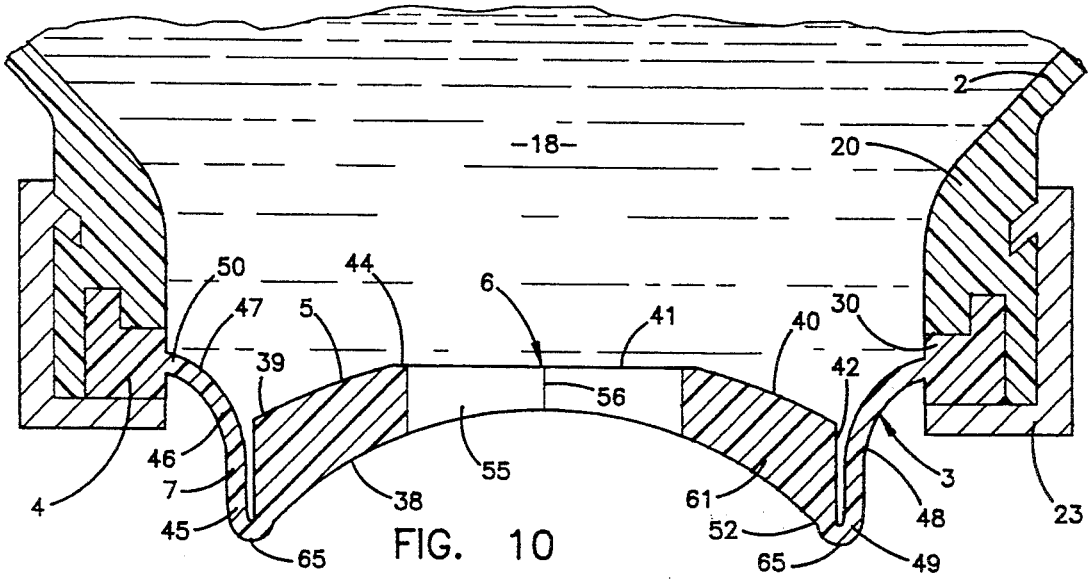
FIG. 10 is an enlarged, cross-sectional view of the valve installed in an associated container, with the valve shown in a fully closed and fully extended position.

When additional pressure is communicated with the interior of container 2, valve head 5 continues to extend outwardly toward the exterior of dispensing package 1 until connector sleeve 7 is fully extended, as illustrated in FIG. 10. When valve heads are in the fully extended position (FIG. 10), the stress forces built up in connector sleeve 7 cause the sidewall portion 45 of the connector sleeve 7 to assume a generally cylindrical shape concentric with and about the marginal edge 42 of valve head 5. Sidewall 45 of connector sleeve 7 is folded back 180 degrees from its original molded shape, to an orientation parallel with the marginal edge 42 of valve head 5, and defines an exterior lip or rim 65.

Figure 11:
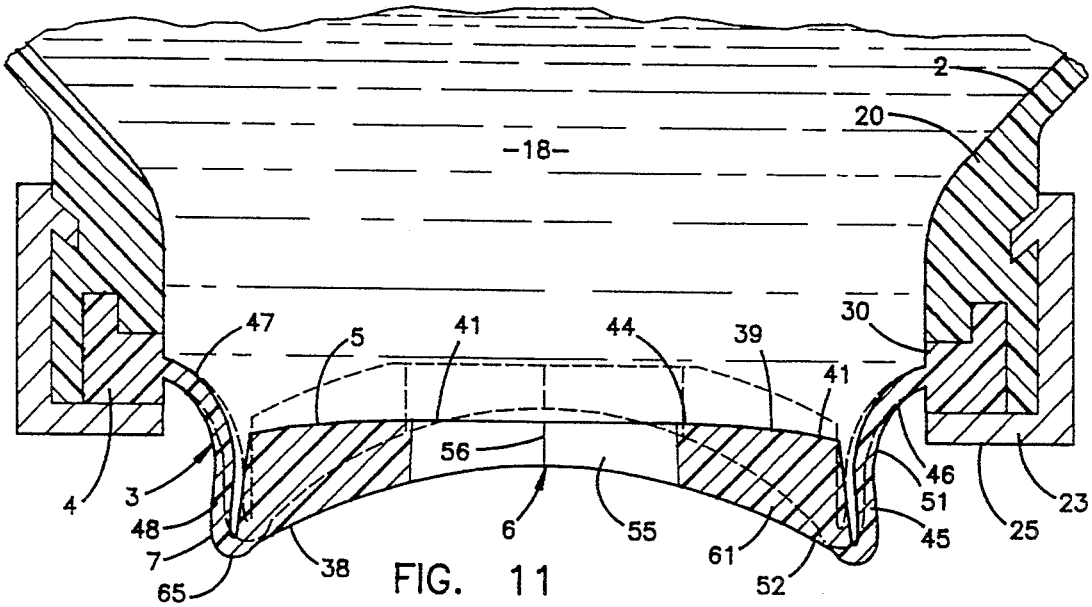
FIG. 11 is an enlarged, cross-sectional view of the valve installed in an associated container, with the valve shown in a fully closed and fully extended position, wherein a valve head portion thereof is shown beginning to snap outwardly.

When additional pressure is communicated with the interior of container 2, as illustrated in FIG. 11, valve head 5 continues to shift outwardly. However, since connector sleeve 7 is fully extended, further outward shifting of valve head 5 longitudinally tenses or stretches connector sleeve 7, thereby increasing the outwardly directed torque applied to the valve head 5. Also, the further outward movement of valve head 5 tends to flatten or straighten valve head 5, particularly along the exterior surface 38 thereof, as best illustrated in FIG. 11. This flattening motion tends to enlarge or dilate the circular plan configuration of valve head 5, which enlargement is in turn resisted by radially inwardly directed forces applied to the marginal edge 42 of valve head 5 by connector sleeve 7, thereby generating another complex pattern of stresses within valve 3, which forces include those which tend to compress valve head 5 in a radially inward direction. Due to the tapered shape of valve head 5, the majority of compression strain is believed to take place adjacent the center portion 41 of valve head 5. As best illustrated by a comparison of the broken line figure and the full line figure provided in FIG. 11, when connector sleeve 7 is in the fully extended position, as shown in the broken lines, and additional pressure is communicated with the interior side 39 of valve 3, exterior rim 65 moves axially outwardly and radially outwardly as shown in the full lines of FIG. 11. The marginal edge 42 of valve head 5 is shown bent or elastically deformed inwardly as a consequence of the torque forces applied thereto by connector sleeve 7.

Figure 12:
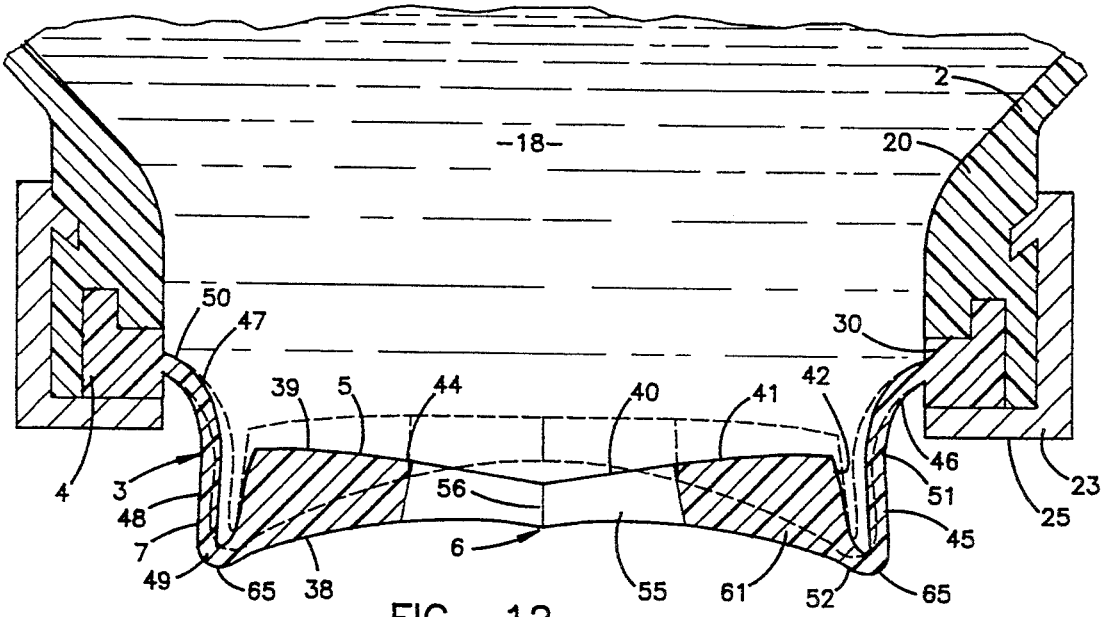
FIG. 12 is an enlarged, cross-sectional view of the valve installed in an associated container, with the valve shown in a fully closed, and fully extended position, wherein the valve head portion is shown continuing to snap outwardly.

When additional pressure is communicated with the interior of container 2, as illustrated in FIG. 12, valve head 5 continues to shift outwardly by further longitudinal stretching of connector sleeve 7, and further enlargement of the plan shape of valve head 5. This motion is best illustrated by a comparison of the broken line figure and the full line figure provided in FIG. 12. Exterior rim 65 moves from the condition illustrated in FIG. 11, which corresponds to the broken line figure of FIG. 12, in an axially outwardly and radially outwardly fashion to the position shown in the full lines of FIG. 12. The marginal edge 42 of valve head 5 is shown more bent or elastically deformed inwardly, as a consequence of the increased torque forces applied thereto by connector sleeve 7. These combined forces and motions also serve to further compress valve head 5 into a state of bifurcation, as illustrated in FIG. 12, wherein the combined forces acting on valve head 5 will, upon application of any additional outward force on the interior side 39 of valve 3, cause the same to quickly open outwardly with a snapping motion to separate valve flaps 57 in the manner illustrated in FIGS. 13 and 14, and thereby dispense liquid product through discharge orifice 6. The bifurcation state of valve 3, as the term is used herein, is illustrated in FIG. 12, and defines a relatively unstable condition which valve 3 assumes immediately prior to opening into the fully open condition shown in FIGS. 13 & 14. As valve 3 passes through the bifurcation state shown in FIG. 12, the combined forces acting on valve head 5 are in a very temporary, unstable condition of equilibrium for a given moment, and then quickly shift valve head 5 into a generally outwardly protruding shape, simultaneously opening orifice 6. In the bifurcation state shown by the full lines in FIG. 12, valve head 5 assumes the shape of a nearly planar disc, with exterior surface 38 cupped inwardly between rim 65 and flap edges 60, and interior surface 39 bent slightly outwardly toward the center of orifice 6.

The snap type opening of valve 3 is achieved, at least in part, by the torque exerted on valve head 5 by connector sleeve 7, which as noted in the example illustrated in FIG. 12, is sufficient to substantially distort the shape of the marginal edge 42 of valve head 5. When valve 3 assumes the fully extended and fully open position illustrated in FIGS. 13 & 14, valve flaps 57, as well as the associated rim portion 61 of valve head 5 are bent or elastically deformed outwardly, thereby permitting the rim 65 of valve head 5 to become smaller or constrict slightly. Valve flaps 57 tend to fold openly along lines extending between the ends 55*a* and 55*b* or orifice slits 55 and 56. The continued radial inwardly compression applied to valve head 5 by connector sleeve 7, in addition to the outwardly oriented torque applied thereto by connector sleeve 7, combine to keep discharge orifice 6 in the fully open position, even if the pressure communicated with the interior of container 2 is reduced. Hence, after discharge orifice 6 has been opened through the application of the predetermined opening pressure, that pressure which is required to maintain fluid flow through orifice 6 is reduced, or less than the threshold pressure, so as to provide greater dispensing ease and flow control. Since the resiliency of connector sleeve 7 serves to resist the dilating action of valve head 5, and thereby compresses the same to achieve a snap open/snap close motion, if the resiliency of connector sleeve 7 is varied somewhat, such as by making connector sleeve 7 thicker or thinner, the amount or degree of snap action can be thereby adjusted for any specific application. Similarly the resilient strength of ring 61 can be adjusted to accomplish the desired snap action.

Figure 13:
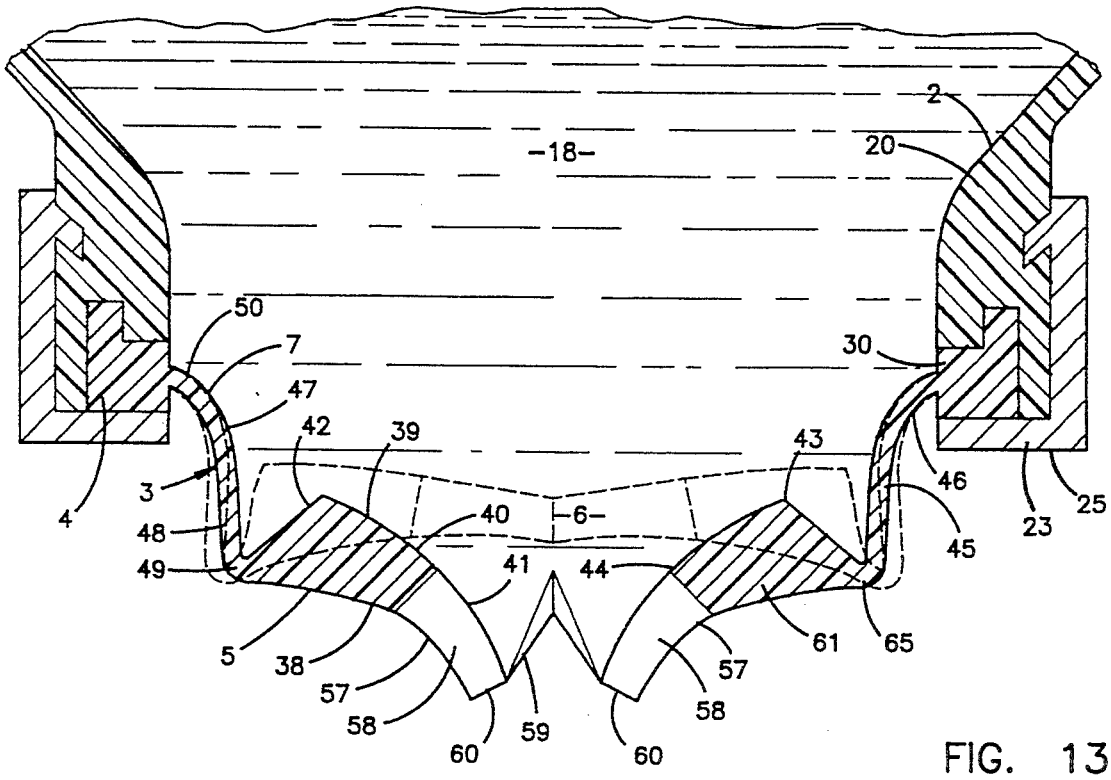
FIG. 13 is an enlarged, cross-sectional view of the valve installed in an associated container, with the valve shown in a fully extended position, wherein the valve head portion is shown snapped fully outwardly and fully open.
Figure 14:
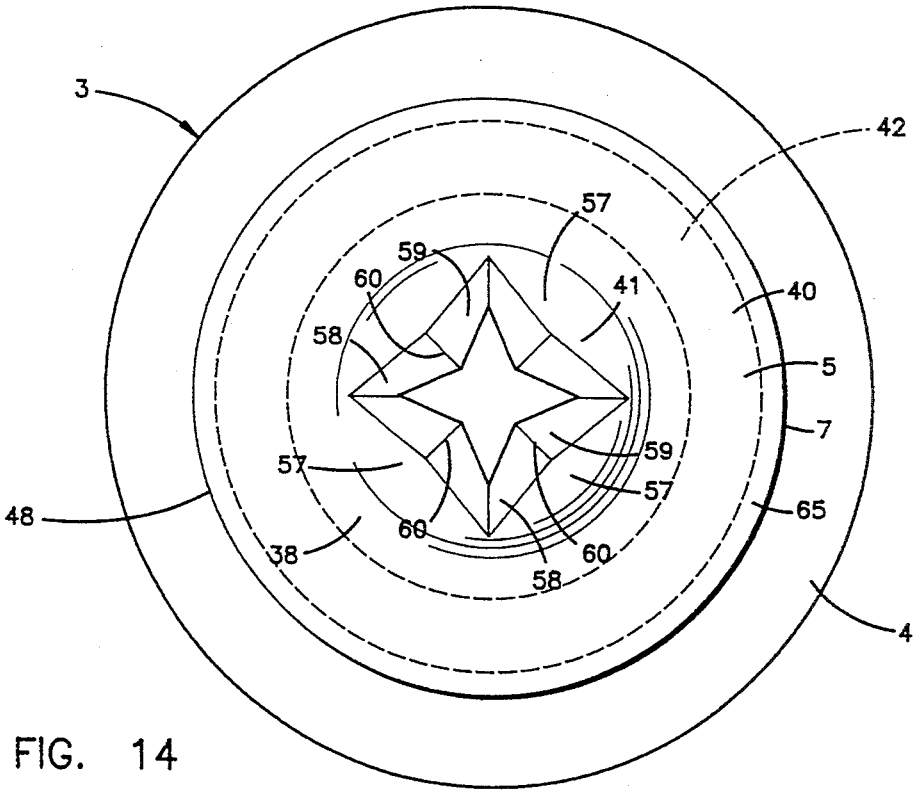
FIG. 14 is an enlarged, bottom plan view of the valve shown in the position illustrated in FIG. 13.

The combined compressive and torque forces acting on valve head 5 by connector sleeve 7 open valve flaps 57 to a generally predetermined configuration, such that the rate of flow through discharge orifice 6 remains substantially constant, even though significant pressure differences are applied to container 2. As best illustrated in FIGS. 13 and 14, after valve 3 passes through the bifurcation state shown in FIG. 12, in the direction of opening, it quickly and positively assumes the fully open condition shown in FIGS. 13 and 14, wherein the end edges 60 of valve flaps 57 diverge radially outwardly, such that discharge opening 6 assumes a star shaped plan configuration, as best seen in FIG. 14. The marginal edge 42 of valve head 5 rotates or pivots inwardly somewhat under the pressure of fluid product 18, and the resilient torque applied thereto by connector sleeve 5, which continues to resiliently urge valve 3 back toward its original molded shape (FIG. 7). Connector sleeve 7 remains tensed both axially and circumferentially under outwardly directed forces generated by the pressures within container 2, as well as the dynamic flow of fluid product through orifice 6. The geometry of the illustrated valve 3, particularly in the shape of valve head 5 and connector sleeve 7, serve to force valve 3 into the configuration shown in FIGS. 13 and 14 whenever orifice 6 is snapped opened.

When pressure within the interior of container 2 is reduced, discharge orifice 6 will still remain open in substantially the fully open position shown in FIGS. 13 & 14, until the pressure reaches the preselected closure pressure, at which point, the forces developed in connector sleeve 7 through elastic deformation from its original molded shape (FIG. 7), pulls valve head 5 inwardly, back through the bifurcation state, and into the concave orientation shown in FIG. 10, thereby positively and securely closing discharge orifice 6 with a snapping action, similar to that action by which discharge orifice 6 opened. The snap closing motion of valve head 5 serves to close orifice 6 very quickly and very completely, so as to sharply cut off the stream of fluid product being dispensed from package 1 without any drops or dribbles, even when very viscous and/or dense products are being dispensed. Valve 3 will continue to assume the fully closed, fully extended position illustrated in FIG. 10, until such time as the interior pressure in container 6 is further reduced, so as to permit the resiliency in connector sleeve 7 to shift valve head 5 back into the fully retracted, initial position illustrated in FIG. 7.

At least some of those valves 3 contemplated by the present invention have a relatively high predetermined closing pressure, such as in the nature of 17–18 inches of water, so that orifice 6 will snap securely closed even if container 2 does not provide any suck back, or negative pressure. Furthermore, the connector sleeve 7 of at least some such valves 3 is constructed to provide sufficient resiliency to automatically shift valve head 5 back to the fully retracted position (FIG. 7) without any suck back or negative pressure from container 2. Hence, valves 3 can be readily adapted for use in conjunction with containers which include collapsing bags, tubes or the like. Also, valves 3 are particularly adapted for bottom dispensing packages, such as those illustrated in FIGS. 1–3, where valve 3 normally supports a column of liquid product.

In many embodiments of dispensing package 1, container 2 will be designed with relatively stiff sidewalls 14 and 15 which resume their original shape after being squeezed. In such embodiments, the suck back of air into container 2 after dispensing fluid product therefrom is typically desired to prevent collapsing the container 2, and thereby facilitate continued ease of dispensing until container 2 is completely empty. When valve 3 is in the fully closed and fully retracted position (FIG. 9), the concave configuration of valve head 5 permits orifice 6 to readily open inwardly so that air can be sucked back into the interior of container 2, yet positively prevents orifice 6 from opening outwardly in a manner which would permit leakage. Hence, even relatively weak, thin walled containers 2 can be used with valve 3 without significant collapsing of container sidewalls 14 and 15.

Figure 15:
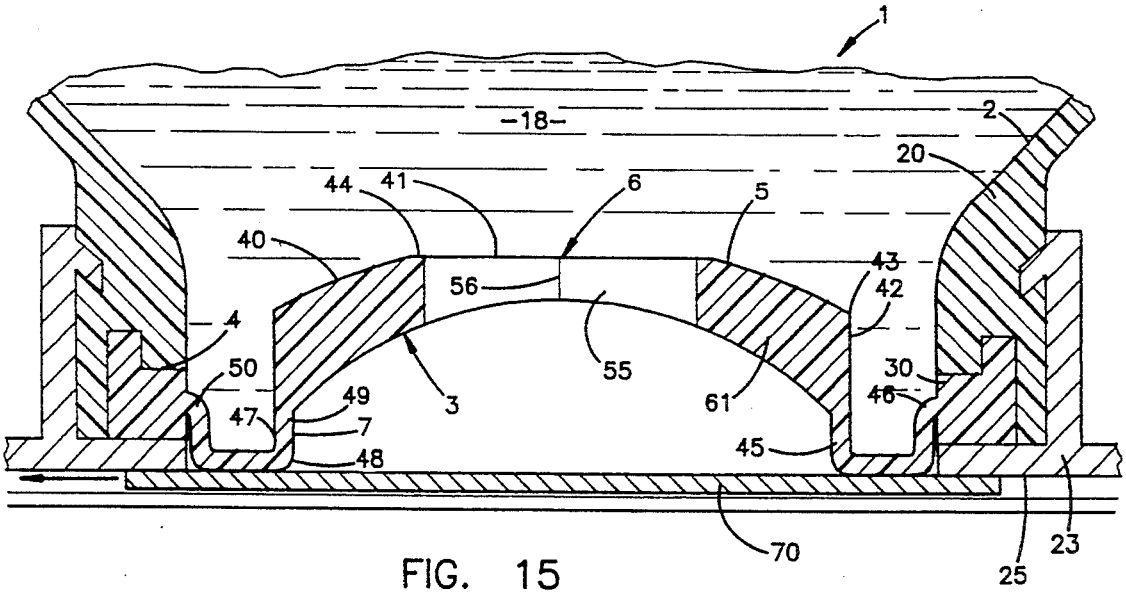
FIG. 15 is an enlarged, cross-sectional view of the valve installed in an associated container, with the valve shown in a fully closed, and partially extended position abutting a container closure.

With reference to FIG. 15, dispensing package 1 may be provided with a positive closure arrangement to prevent inadvertent discharge when dispensing package 1 is being transported, or the like, such as for initial shipping, travel, etc. The dispensing package 1 shown in FIG. 15 includes a sliding closure 70, which when closed, physically blocks the outward rolling extension of connector sleeve 7 and associated valve head 5. By constraining the outwardly extending motion of connector sleeve 7, valve head 5 is prevented from inverting into a convex configuration, and thereby keeps discharge orifice 6 fully closed. When closure 70 is slid sideways out from underneath valve 3, valve 3 is then free to reciprocate and open orifice 6 to dispense liquid product from container 2.

Figure 16:
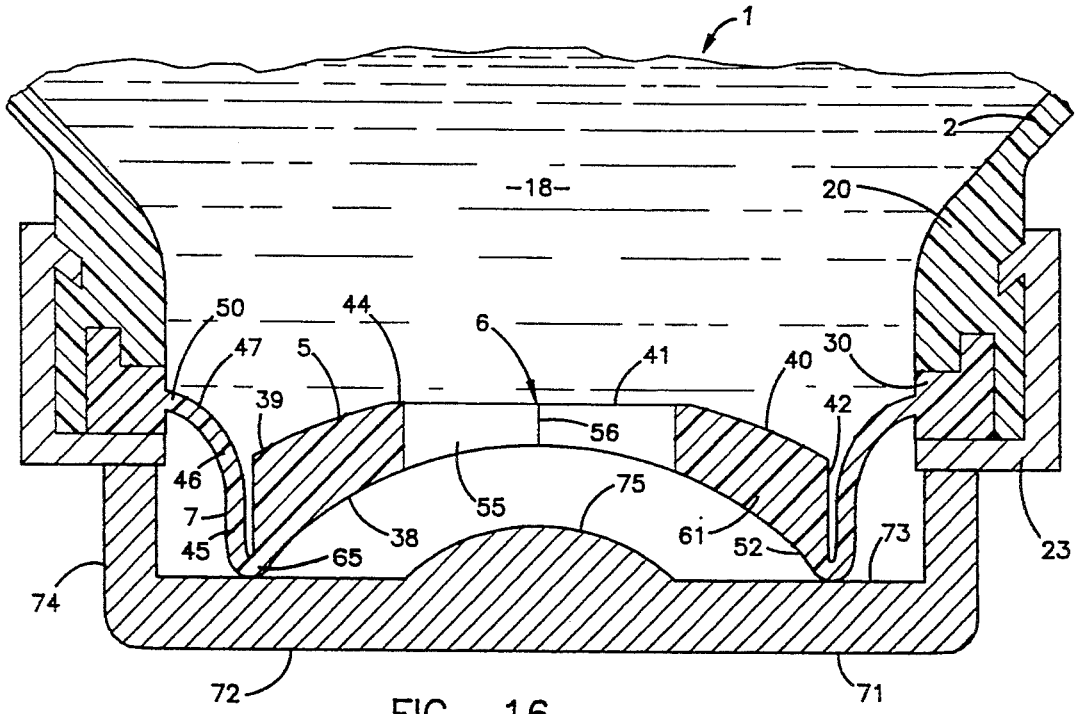
FIG. 16 is an enlarged, cross-sectional view of the valve installed in an associated container, with the valve shown in a fully closed and fully extended position abutting an alternative container closure.

FIG. 16 is a partially schematic view of an alternative closure arrangement for dispensing package 1, wherein a removable cap 71 is provided for detachable connection with retainer ring 23 by conventional fastener means, such as a snap lock, hinge, etc. (not shown). The illustrated cap 71 has a generally flat exterior surface 72, an interior surface 73, and a cylindrical side wall 74, which is sized and shaped such that interior cap surface 73 abuts the rim 65 of valve 3 when valve head 5 is in its fully extended position. The central portion of cap interior surface 73 includes an inwardly projecting protuberance 75, which in the illustrated example, is generally in the form of a convex, semi-spherical node that extends inwardly toward valve 3 to a position adjacent to the cupped exterior surface 38 of valve 3. Node 75 is shaped to positively retain valve head 5 in a concave configuration, and thereby securely maintain orifice 6 fully closed.

The reciprocating motion of valve head 5 on rolling connector sleeve 7 provides dispensing package 1 with several important advantages. For example, connector sleeve 7 is preferably configured with sufficient flexibility that abnormal pressure increases developed within the interior of container 2, such as those caused by thermal expansion, or the like, are offset by the axial shifting motion of valve head 5 with respect to connector sleeve 7, so as to alleviate excess pressure on discharge orifice 6. In this manner, if dispensing package 1 were used in conjunction with a liquid soap or shampoo that was designed for hanging in an inverted condition in a shower or bath, when ambient temperatures within the shower rise, instead of communicating the associated pressure increases directly to discharge orifice 6 in a manner which might cause it to inadvertently open, valve head 5 shifts axially outwardly to relieve any such pressure, and thereby prevent any inadvertent leakage of the fluid product from dispensing package 1.

Another example of the benefits achieved by the rolling diaphragm action of connector sleeve 7 and axial reciprocating motion of valve head 5, is that connector sleeve 7 is preferably configured with sufficient flexibility that any misalignment and/or distortion of the valve flange 4, such as that experienced when attaching the valve to container 2, are not transmitted to valve head 5, thereby permitting unhindered operation of discharge orifice 6. As previously noted, due to the inherently sticky nature of liquid silicone rubber, the attachment of valves constructed from the same to a container 2 can be quite difficult, and ofttimes results in some type of unequal compression and/or distortion of the marginal flange 4 of valve 3. Without the rolling diaphragm action of connector sleeve 7, any such distortion is communicated directly to the valve head 5, which in turn distorts discharge orifice 6, and alters important design characteristics such as its predetermined opening pressure, closing pressure, flow rate, etc. The rolling diaphragm connector sleeve 7 associated with the present valve 3 tends to insulate or isolate valve head 5 from marginal flange 7, such that it can float freely, and thereby avoid such problems.

Yet another example of the benefits achieved by this aspect of the present invention is that connector sleeve 7 is preferably configured with sufficient flexibility that vibrations, shock impact forces, and the like applied to container 2 are absorbed and/or dampened by shifting valve head 5 on rolling connector sleeve 7, so as to avoid inadvertent opening of discharge opening 6. In the event dispensing package 1 is dropped onto the floor, slammed forcefully against a worksurface, or otherwise jarred or shook, the shock forces arising from the acceleration and/or deceleration of the fluid product within container 2 would otherwise be communicated directly with the discharge orifice 6, and tend to cause it to open inadvertently. However, the rolling connector sleeve 7 action of valve 3 serves as a cushion or shock absorber for such shock impact forces, and thereby greatly alleviates the chance for the inadvertent discharge of fluid product from dispensing package 1. In a similar manner, when dispensing container 1 is used for non-homogenous fluids, such as some types of salad dressings, or the like, which are typically shook prior to use, connector sleeve 7 assists in absorbing these vibrations, and thereby prevent leakage.

Yet another example of the benefits achieved by this aspect of the present invention is that connector sleeve 7 is preferably configured with sufficient flexibility that only very moderate pressures, substantially lower than the predetermined opening pressure of valve 3, are required to shift valve head 5 from the fully retracted position (FIG. 7) to the fully extended position (FIG. 10), thereby improving the dispensing "feel" of the package 1. When the user grasps container 2, even a very light squeeze on sidewalls 14 and 15 will rollingly extend connector sleeve 7 and valve head 5 to the fully extended and fully closed position shown in FIG. 10, at which point valve head 5 halts momentarily and further movement of the fluid product is resisted until additional forces are exerted on container 2 which result in an internal pressure within container 2 greater than the predetermined opening pressure of valve 3. This motion of connector sleeve 7 and valve head 5 is sensed by the user through touch or feel, typically in the form of a vibration or ripple experienced in container sidewalls 14 and 15 when valve head 5 reaches the fully extended position (FIG. 10). This ripple motion signals the user that valve head 5 is fully extended, and that further pressure will cause valve 3 to snap open and dispense fluid product. When valve 3 snaps open and snaps closed, similar vibrations or ripples are communicated to the user through container sidewalls 14 and 15 to assist in achieving accurate flow control.

In the illustrated examples of dispensing package 1, valve 3 is mounted within container 2 in a manner which causes valve head 5 to shift between the fully retracted position shown in FIG. 7 wherein valve 3 is disposed wholly within the interior of container 2 for safely storing valve 3, and the fully extended discharge position shown in FIGS. 13 & 14 wherein valve head 5 and associated orifice 6 are disposed wholly outside container 2 for neatly dispensing the fluid product therethrough. By shifting valve head 5 between these two extreme positions, valve 3 can remain normally unexposed and secure within the container 2 when not in use, without sacrificing neatness when dispensing. Also, valve 3 is preferably positioned in container 2 so that the arcuate portion 51 of connector sleeve 7 is disposed adjacent the bottom 25 of container base 13, so that if dispensing package is slammed down onto a surface, abutment between valve 3 and the surface will prevent valve 3 from shifting to the fully extended position, and thereby keep orifice 6 closed to prevent inadvertent leakage.

Dispensing package 1 is extremely versatile, being capable of easily and neatly dispensing a wide variety of fluid products. The self-sealing valve 3 is matched with both the container 2 and the type of liquid product 18 to be dispensed therefrom, so as to quickly and securely seal, yet readily open upon manipulation by the user, without requiring excess pressure or forces. The resiliently flexible connector sleeve 7, which is configured to double over and extend rollingly, accommodates for thermal expansion within container 2, absorbs shock impact forces to the container, accommodates for any misalignment and/or distortion which might be applied to the valve flange in attaching the same to the container, and provides a unique dispensing feel which greatly facilitates accurate dispensing. Valve 3 is configured so that when orifice 6 snaps open, a generally constant flow rate is established therethrough, even when container 2 is subjected to a relatively wide range of pressures. Valve 3 is also preferably configured such that once discharge orifice 6 is open, the amount of pressure required to maintain fluid flow is reduced, so as to provide greater ease of operation and control, without sacrificing secure sealing. Dispensing package 1 is particularly adapted for bottom dispensing configurations, shake containers, and other similar packaging concepts, without leakage.

Figure 17:
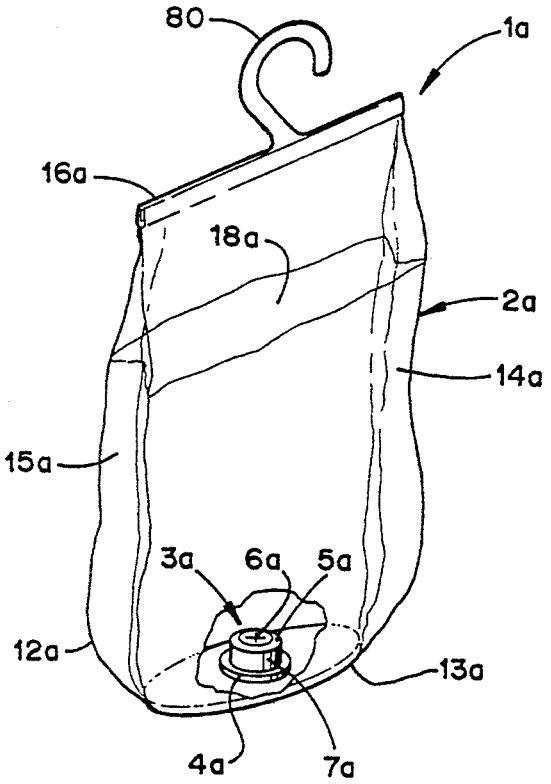
FIG. 17 is a perspective view of another embodiment of the present dispensing package, wherein a portion thereof has been broken away to reveal a self-sealing valve mounted in a bottom portion of a collapsible wall container.

The references numeral 1*a* (FIG. 17) generally designates another dispensing package embodying the present invention, wherein one of the previously described dispensing valves is mounted in a collapsible bag type of container. Since dispensing package 1*a* is similar to the previously described dispensing package 1, similar parts appearing in FIGS. 1–16 and FIG. 17 respectively are represented by the same, corresponding reference numeral, except for the suffix "a" in the numerals of the latter. In dispensing package 1*a*, container 2*a* is particularly designed for bottom dispensing, and includes a collapsible container body 12*a* having a rigid base 13*a* in which valve 3*a* is mounted. Container body 12*a* is preferably integrally formed from a section of flexible film or the like, in the nature of a bag, and includes collapsible sidewalls 14*a* and 15*a*. The container sidewalls 14*a* and 15*a* are sufficiently flexible that they readily collapse inwardly toward one another when fluid product 18*a* is dispensed from container 2*a*. In the illustrated example, a hook-shaped hanger 80 is provided adjacent the top 16*a* of container body 12*a* at a medial portion thereof, and serves to detachably hang container 2*a* in a suspended orientation from an associated support (not shown).

The self-sealing dispensing valve 3*a* mounted in container 2*a* is identical to the previously described dispensing valve 3, and includes a marginal flange 4*a*, a valve head 5*a* with a discharge orifice 6*a* therein, and a connector sleeve 7*a*, having one end area thereof connected with valve flange 4*a*, and the opposite end area thereof connected with valve head 5*a* adjacent a marginal portion thereof.

In general, dispensing valve 3*a* operates the same as dispensing valve 3, as illustrated in FIGS. 7–14, and described in the related specification. However, when fluid product 18*a* is dispensed from dispensing package 1a, the walls 14a and 15a of container 2a simply collapse, and do not shift back into their original shape, as experienced with previously described container 2. In dispensing package 1a, the resilient flexibility of connector sleeve 7a applies an outwardly directed torque or leverage to the valve head 5a when pressure within container 2a is raised above the predetermined discharge pressure, so as to assist in opening orifice 6a. The connector sleeve 7a of valve 3a also applies an inwardly directed torque or leverage to valve head 5a when the predetermined discharge pressure within container 2a is released, so as to assist in closing orifice 6a. The closing torque generated within dispensing valve 3a is sufficient to positively shift valve 3a into its fully closed position, without requiring any negative pressure or suck back within the interior of container 2a, thereby permitting the use of valve 3a with a collapsible bag type of container 2a. When the hydraulic head acting on valve 3a falls below a preselected amount, valve 3a will further shift into its fully retracted position. Hence, the same self-sealing dispensing valve 3 and 3a can be effectively used with either the bag type collapsible wall container 2a illustrated in FIG. 17, or the squeeze type resilient wall container 2 illustrated in FIG. 1.

Figure 18:
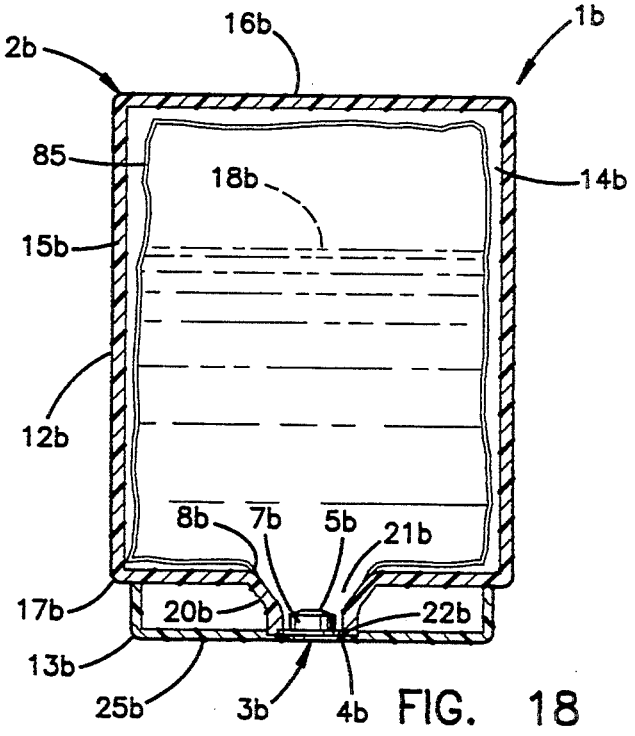
FIG. 18 is a vertical cross-sectional view of yet another dispensing package embodying the present invention, wherein a self-sealing valve is mounted in a bottom portion of a squeeze type container having an interior collapsible bag liner.

The reference numeral 1b (FIG. 18) generally designates yet another dispensing package embodying the present invention, wherein one of the previously described dispensing valves is mounted in a squeeze type resilient wall container having a collapsible liner mounted on the interior thereof. Since dispensing package 1b is similar to the previously described dispensing packages 1 and 1a, similar parts appearing in FIGS. 1–17 and FIG. 18 respectively are represented by the same, corresponding reference numeral, except for the suffix "b" in the numerals of the latter. Dispensing package 1b includes a multi-part container 2b, having a self-sealing valve 3b mounted therein which is identical to the previously described dispensing valves 3 and 3a. Container 2b is also particularly designed for bottom dispensing, and includes a general flexible, oblong container body 12b supported on a substantially rigid base 13b. Container body 12b is preferably integrally molded from an appropriate synthetic material or the like, so as to create a one-piece construction that includes oppositely oriented sidewalls 14b and 15b, a top 16b and a bottom 17b. The container sidewalls 14b and 15b are laterally flexible, and preferably have sufficient resilience or stiffness that they automatically return to their original shape upon release of any external forces which are applied to container 2b to dispense fluid product 18b therefrom. A collapsible bag liner 85 is mounted within the interior of container body 12b, and is preferably constructed from a thin sheet or film type of material or the like, which is sealed about its marginal edges to retain the fluid product 18b therein without leaking. The walls of bag liner 85 are sufficiently flexible that they readily converge together or collapse when fluid product 18b is dispensed therefrom. Flexible bag liner 85 has an open end 86 which is sealingly connected with downwardly opening neck 20b of container body 12b at discharge opening 21b. It is to be understood that collapsible bag liner 85 may also be detachably connected with container body 12b, so as to be replaceable. When container sidewalls 14b and 15b are squeezed or converged, pressure is thereby applied to collapsible bag liner 85, which pressure is in turn applied to the fluid product 18b therein, so as to dispense product through valve 3b. A small vent aperture, check valve arrangement, or other similar arrangement (not shown) may be incorporated into container 2b to permit ambient air to be drawn back into container 2b after dispensing, so that resilient sidewalls 14b and 15b return to their original shape. The walls of bag liner 85 may be made thicker at their base area and thinner at their top area to facilitate collapsing bag liner 85 from top to bottom without folds or other obstructions that might inhibit the dispensing of all product from container 2b.

Valve 3b is mounted in dispensing package 1b in a fashion substantially similar to the arrangement illustrated in FIGS. 1–3, wherein an annularly shaped groove 22b is provided at the free end of neck 20b, and is shaped to closely receive the marginal flange 4b of valve 3b therein. A valve retainer ring (not shown) is positioned adjacent groove 22b, and is attached to container body 12b by a snap-lock arrangement. Container base 13b has a substantially flat bottom portion 25b that is adapted to abuttingly support dispensing package 1b on an associated surface, such as a countertop, sink, worksurface, or the like.

In general, dispensing valve 3b operates in the same manner as dispensing valve 3, as illustrated in FIGS. 7–14, and described in the related specification. However, dispensing package 1b operates in a manner quite similar to above described dispensing package 1a (FIG. 17), wherein as fluid product 18b is dispensed therefrom, the walls of collapsible bag liner 85 simply converge together, such that there is no suck back of air into the bag liner. Valve 3b is configured such that it will positively return to its fully closed position by simply removing the predetermined discharge pressure, without requiring a negative pressure to be developed within the interior of the collapsible bag liner 85.

In those embodiments of the present invention wherein the container does not apply a negative pressure to the dispensing valve, such as dispensing package 1a and 1b, the use of a single slit orifice in the dispensing valve will assist in preventing air from being sucked back into the container. In those applications where the product deteriorates when exposed to air, the extra suck back resistance provided by a single slit valve orifice may be beneficial.

Figure 19:
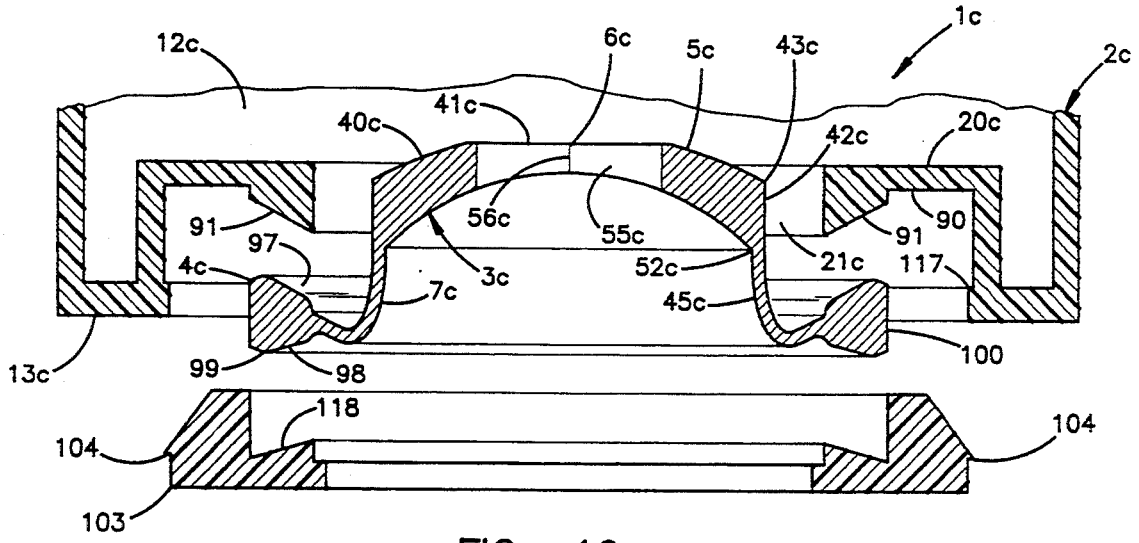
FIG. 19 is an enlarged, fragmentary, vertical cross-sectional view of another dispensing package embodying the present invention, shown in a disassembled condition, and including a valve with an asymmetrically configured flange.
Figure 20:
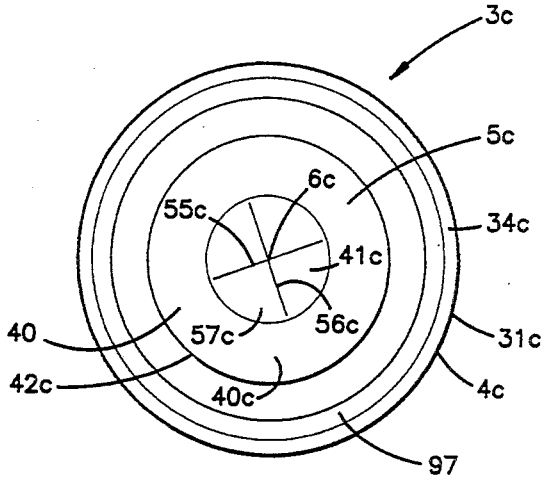
FIG. 20 is a top plan view of the valve shown in FIG. 19.

The reference numeral 1c (FIGS. 19–25) generally designates yet another dispensing package embodying the present invention, which includes a dispensing valve having a unique flange configuration. Since dispensing package 1c is similar to the previously described dispensing packages 1–1b, similar parts appearing in FIGS. 1–18 and FIGS. 19–25 respectively are represented by the same, corresponding reference numeral, except for the suffix "c" in the numerals of the latter. In the example illustrated in FIG. 19, dispensing package 1c includes a container 2c having a squeeze type body 12c, and a substantially rigid base 13c, with a neck 20c that defines a discharge opening 21c about which the marginal flange 4c of valve 3c is positioned. Container neck 20c includes adjacent its free end a recessed portion 90 with a beveled valve seat 91 positioned about discharge opening 21c. Beveled valve seat 91 is inclined upwardly in a radially outwardly extending direction, and is adapted to mate with the marginal flange portion 4c of valve 3c in the manner described in further detail hereinbelow.

Valve 3c is substantially identical in construction to previously described valves 3–3b, except valve 3c has a uniquely shaped marginal flange portion 4c. Like valves 3–3b, valve 3c also includes a valve head 5c with a discharge orifice 6c therein, and a connector sleeve 7c, having one end area thereof connected with valve flange 4c, and the opposite end area thereof connected with valve head portion 5c adjacent a marginal portion thereof. Connector sleeve 7c has a resiliently flexible construction, such that when pressure within container 2c is raised above a predetermined amount, valve head 5c shifts outwardly in a manner which causes connector sleeve 7c to double over and then extend rollingly. The marginal edge 42c of valve head 5c is tapered slightly inwardly toward the central axial axis of valve 3c by an amount in the nature of 1–3 degrees, which facilitates molding operations.

The unique construction of valve flange 4c facilitates conveying a plurality of like valves 3c, such as to an assembly station for connection with an associated container 2c, which may be accomplished with associated machinery (not shown). Although the present invention contemplates use in conjunction with a wide variety of different types of conveying mechanisms, in the embodiment illustrated in FIGS. 23–25, a vibrating chute 93 is provided, which has a generally U-shaped transverse cross-sectional configuration, comprising a base 94, and opposite upstanding sidewalls 95. Vibrating chute 93 is inclined slightly, and includes a powered mechanism or motor (not shown) for imparting vibratory motion thereto, so as to cause valves 3c to translate smoothly along chute 93, as described below.

The marginal flange portion 4c of valve 3c is especially designed for conveyance along chute 93, and includes a first surface 97 (FIG. 19) oriented to face generally toward valve head 5c, and a second surface 98 oriented to face generally away from valve head 5c. The first flange surface 97 is shaped for sealing abutment with beveled valve seat 91, and the second flange surface 98 has a support edge area 99 which projects outwardly in a direction away from valve head 5c to a location exteriormost of valve 3c. The support edge area 99 of valve flange 4c is configured to abut the interior surface 96 of the base 94 of vibrating chute 93 when valve 3c is positioned thereon in a predetermined upright orientation, with valve head 5c oriented upwardly. During handling of valve 3c, such as for assembly in an associated container 2c, a plurality of valves 3c are preferably positioned on the conveying surface 96 of chute 93 in their upright orientation, such that the support edge area 99 of each valve 3c is in abutment with conveyor surface 94, which establishes minimum contact therebetween to facilitate reliably translating valves 3c along the chute 93, while retaining the valves 3c in their predetermined upright orientation.

Figure 21:
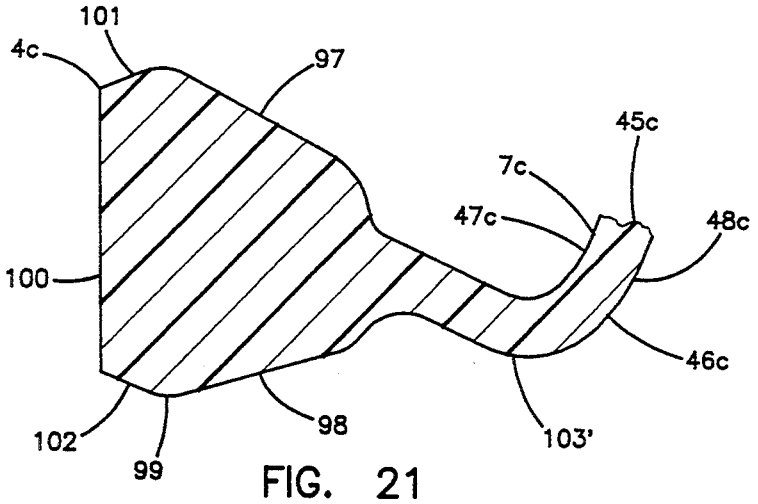
FIG. 21 is an enlarged, vertical cross-sectional view of a flange portion of the valve shown in FIGS. 19–20.

As best shown in FIG. 21, the flange portion 4c of valve 3c has a curved or arcuate support edge area 99, which is oriented to project outwardly away from valve head 5c in a convex fashion, so as to alleviate binding and sticking on conveying surface 96. The illustrated valve flange 4c also includes a generally flat outer edge 100 which extends between the outer portions of flange surfaces 97 and 98. The flat outer edge 100 of valve flange 4c is oriented generally parallel with the central axial axis of valve 4c, and assists in routing valve 3c along conveying surface 96 in its upright orientation, as described below. The major portions of valve flange surfaces 97 and 98 are substantially flat, and taper inwardly toward connector sleeve 7c. The outermost portions 101 and 102 of flange surfaces 97 and 98 taper in an opposite direction. The first and second valve flange surfaces 97 and 98 are arranged in a mutually asymmetrical configuration, wherein flange surface 97 is oriented at an angle with respect to the central axial axis of the valve 3c that is less than the angle at which flange surface 98 is oriented with respect to the central axial axis of valve 3c. In other words, as valve flange 4c is oriented in FIG. 21, the angle of flange surface 97, as measured from surface 97 upwardly to the valve central axis, is substantially steeper than the angle of flange surface 98, as measured from surface 98 downwardly to the valve central axis. In the illustrated valve 3c, flange surface 97 is-oriented at an angle of approximately 55–65 degrees with respect to flange edge 100, while flange surface 98 is oriented at an angle of approximately 70–80 degrees with respect to flange edge 100. This asymmetrical configuration also facilitates efficiently molding valves 3c.

Figure 23:
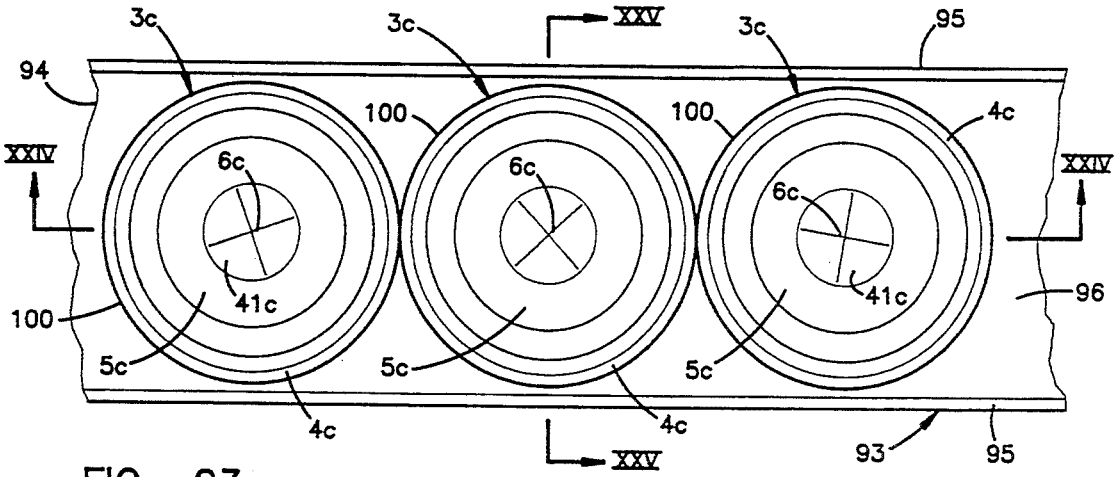
Figure 24:
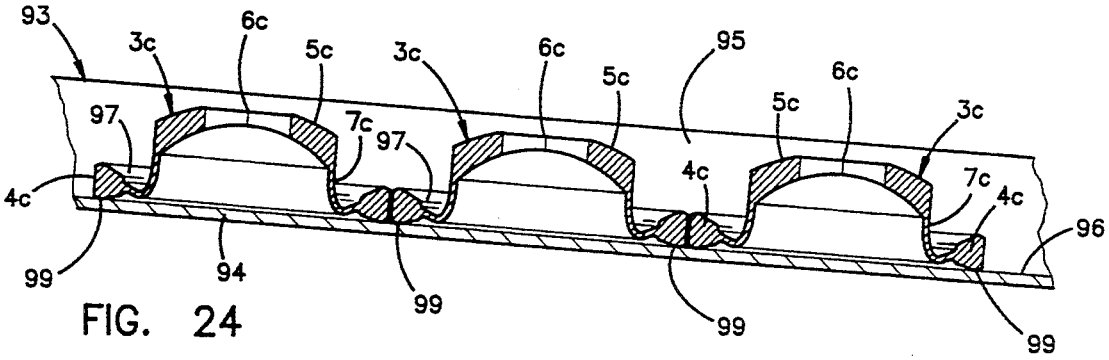
FIG. 24 is a vertical cross-sectional view of the valves and conveyor shown in FIG. 23, taken along the line XXIV—XXIV, FIG. 23.
Figure 25:
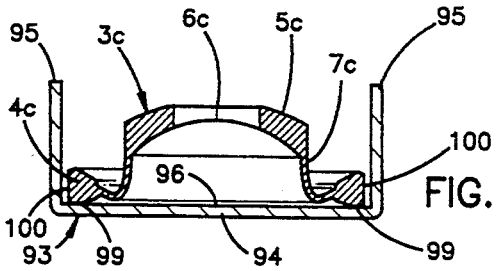
FIG. 25 is a vertical cross-sectional view of the valves and conveyor shown in FIG. 23, taken along the line XXV—XXV, FIG. 23.

The configuration of the connector sleeve 7c associated with valve 3c is substantially similar to that described above with respect to valves 3–3b, and includes a generally J-shaped sidewall 45c having a radially outwardly extending base portion 46c with interior and exterior surfaces 47c and 48c respectively. In the orientation illustrated in FIG. 21, the outwardlymost or downwardlymost protruding portion of sleeve base portion 46c is designated by the reference numeral 103', and is spaced axially inwardly or upwardly from the support edge area 99 of valve flange 4c, so that when a valve 3c is positioned on conveying surface 96 in an upright orientation, as illustrated in FIGS. 23–25, the only portion of the valve 3c which comes in contact with the conveying surface 96 is line contact by flange area 99.

When handling valves 3c, such as when assembling the same in a closure or an associated container 2c, a plurality of valves 3c may be placed in a bin or hopper (not shown), and then translated to an assembly station (not shown) by vibrating chute 93. As best illustrated in FIGS. 23–25, the width of vibrating chute 93 is preferably selected so that at least one portion thereof is just slightly greater than the diameter of valve flanges 4c, so that valves 3c are forced into a single file arrangement to facilitate automated assembly. As previously noted, the configuration of valve flange 4c is such that only the support edge area 99 of each valve 3c comes in contact with chute conveying surface 96, so as to alleviate sticking and binding thereon. The flat outer edges 100 of valves 3c are such that when they come into contact with the sidewalls 95 of vibrating chute 93, the valves 3c will not be displaced or upended from their desired, upright orientation.

Figure 22:
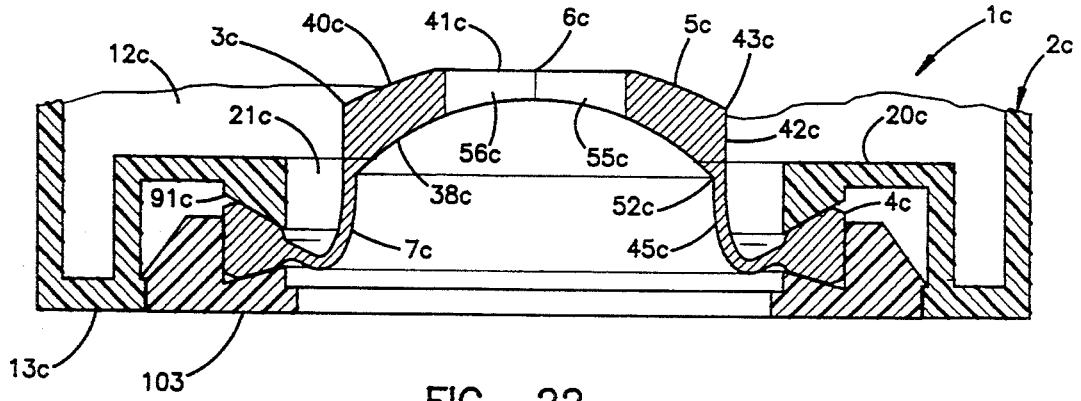
FIG. 22 is an enlarged, fragmentary, vertical, cross-sectional view of the dispensing package shown in FIG. 19, shown in an assembled condition.

The illustrated valve 3c is retained in valve seat 91 (FIG. 19) by a snap ring 103, which includes an outwardly projecting ring 104 that engages a mating lip 117 on container 2c, as shown in FIG. 22. Snap ring 103 includes a beveled seat 118 which abuts surface 98 of valve flange 4c to sealingly retain valve 3c about discharge opening 21c. In general, dispensing valve 3c operates in the same manner as dispensing valve 3, as illustrated in FIGS. 7–14, and described in the related specification. It is to be understood that dispensing valve 3c may be retained in container 2c in a variety of other fashions such as screw retainers, crimped collars, molded integrally into container 2c, and the like, and that valve seat surfaces 91 and 118 may assume many different shapes and sizes as required for a particular application.

Figure 26:
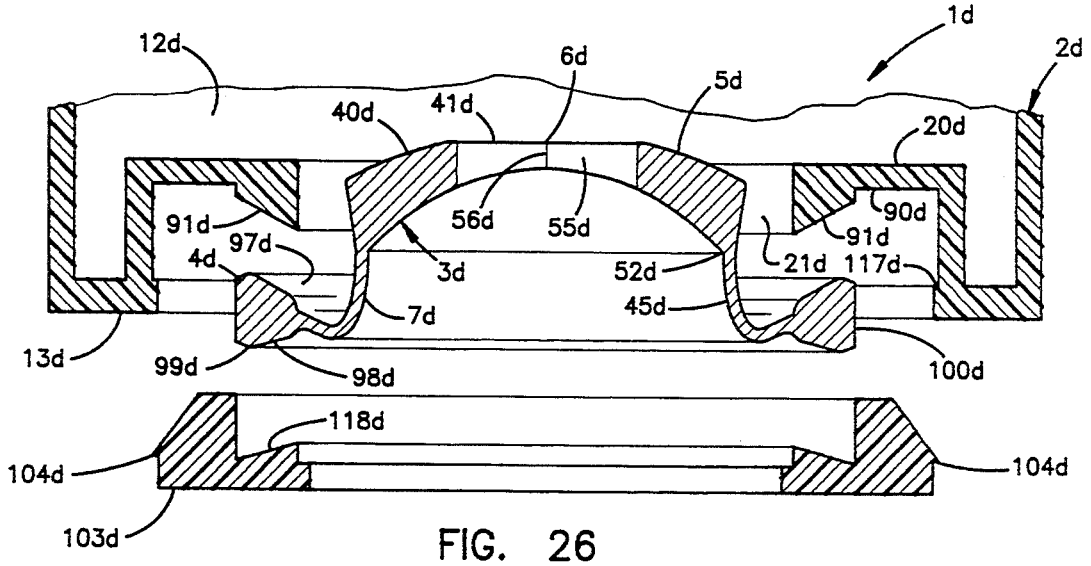
FIG. 26 is an enlarged, fragmentary vertical cross-sectional view of yet another dispensing package embodying the present invention, shown in a disassembled condition, and including a valve with a crown shaped valve head.
Figure 28:
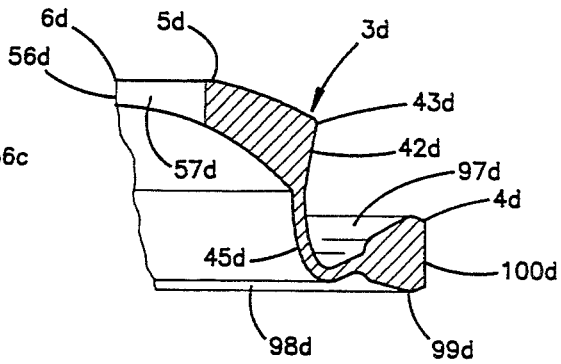
FIG. 28 is an enlarged, fragmentary, vertical cross-sectional view of a right hand portion of the crown shaped valve illustrated in FIG. 26.
Figure 29:
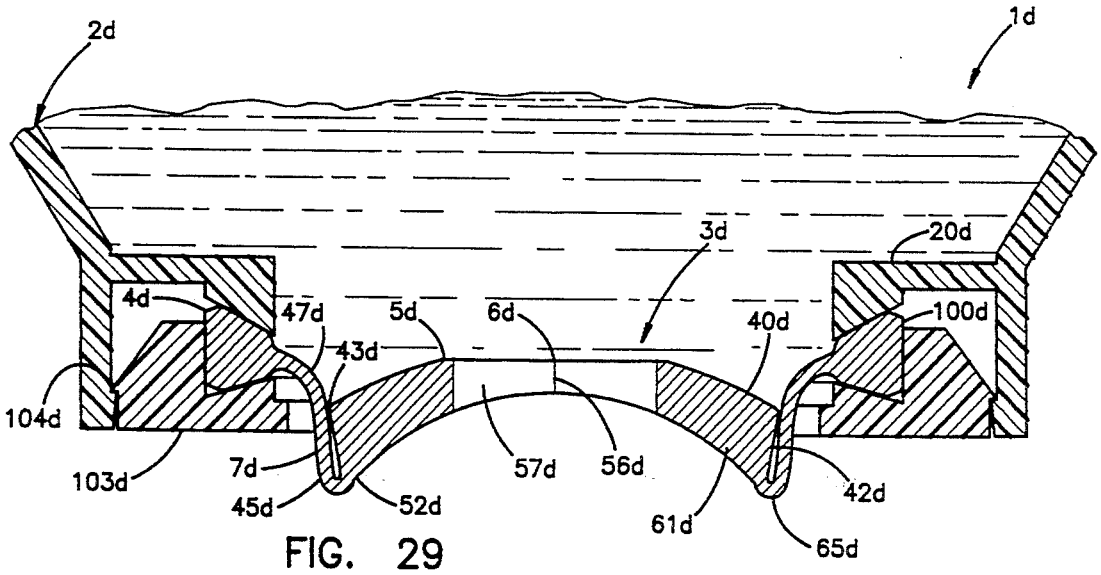
FIG. 29 is an enlarged, cross-sectional view of the crown shaped valve shown in FIGS. 26 and 28 installed in an associated container, with the valve shown in a fully closed, and fully extended position.

The reference number 1d (FIGS. 26 & 28–31) generally designates yet another dispensing package embodying the present invention, wherein the dispensing valve has a crown shaped valve head. Since dispensing package 1*d* is similar to the previously described dispensing packages 1–1*c*, similar parts appearing in FIGS. 1–25 & 27 and FIGS. 26 & 28–31 respectively are represented by the same, corresponding reference numeral, except for the suffix "d" in the numerals of the latter. In the example illustrated in FIGS. 26 & 29–31, dispensing package 1*d* includes a container 2*d* having a squeeze type body 12*d* and a substantially rigid base 13*d*, with a neck 20*d* that defines a discharge opening 21*d* about which the marginal flange 4*d* of valve 3*d* is positioned. Container neck 20*d* includes adjacent its free end a recessed portion 90*d* with a beveled valve seat 91*d* positioned about discharge opening 21*d*. Beveled valve seat 91*d* is inclined upwardly in a radially outwardly extending direction, and is adapted to mate with the marginal flange portion 4*d* of valve 3*d* in the manner described in further detail hereinbelow. The illustrated valve 3*d* is retained in valve seat 91*d* (FIG. 26) by a snap ring 103, which includes an outwardly projecting ring 104*d* that engages a mating lip 117*d* on container 2*d*, as shown in FIG. 29. Snap ring 103*d* includes a beveled seat 118*d* which abuts surface 98*d* of valve flange 4*d* to sealingly retain valve 3*d* about discharge opening 21*d*.

Figure 27:
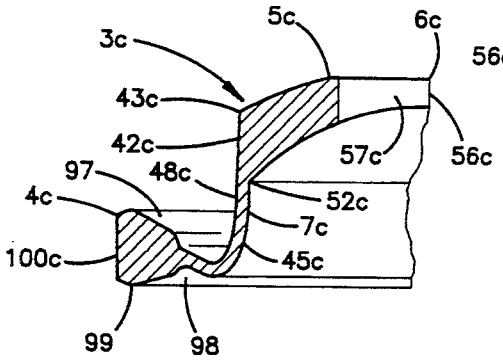
FIG. 27 is an enlarged, fragmentary, vertical cross-sectional view of a left hand portion of the valve illustrated in FIGS. 19–25.

Dispensing valve 3*d* (FIGS. 26–29) is substantially similar to previously described valve 3*c*, except for the unique crown design of valve head portion 5*d*. The valve head portion 5*d* of valve 3*d* has an outwardly flared or "crown" shape, which serves to alleviate nesting during handling of valves 3*d*, such as during assembly in an associated container 2*d*, and improves air suck back into the associated container 2*d*, without sacrificing desirable closing characteristics, as described in greater detail hereinafter. FIGS. 27 and 28 provide a side-by-side comparison between the previously described dispensing valve 3*c* (FIG. 27), and the crown valve 3*d* (FIG. 28). In dispensing valve 3*c* (FIG. 27), the marginal edge 42*c* of valve head 5*c* tapers radially inwardly from the central axial axis of valve 3*c* by an amount of the nature of 1–3 degrees. Hence, the marginal edge 42*c* of valve head 5*c* is generally in line with the exterior surface 48*c* of connector sleeve 7*c*, such that the combined structure is somewhat frustroconical in side elevation. In contrast, in the crown shaped valve 3*d*, as illustrated in FIG. 28, the marginal edge 42*d* of valve head 5*d* tapers or flares radially outwardly, such that it assumes an angle of around 8–12 degrees with respect to the central axial axis of valve 3*d*. Also illustrated in FIGS. 27 and 28, is the fact that the thickness of valve head 5*c* at orifice 6*c* is slightly greater than the thickness of valve head 5*d* at orifice 6*d*. The thinner valve head thickness associated with valve 3*d* improves the suck back of air into the container after dispensing, as illustrated in FIG. 1, since the flaps or petals 57*d* of valve head 5*d* are somewhat more flexible than the petals 57*c* of valve 3*c*. The crown shape of valve head 5*d* also provides additional torque or leverage in shifting discharge orifice 6*d* between the fully open and fully closed positions, so as to insure positive dispensing action, even though the thickness of valve head 5*d* is slightly thinner at discharge orifice 6*d* than in valve 3*c*. Hence, the desirable opening and closing characteristics of valves 3–3*c* is incorporated into valve 3*d*. Furthermore, the outwardly tapered or crown configuration of valve head 5*d* assists in preventing adjacent valves 3*d* from nesting within one another during handling of the valves 3*d*. The increased diameter of valve head 5*d* at its outmost edge 43*d* assists in preventing adjacent valves from becoming entangled or nested within one another during processing, thereby greatly facilitating the assembly of valves 3*d* in an associated container 2*d*, and other similar automated operations.

Figure 30:
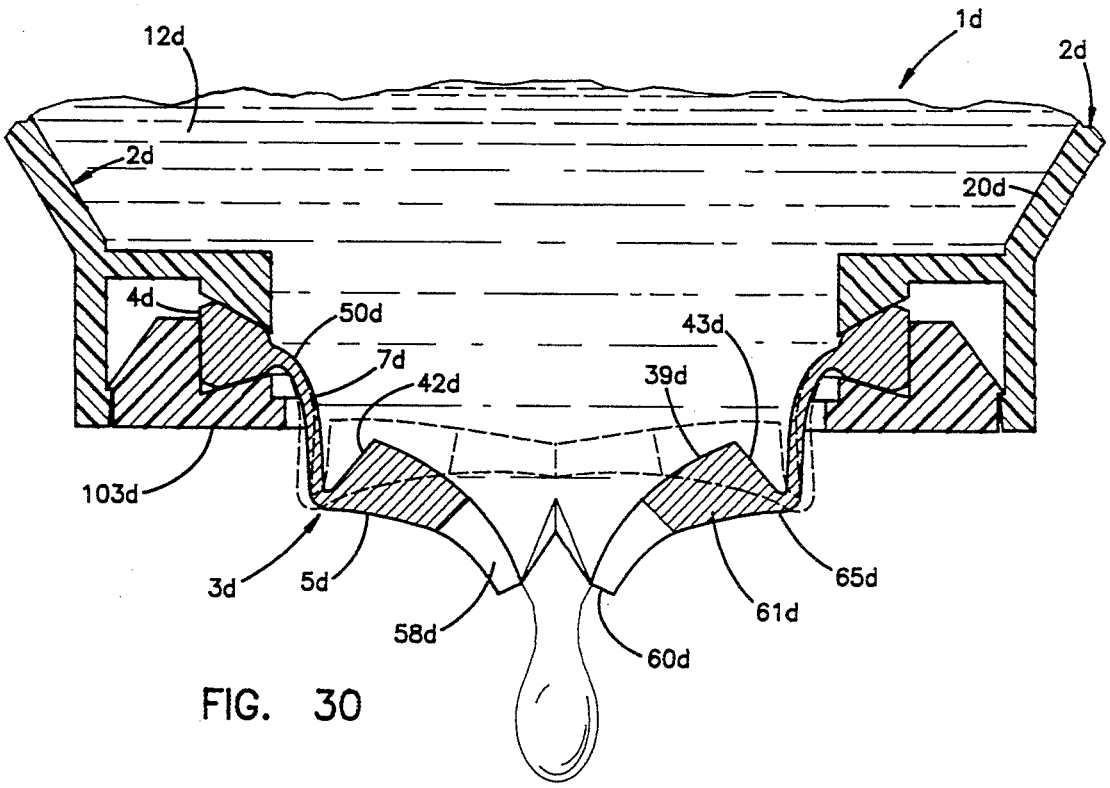
FIG. 30 is an enlarged, cross-sectional view of the crown shaped valve shown in FIGS. 26 and 28–29 installed in an associated container, with the valve shown in a fully extended position, wherein the valve head portion is shown snapped fully outwardly and fully open.
Figure 31:
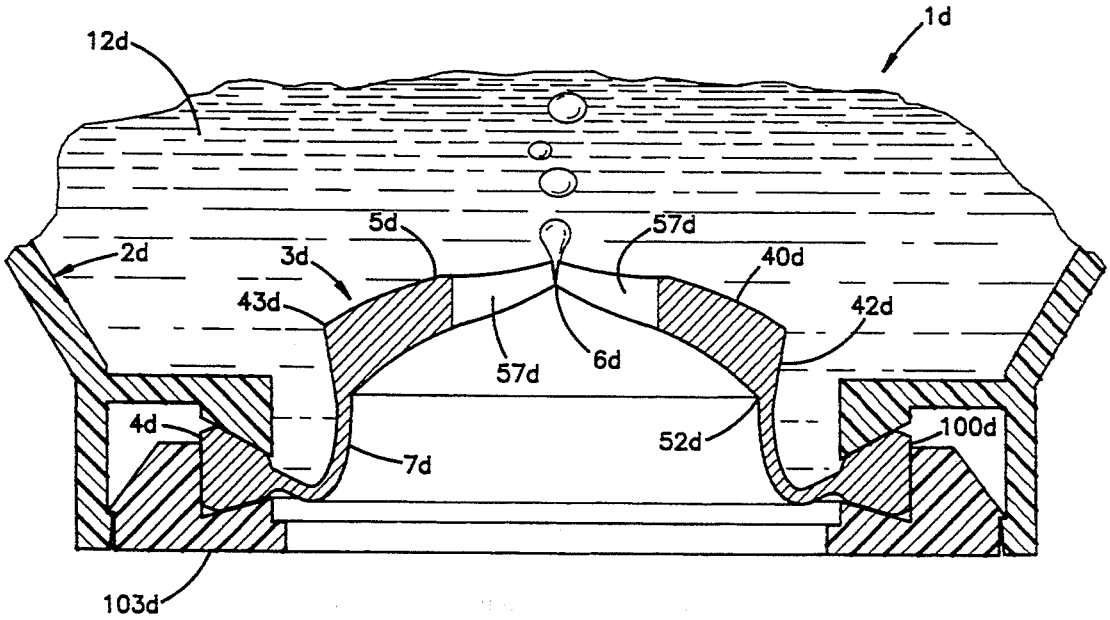
FIG. 31 is an enlarged, cross-sectional view of the crown shaped valve shown in FIGS. 26 and 28–30, installed in an associated container, with the valve shown in a fully retracted position, sucking air back into the container.

With reference to FIGS. 29–31 dispensing valve 3*d* operates in a manner substantially similar to that described above with respect to valve 3, except as noted below. When dispensing valve 3*d* is in the fully closed and fully extended position illustrated in FIG. 29, the crown shape of valve head 5*d* causes the outermost edge portion 43*d* thereof to be positioned relatively close to the interior surface 47*d* of connector sleeve 7*d*. As dispensing valve 3*d* is shifted into the fully open position illustrated in FIG. 30, the increased thickness accorded by the crown shape of valve head 5*d* provides additional torque or leverage to shift discharge orifice 6*d* into the fully open position. The additional thickness of crown valve head 5 also serves to provide additional torque or leverage in returning discharge orifice 6*d* to the fully closed position, even when valve 3*d* is attached to a container which does not experience a negative pressure therein, such as collapsible bag containers 2*a* and 2*b*, or other similar arrangements. When dispensing valve 3*d* is used in conjunction with a squeeze type resilient wall container 3*d*, such as the container 2 illustrated in FIGS. 1–3, or the container 2*d* shown in FIGS. 26 & 29–31, the crown construction of valve head 5*d* provides for increased suck back of air into container 2*d*, as illustrated in FIG. 31. This increased ability to more easily suck back air into container 2*d* prevents the sidewalls of the container 2*d* from collapsing, even when valve 3*d* is configured for bottom dispensing.

Figure 32:
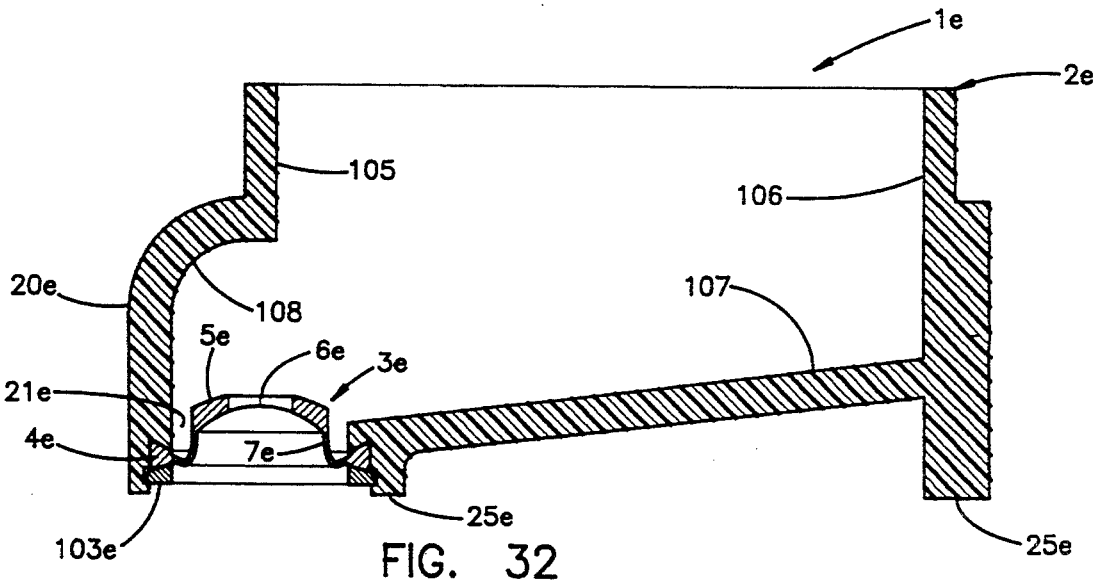
FIG. 32 is a partially schematic, cross-sectional view of yet another embodiment of the present dispensing package, wherein the valve is mounted in a sloped base portion of an associated container.

The reference numeral 1*e* (FIG. 32) generally designates yet another dispensing package embodying the present invention, having an inclined bottom dispense arrangement. Since dispensing package 1*e* is similar to the previously described dispensing packages 1–1*d*, similar parts appearing in FIGS. 1–31 and 32 respectively are represented by the same, corresponding reference numeral, except for the suffix "e" in the numerals of the latter. In the illustrated dispensing package 1*e*, container 2*e* is provided with a dispensing valve 3*e* mounted in a bottom portion thereof. Container 2*e* has flat bottom portions 25*e* adapted to abuttingly support dispensing package 1*e* on an associated surface, such as a countertop, sink, worksurface or the like. The interior of container 2*e* includes a downwardly opening neck 20*e* which defines a discharge opening 21*e* about which the marginal flange 4*e* of valve 3*e* is positioned. In the illustrated example, discharge opening 21*e* is positioned adjacent an edge area of the container bottom 25, so as to facilitate bottom dispensing liquid product from container 2*e* by improving aim control, and minimizing the amount of motion required to dispense product. The interior of container 2*e* includes sidewall surfaces 105 & 106 and a base surface 107. Sidewall surface 105 includes an outwardly protruding portion 108 which forms a cavity directly above dispensing valve 3*e*. The bottom surface 107 of container 2*e* is sloped or inclined downwardly from its outer edges to discharge opening 21*e*, so that all fluid product can be readily emptied from container 2*e*, without requiring reorientation from its normal upright position. In general, dispensing valve 3*e* operates in the same manner as dispensing valve 3, as illustrated in FIGS. 7–14, and described in the related specification.

Figure 33:
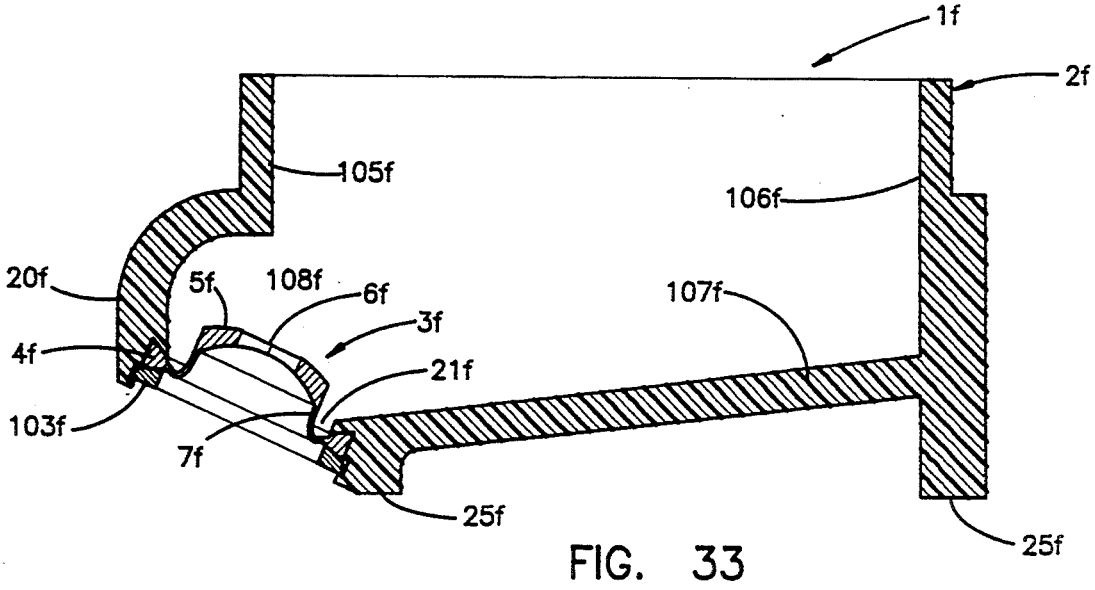
FIG. 33 is a partially schematic, cross-sectional view of yet another embodiment of the present dispensing package, wherein the valve is mounted at an angle in a sloped base portion of an associated container.

The reference numeral if (FIG. 33) generally designates yet another dispensing package embodying the present invention, having an angled bottom dispense feature. Since dispensing package If is similar to previously described dispensing packages 1–1*e*, similar parts appearing in FIGS. 1–32 and FIG. 33 respectively are represented by the same, corresponding reference numeral, except for the suffix "f" in the numerals of the latter. Dispensing package 1*f* is nearly identical to dispensing package 1*e*, except for the orientation of discharge opening 21*f*. In the illustrated dispensing package 1*f*, discharge opening 21*f* is oriented at an acute angle, in the range of 20–30 degrees, with respect to the base 25*f* of container 2*f*, and the associated dispensing valve 3*f* is similarly angularly oriented therein. As a consequence, dispensing from container 1*f* can be achieved with improved aim control, and perhaps in at least some instances, without moving dispensing package 1*f* from its set position. For instance, when dispensing package 1*f* is positioned on a support surface adjacent a wash area, such as a sink or the like, the angled orientation of discharge opening 21 and associated dispensing valve 3*f* will permit the user to dispense fluid product into the wash area by simply grasping and squeezing dispensing package 1*f*. The directional location of dispensing valve 38 facilitates accurately aiming the stream of fluid product from container 2*f*. Also, in such environments, the user may not be required to bodily transport dispensing package 1*f* over the wash area.

Figure 34:
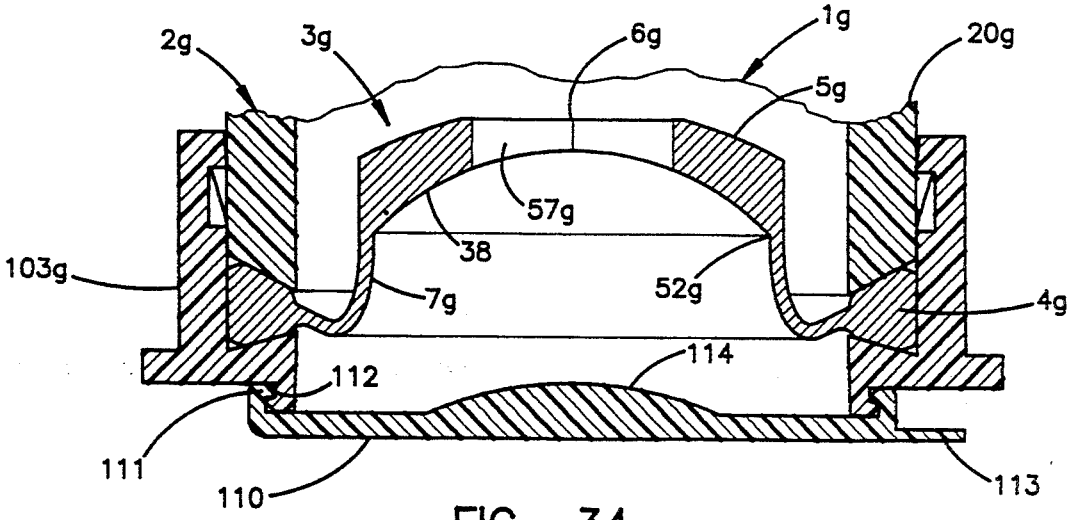
FIG. 34 is a partially schematic, cross-sectional view of yet another embodiment of the present dispensing package, wherein a cap is provided with a protuberance which positively prevents the valve from leaking.

The reference numeral 1*g* (FIG. 34) generally designates yet another dispensing package embodying the present invention, having a valve stop associated therewith. Since dispensing package 1*g* is similar to the previously described dispensing packages 1–1*f*, similar parts appearing in FIGS. 1–33 and 34 respectively are represented by the same, corresponding reference numeral, except for the suffix "g" in the numerals of the latter. In dispensing package 1*g* a travel closure 110 is positioned generally opposite the associated dispensing valve 3*g*. In the illustrated example, closure 110 is in the form of a flat cap, having a peripheral rib 111 which engages a mating groove 112 in container neck 20*g* to detachably retain the same in place with a snap lock. Closure cap 110 also includes an outwardly protruding tab 113 to facilitate removing closure cap 110 from container 1*g*. The interior surface of closure cap 110 includes an inwardly projecting protuberance or valve stop 114, which serves to positively prevent valve orifice 6 from leaking. In the illustrated example, protuberance 114 comprises an arcuately shaped dimple, which is located adjacent the central portion of closure cap 110, and is shaped generally similar to the exterior surface 38 of valve head 5*g*. As previously discussed, valve head 5*g* must assume an outwardly protruding configuration to shift discharge orifice 6*g* into the open position. When pressure is applied to container 2*g*, valve head 5*g* will extend rollingly outwardly into contact with closure cap 110, and abutting contact will be established between the interior surface 38 of valve head 5*g*, and arcuate dimple 114, which contact will positively prevent valve head 5*g* from leaking. Hence, discharge orifice 6*g* will remain completely sealed, even when dispensing package 1*g* is shaken vigorously, jarred, or the like. It is to be understood that dimple 114 may assume different shapes, and can be positioned opposite valve 3*g* by arrangements other than cap 110, and still serve effectively to prevent valve leakage.

Figure 35:
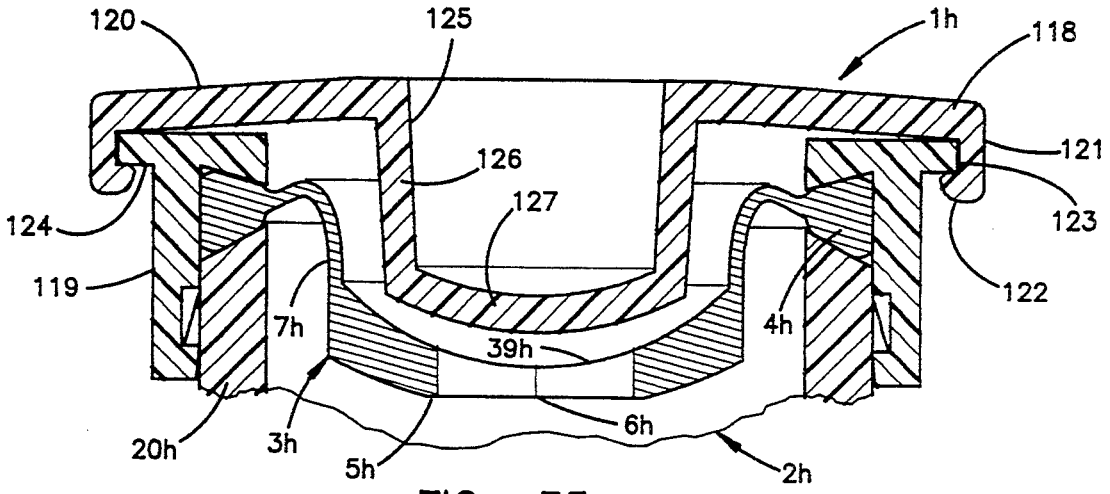
FIG. 35 is a partially schematic, cross-sectional view of yet another embodiment of the present dispensing package, wherein an exterior fitted cap is provided to prevent the valve from inadvertently leaking.

The reference numeral 1*h* (FIG. 35) generally designates yet another dispensing package embodying the present invention, having an alternative valve stop associated therewith. Since dispensing package 1*h* is similar to previously described dispensing packages 1–1*g*, similar parts appearing in FIGS. 1–34 and 35 respectively are represented by the same, corresponding reference numeral, except for the suffix "h" in the numerals of the latter. In dispensing package 1*h*, a removable cap 118 attached to a closure assembly 119 mounted on the neck 20*h* of container 2*h* generally opposite the associated dispensing valve 3*h*. In the illustrated example, cap 118 has a generally circular plan configuration, with downwardly opening arcuate upper surface 120, and a depending marginal flange 121 with a radially inwardly protruding lip 122 which defines an internal groove 123 within the interior of cap 118. The upper end of closure assembly 119 includes a radially outwardly protruding rim 124, which is received within the groove 123 of cap 118 to form a snap lock that detachably retains cap 118 securely in place.

The illustrated cap 118 (FIG. 35) also includes a valve stop in the form of a dome 125 which protrudes inwardly from the center portion of cap 118. Dome 125 includes a tapered frustoconical sidewall 126 and an arcuate end wall 127 positioned adjacent to the interior surface 39*h* of valve 3*h*. When cap 118 is mounted in position on container 2*h*, dome 125 prevents valve 3*h* from shifting into its open position, so as to prevent inadvertent leakage of fluid product from container 2*h*.

Figure 36:
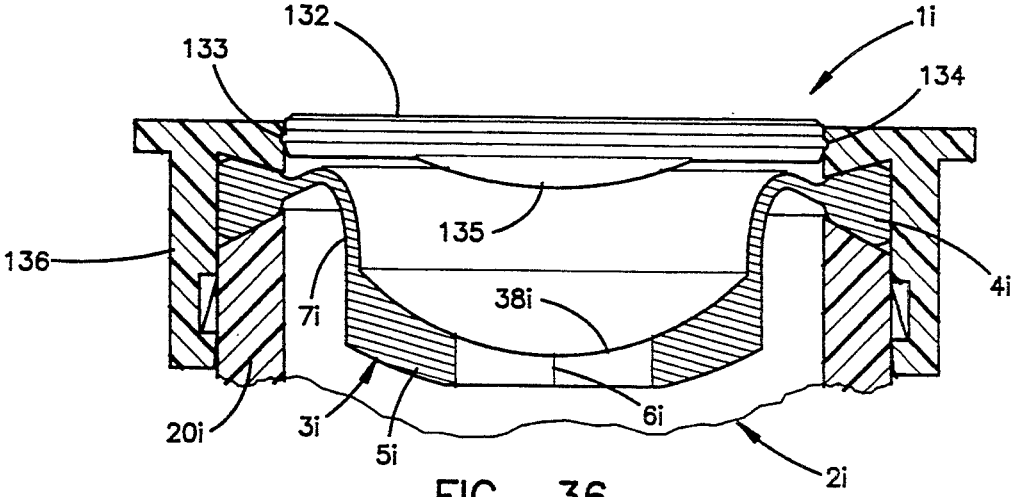
FIG. 36 is a partially schematic, cross-sectional view of yet another embodiment of the present dispensing package, wherein an interior fitted cap is provided to prevent the valve from inadvertently leaking.

The reference numeral 1*i* (FIG. 36) generally designates yet another dispensing package embodying the present invention, having an alternative valve stop associated therewith. Since dispensing package 1*i* is similar to the previously described dispensing packages 1–1*h*, similar parts appearing in FIGS. 1–35 and 36 respectively are represented by the same, corresponding reference numeral, except for the suffix "i" in the numerals of the latter. In dispensing package 1*i*, the valve stop is in the form of a removable, internally mounted cap 132, which is positioned generally opposite dispensing valve 3*i*. In the illustrated example, cap 132 has a disc-shaped plan configuration, with an outwardly protruding central rib 133. A closure assembly 136 mounted on the neck 20*i* of container 2*i* includes an annular groove 134 in which the rib 133 of cap 132 is detachably received with a snap lock action to retain cap 132 securely in place. Cap 132 includes an arcuately shaped dimple 135 projecting from the interior side thereof, which is located adjacent the central portion of cap 132, and is shaped generally similar to the exterior surface 38*i* of valve head 5*i*.

Figure 37:
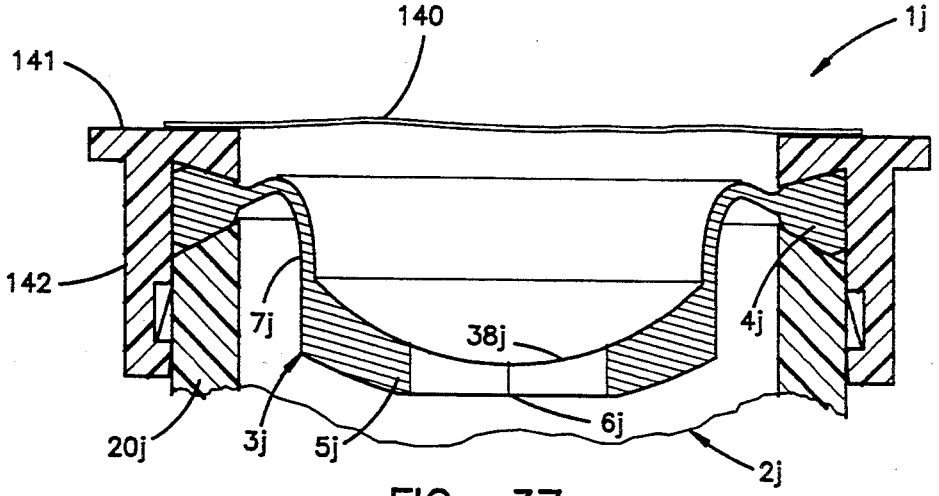
FIG. 37 is a partially schematic, cross-sectional view of yet another embodiment of the present dispensing package, wherein a foil patch is provided to prevent the valve from inadvertently leaking.

The reference numeral 1*j* (FIG. 37) generally designates yet another dispensing package embodying the present invention, having an alternative valve stop associated therewith. Since dispensing package 1*j* is similar to the previously described dispensing packages 1–1*i*, similar parts appearing in FIGS. 1–36 and 37 respectively are represented by the same, corresponding reference numeral, except for the suffix "j" in the numerals of the latter. In dispensing package 1*j*, the valve stop is in the form of a thin patch 140 positioned generally opposite the associated dispensing valve 3*j*. In the illustrated example, patch 140 is constructed from a foil material or the like, with a disc- shaped plan configuration, and adhesive along the peripheral edge thereof which securely attaches the same to the upper surface 141 of the closure assembly 142 mounted on container neck 20*j*. Patch 140 not only prevents dispensing valve 3*j* from shifting to an open position, but also forms a leak resistant seal about the open discharge end of container 2*j*.

Figure 38:
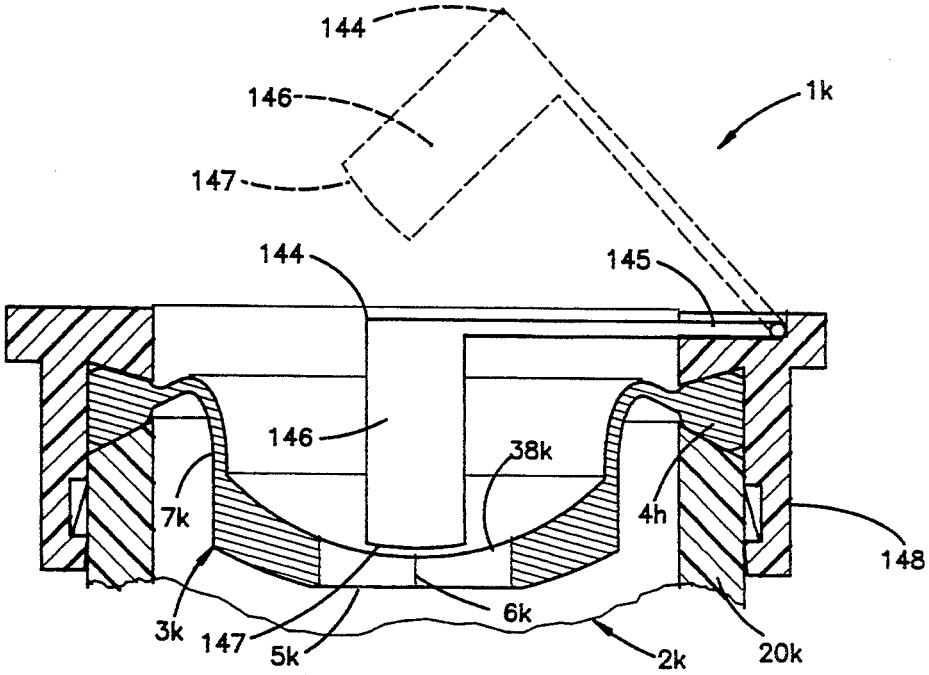
FIG. 38 is a partially schematic, cross-sectional view of yet another embodiment of the present dispensing package, wherein an L-shaped, pivoting stop is provided to prevent the valve from inadvertently leaking.

The reference numeral 1*k* (FIG. 38) generally designates yet another dispensing package embodying the present invention, having an alternative valve stop associated therewith. Since dispensing package 1*k* is similar to the previously described dispensing packages 1–1*j*, similar parts appearing in FIGS. 1–37 and 38 respectively are represented by the same, corresponding reference numeral, except for the suffix "k" in the numerals of the latter. In dispensing package 1*k*, the valve stop is in the form of an L-shaped arm 144, which is selectively positioned generally opposite the associated dispensing valve 3*k*. In the illustrated example, L-shaped arm 144 has one end 145, pivotally connected with a closure assembly 148 mounted on the neck 20*k* of container 2*k* for shifting stop arm 144 between an open and a closed position, as illustrated by the full lines in FIG. 38. The broken lines in FIG. 38 illustrate a partially open position for stop arm 144. The opposite end 146 of L-shaped arm 144 includes an arcuate free end 147 that is shaped for positioning adjacent the exterior surface 38*k* of valve head 5*k* when stop arm 144 is in its fully closed position, so as to prevent valve 3*k* from shifting to an open position.

Figure 39:
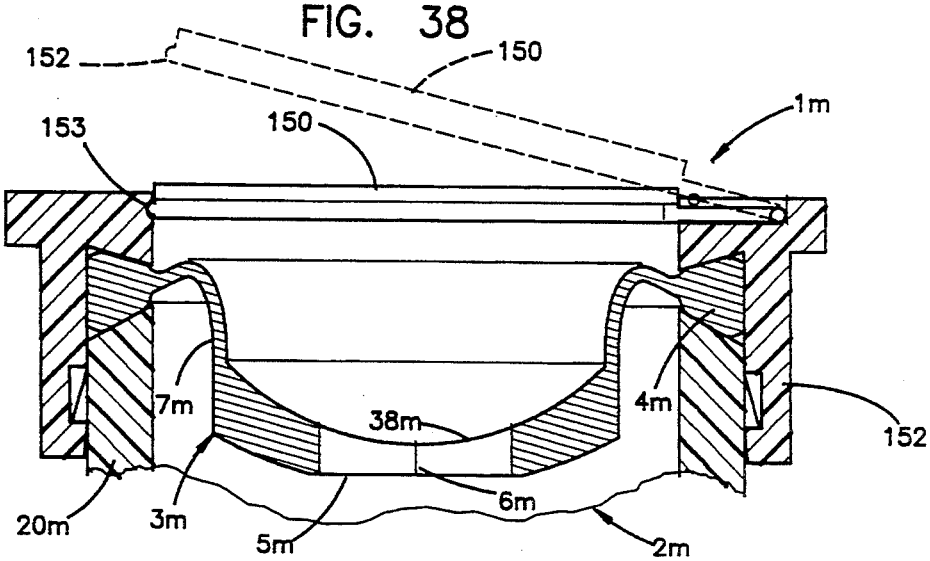
FIG. 39 is a partially schematic, cross-sectional view of yet another embodiment of the present dispensing package, wherein a disc-shaped pivoting cap is provided to prevent the valve from inadvertently leaking.

The reference numeral 1*m* (FIG. 39) generally designates yet another dispensing package embodying the present invention, having an alternative valve stop associated therewith. Since dispensing package 1*m* is similar to the previously described dispensing packages 1–1*k*, similar parts appearing in FIGS. 1–38 and 39 respectively are represented by the same, corresponding reference numeral, except for the suffix "m" in the numerals of the latter. In dispensing package 1*m*, the valve stop is in the form of a disc-shaped cap 150 that is selectively positioned generally opposite the associated dispensing valve 3*m*. In the illustrated example, cap 150 includes a marginal portion pivotally connected with a closure assembly 152 mounted on the container neck 20*m* for rotation between an open position and closed position, as illustrated by the full lines in FIG. 39. The broken lines in FIG. 39 illustrate a partially open position for cap 150. Cap 150 also includes an outwardly protruding bead 152 shaped to be received in a mating groove 153 in an interior portion of closure assembly 152 to form a snap lock therebetween, so as to securely retain cap 150 in its fully closed position.

Figure 40:
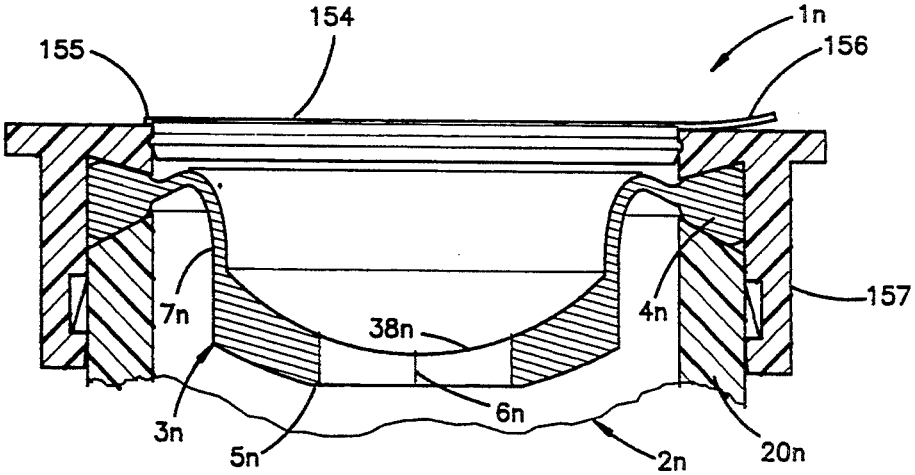
FIG. 40 is a partially schematic, cross-sectional view of yet another embodiment of the present dispensing valve, wherein an internally mounting cap with a tab is provided to prevent the valve from inadvertently leaking.

The reference numeral in (FIG. 40) generally designates yet another dispensing package embodying the present invention, having an alternative valve stop associated therewith. Since dispensing package 1*m* is similar to the previously described dispensing packages 1–1*k* and 1*m*, similar parts appearing in FIGS. 1–39 and 40 respectively are represented by the same, corresponding reference numeral, except for the suffix "n" in the numerals of the latter. In dispensing package 1*n*, the valve stop is in the form of a disc-shaped removable cap 154 which is positioned generally opposite the associated dispensing valve 3*n*. In the illustrated example, cap 154 is quite similar to previously described cap 132 (FIG. 36), except that it includes an upper rim 155, and an outwardly protruding tab 156, which facilitates removal of cap 154 from the closure assembly 157 mounted on container 2*n*.

Figure 41:
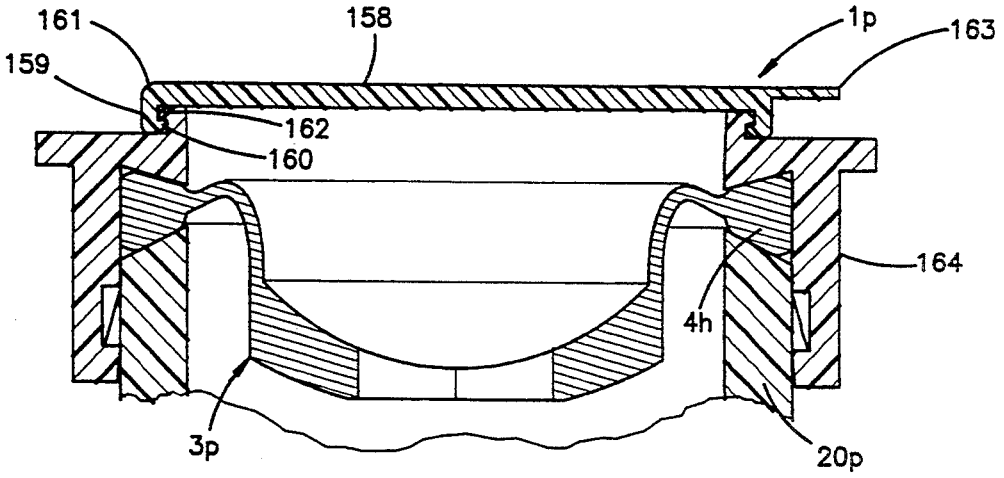
FIG. 41 is a partially schematic, cross-sectional view of yet another embodiment of the present dispensing package, wherein an externally mounted, tabbed cap is provided to prevent the valve from inadvertently leaking.

The reference numeral 1*p* (FIG. 41) generally designates yet another dispensing package embodying the present invention, having an alternative valve stop associated therewith. Since dispensing package 1*p* is similar to the previously described dispensing packages 1–1*k* and 1*m*–1*n*, similar parts appearing in FIGS. 1–40 and 41 respectively are represented by the same, corresponding reference numeral, except for the suffix "p" in the numerals of the latter. In dispensing package, 1*p* the valve stop is in the form of a disc-shaped removable cap 158 that is positioned generally opposite the associated dispensing valve 3*p*. In the illustrated example, removable cap 158 is generally flat, and includes a downwardly extending marginal flange 159 with an inwardly protruding rim 160 which defines an internal groove 161. The upper end of the closure assembly 164 mounted on container neck 20*p* includes an outwardly extending barb 162 which is selectively received in the groove 161 of cap 158 to form a snap lock therebetween. Cap 158 also includes a radially outwardly extending tab 163, which facilitates removable of cap 158 from container 2*p*.

Figure 42:
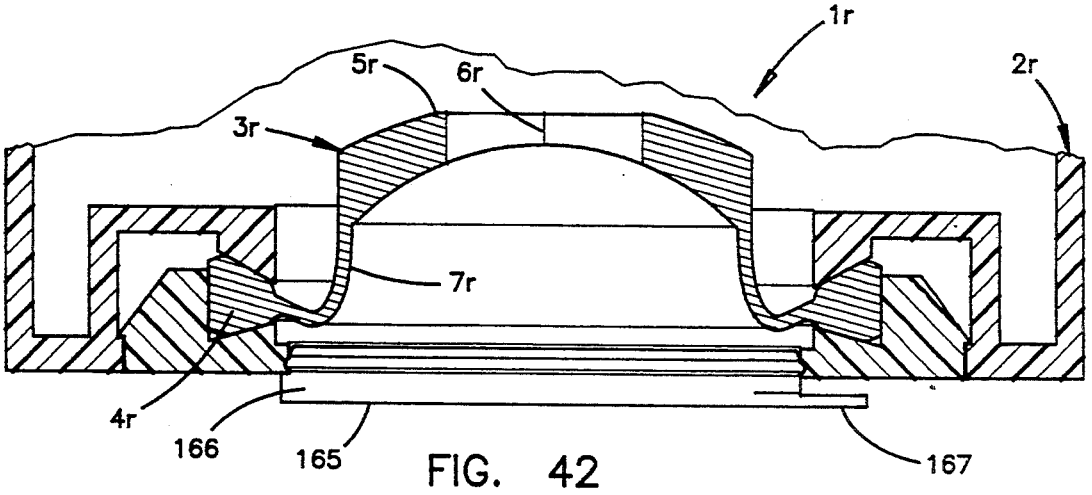
FIG. 42 is a partially schematic, cross-sectional view of yet another embodiment of the present dispensing package, wherein an internally mounted, tabbed cap is provided to prevent the valve from inadvertently leaking.

The reference numeral 1*r* (FIG. 42) generally designates yet another dispensing package embodying the present invention, having an alternative valve stop associated therewith. Since dispensing package 1*r* is similar to the previously described dispensing packages 1–1*k*, 1*m*–1*n* and 1*p*, similar parts appearing in FIGS. 1–41 and 42 respectively are represented by the same, corresponding reference numeral, except for the suffix "r" in the numerals of the latter. In dispensing package 1*r*, the valve stop is in the form of an internally mounted, disc-shaped cap 165, which is quite similar to previously described cap 154 (FIG. 40), and includes a rim 166 and tab 167.

Figure 43:
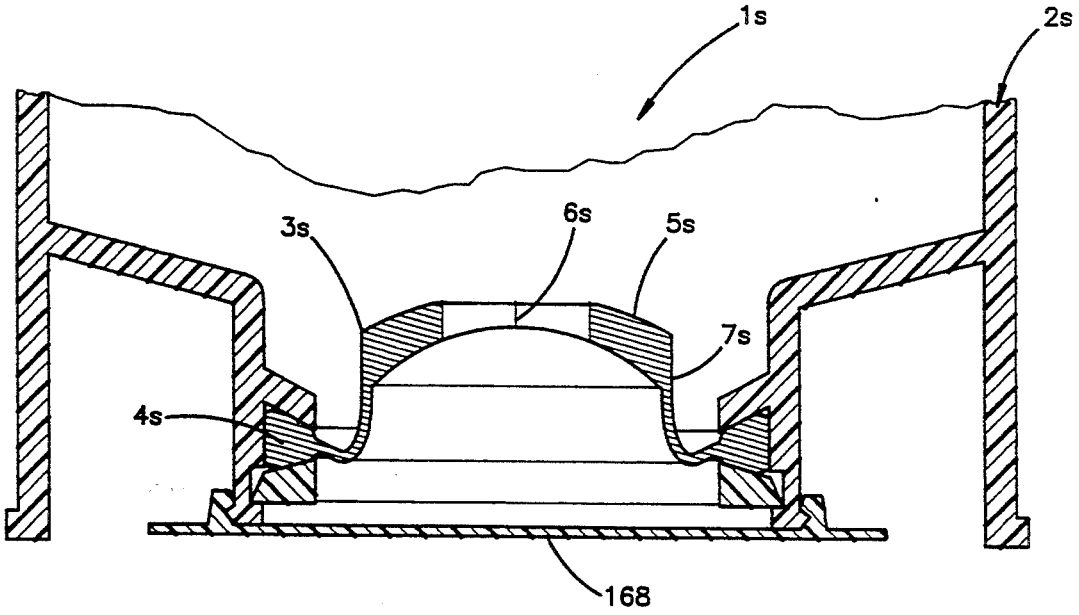
FIG. 43 is a partially schematic, cross-sectional view of yet another embodiment of the present dispensing package, wherein a cap with an annular ring is provided to prevent the valve from inadvertently leaking.

The reference numeral 1*s* (FIG. 43) generally designates yet another dispensing package embodying the present invention, having an alternative valve stop associated therewith. Since dispensing package 1*s* is similar to the previously described dispensing packages 1–1*k*, 1*m*–1*n*, 1*p* and 1*r*, similar parts appearing in FIGS. 1–42 and 43 respectively are represented by the same, corresponding reference numeral, except the suffix "s" in the numerals of the latter. In dispensing package 1*s*, the valve stop is in the form of a disc-shaped removable cap 168 positioned generally opposite the associated dispensing valve 3*s*. In the illustrated example, cap 168 is quite similar to previously described cap 158 (FIG. 41), except that it includes an outwardly protruding rim 169 around its entire periphery, which facilitates removal of the same from container 2*s*.

Figure 44:
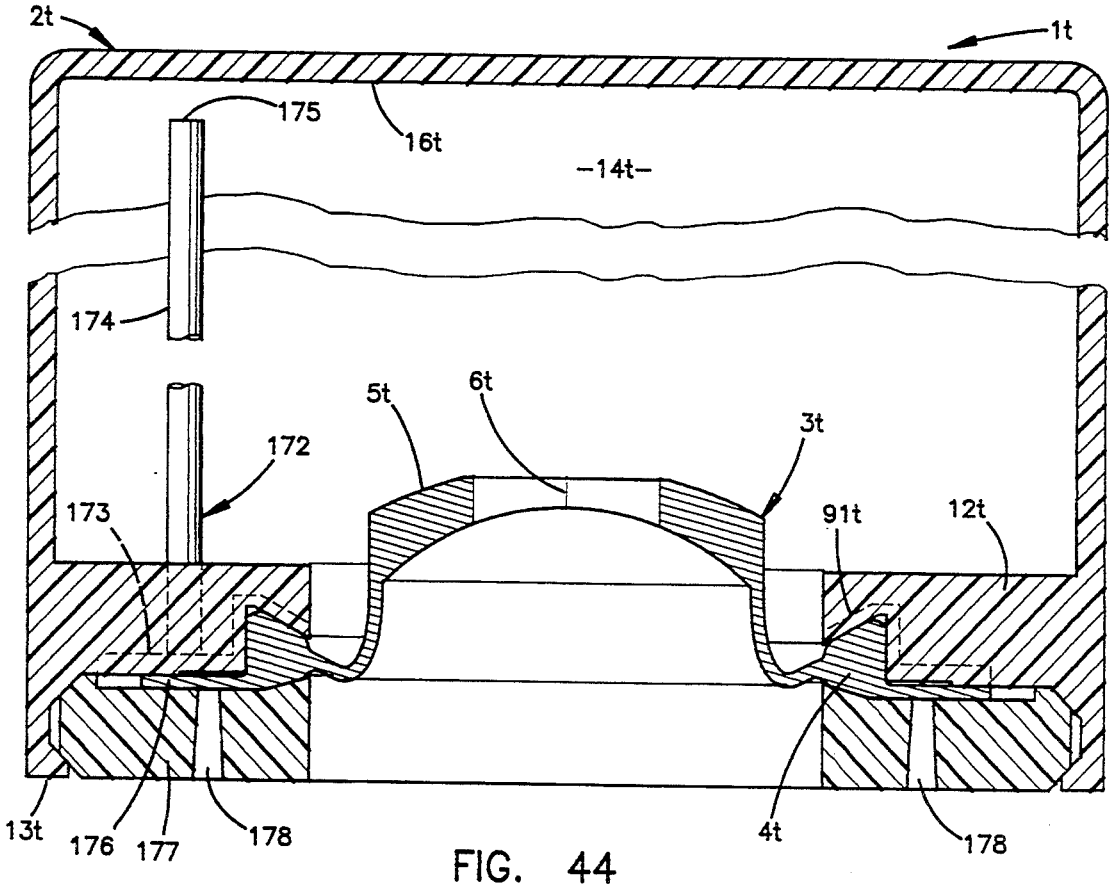
FIG. 44 is a partially schematic, cross-sectional view of yet another embodiment of the present dispensing package, wherein a vent is provided to prevent the walls of the container from collapsing as fluid product is dispensed.

The reference numeral 1*t* (FIG. 44) generally designates yet another dispensing package embodying the present invention, having a container vent arrangement associated therewith. Since dispensing package 1*t* is similar to the previously described dispensing packages 1–1*k*, 1*m*–1*n*, 1*p* and 1*r*–1*s*, similar parts appearing in FIGS. 1–43 and 44 respectively are represented by the same, corresponding reference numeral, except for the suffix "t" in the numerals of the latter. In dispensing package 1*t*, a vent arrangement 172 is provided to selectively admit ambient air into the interior of container 2*t* so as to prevent the sidewalls 14*t* thereof from collapsing when fluid product is dispensed from the dispensing package 1*t*. More specifically, container 2*t* is configured for bottom dispensing, such that discharge orifice 6*t* is oriented downwardly adjacent the base 13*t* of container body 12*t*. The beveled valve seat portion 91*t* of container body 12 includes an enlarged peripheral portion 173, which communicates with a hollow vertical tube 174, having an upper end 175 thereof extending adjacent the top 16*t* of container 2*t*. The marginal flange 4*t* of self-sealing valve 3*t* includes a flat outwardly extending flapper portion 176, which is positioned generally opposite valve seat cavity 173. Dispensing valve 3*t* is mounted in container 2*t* by a special snap ring 177, which includes a plurality of vent apertures 178 extending therethrough to the flapper portion 176 of dispensing valve 3*t*. During operation, after fluid product has been dispensed from container 2, and the sidewalls 14*t* of the container have been released, such that they are resiliently restored to their original shape, a vacuum is created within the interior of container 2*t*. This vacuum is communicated to the interior surface of valve flapper 176 through vent tube 174. The pressure differential on the opposite sides of valve flapper 176 causes the valve flapper to move off of its sealed position over vent apertures 178, thereby allowing ambient air to be drawn into the interior of the container, around valve flapper 176, and through vent tube 174. In this manner, ambient air is drawn into the interior of container 2, until the pressure is substantially equalized, and container sidewalls 14*t* generally assume their original shape. Hence, valve 3*t* also serves as a check valve, which allows ambient air to be drawn into the interior of container 2*t*, but which prevents fluid product from escaping through aperture 178.

Figure 45:
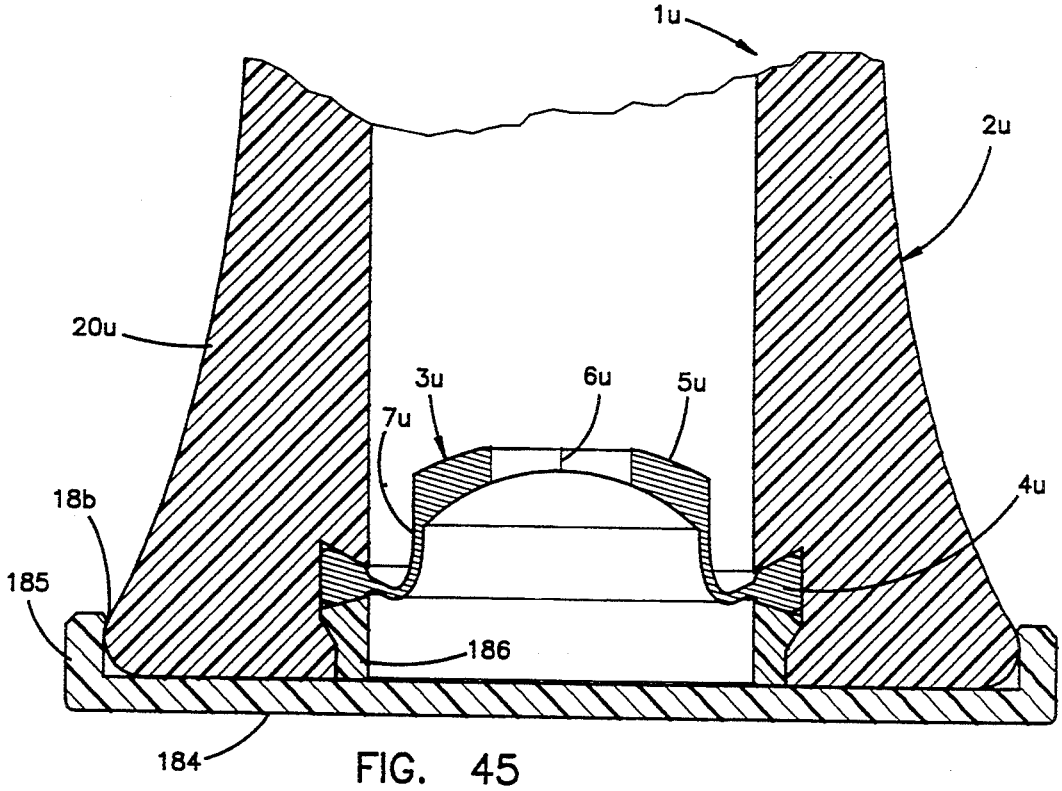
FIG. 45 is a partially schematic, cross-sectional view of yet another embodiment of the present dispensing package, wherein an externally fitted cap is provided to prevent the valve from inadvertently leaking.
Figure 46:
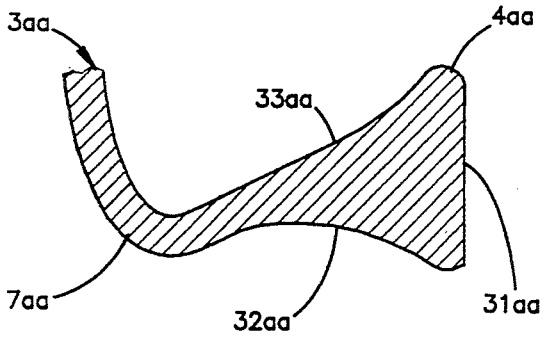
FIG. 46 is an enlarged, vertical cross-sectional view of an alternative flange construction for the self-sealing valve.

The reference numeral 1*u* (FIG. 45) generally designates yet another dispensing package embodying the present invention, having an alternative valve stop associated therewith. Since dispensing package 1*u* is similar to the previously described dispensing packages 1–1*k*, 1*m*–1*n*, 1*p* and 1*r*–*t*, similar parts appearing in FIGS. 1–44 and 45 respectively are represented by the same, corresponding reference numeral, except for the suffix "u" in the numerals of the latter. In dispensing package 1*u*, the valve stop comprises a disc-shaped removable cap 184 that is positioned generally opposite the associated dispensing valve 3*u*. In the illustrated example, cap 184 is generally flat, and includes a marginal flange 185 that is snapped about a mating peripheral edge 186 on container neck 20*u* to retain the same securely in place. Valve 3*u* is retained in container 2*u* by a crimped retainer ring 186.

FIGS. 46–96 illustrate a plurality of alternative dispensing valves embodying the present invention, having different marginal flange configurations, and retainer arrangements to facilitate mounting the same in an associated container. These alternative valve designs are designated by the reference numerals 3*aa*–3*xx*'. Since dispensing valves 3*aa*–3*xx*' are similar to the previously described dispensing valves 3–3*u*, similar parts appearing in FIGS. 1–45 and 46–96 respectively are represented by the same, corresponding reference numeral, except for the suffixes "aa–xx'" in the numerals of the latter.

Figure 47:
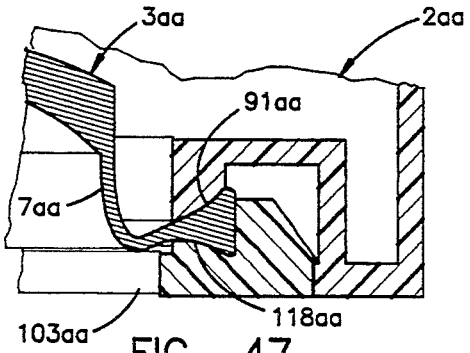
FIG. 47 is a partially schematic, cross-sectional view of the valve flange illustrated in FIG. 46, shown mounted in a container.

With reference to FIGS. 46–67, differently shaped flange designs are provided to assist in mounting the associated dispensing valve on a particular type of package. Since these alternative valve designs relate largely to the different shapes in the valve flange, the drawings are believed to be largely self-explanatory. For instance, with reference to FIG. 46, the marginal flange 4*aa* of illustrated valve 3*aa* has a concave top or inner surface 33*aa*, a concave bottom or outer surface 32*aa*, and a generally flat marginal edge 31*aa*. As shown in FIG. 47, valve 3*aa* is retained in associated container 2*aa* by a snap-in retainer ring 103*aa*, with valve seat surfaces 118*aa* and 91*aa* shaped similar to valve flange surfaces 32*aa* and 33*aa*, respectively.

Figure 48:
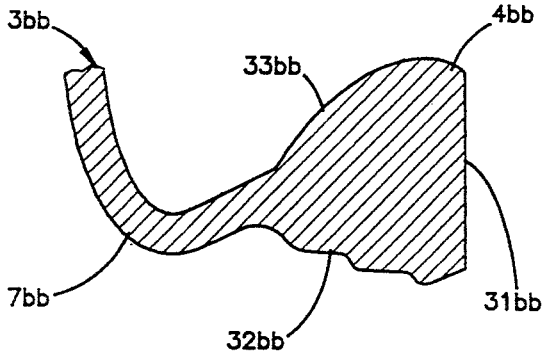
FIGS. 48–55 are enlarged, vertical cross-sectional views of additional alternative flange configurations for the self-sealing valve.
Figure 51:
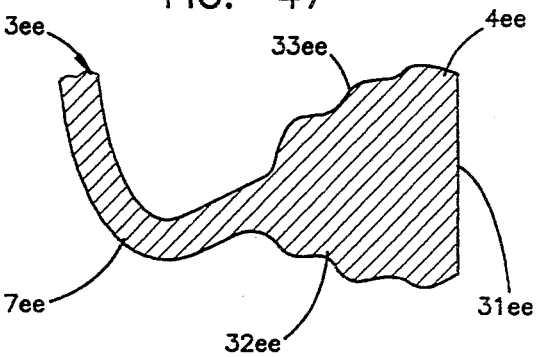
Figure 49:
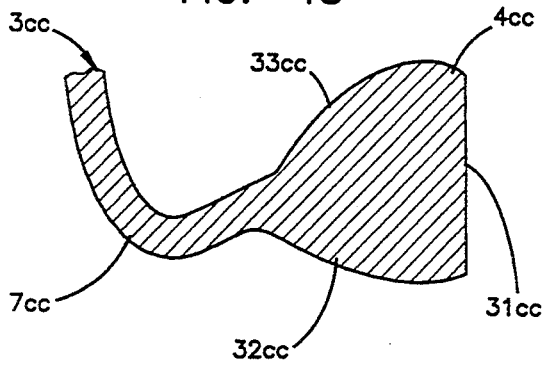
Figure 52:
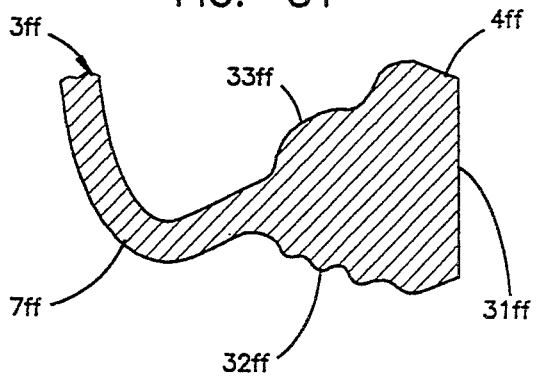
Figure 50:
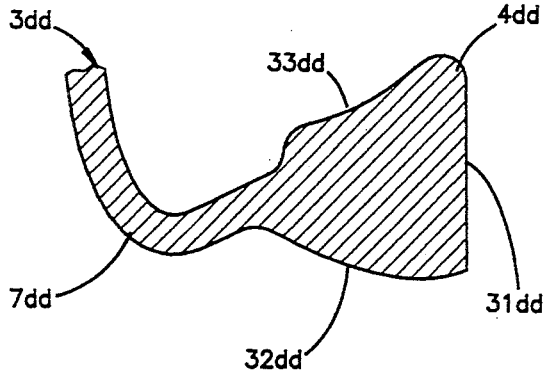
Figure 53:
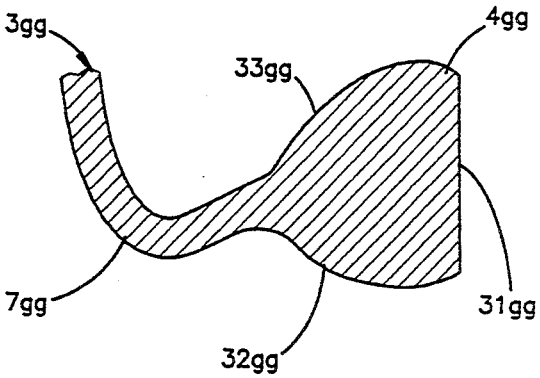
Figure 54:
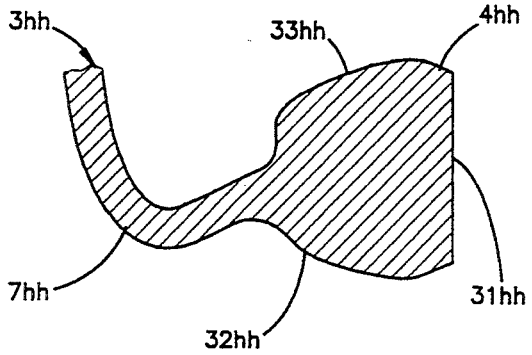
Figure 55:
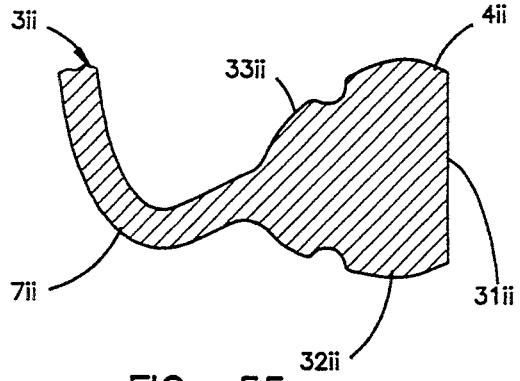
Figure 56:
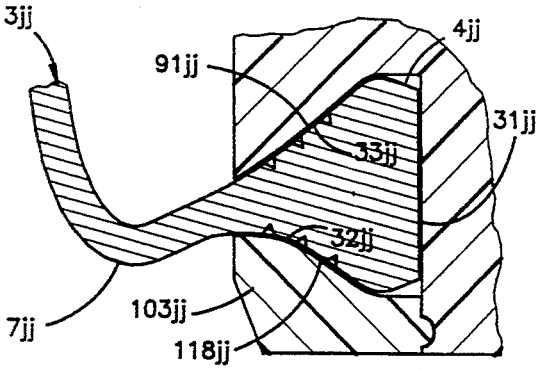
FIG. 56 is an enlarged, fragmentary, vertical cross-sectional view of an additional alternative flange design for the self-sealing valve, shown mounted in an associated container.
Figure 57:
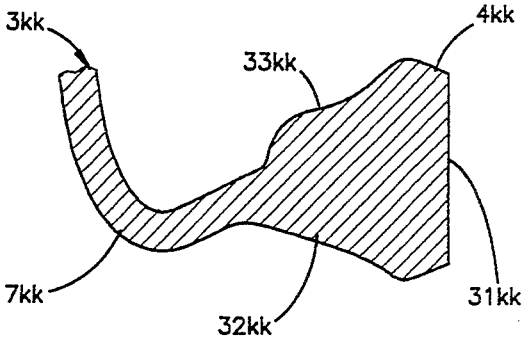
FIGS. 57–66 are enlarged, vertical cross-sectional views of additional alternative flange configurations for the self-sealing valve.
Figure 58:
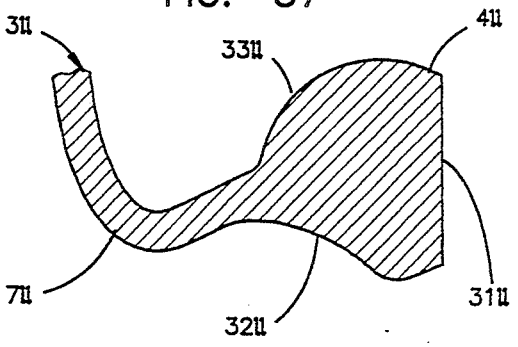
Figure 59:
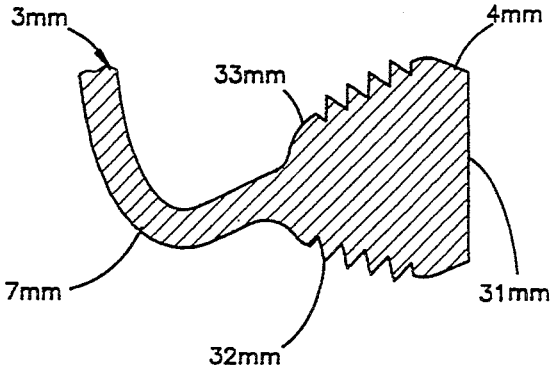
Figure 60:
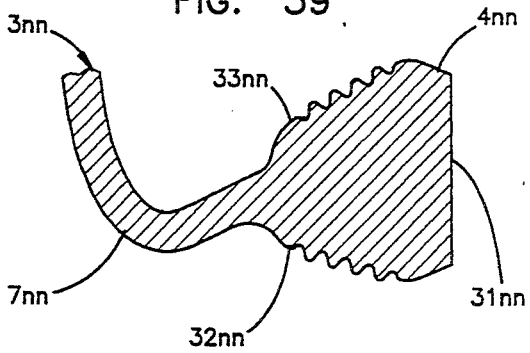
Figure 61:
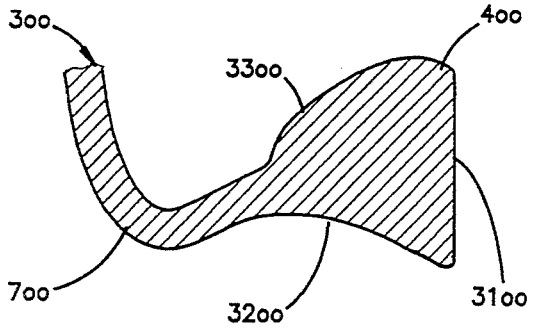
Figure 62:
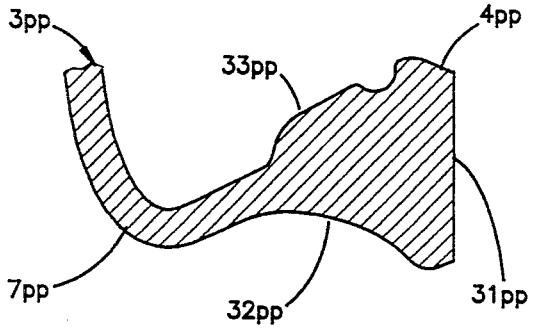
Figure 63:
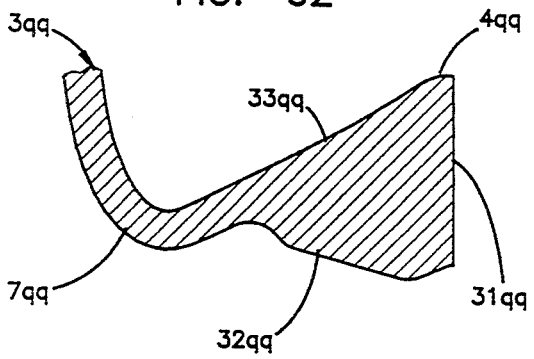
Figure 64:
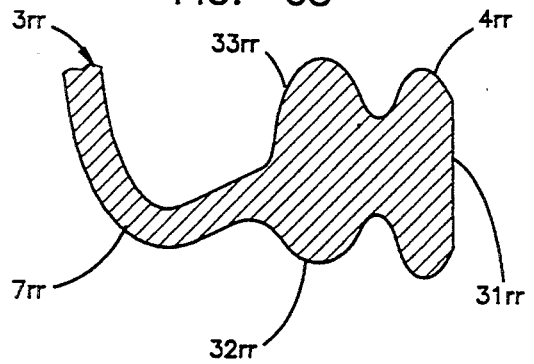
Figure 65:
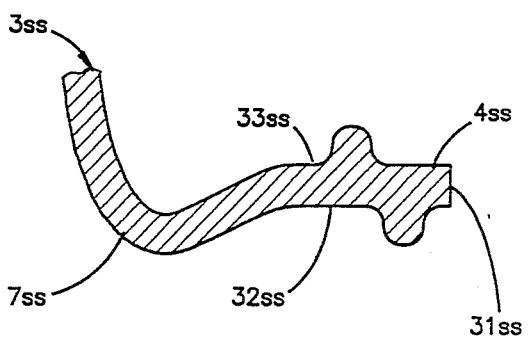
Figure 66:
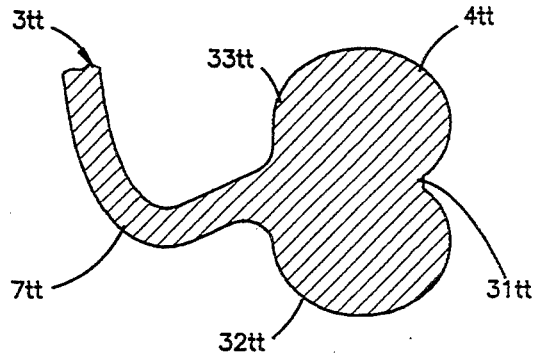
Figure 67:
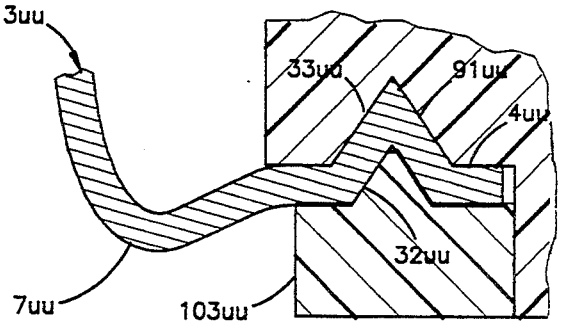
FIG. 67 is an enlarged, vertical cross-sectional view of an additional alternative flange configuration for the self-sealing valve, shown mounted in an associated container.
Figure 68:
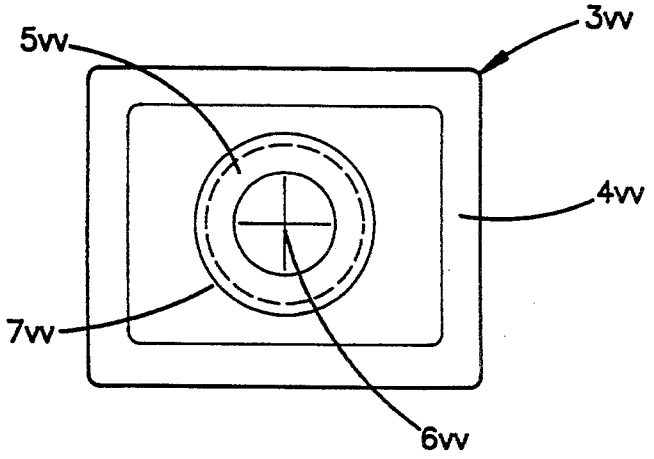
FIGS. 68–70 are enlarged, plan views of additional alternative flange configurations for the self-sealing valve.
Figure 69:
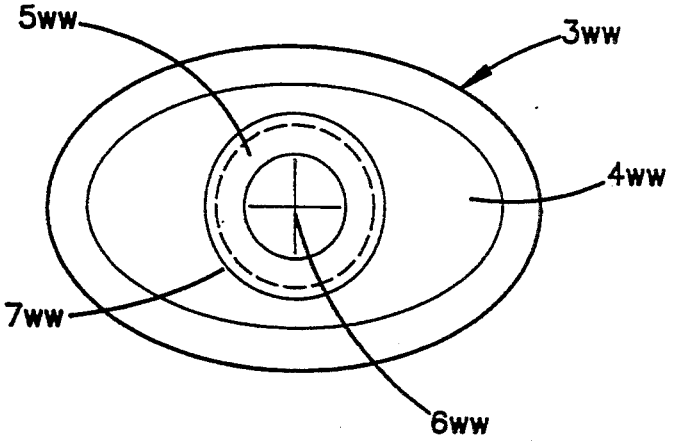
Figure 70:
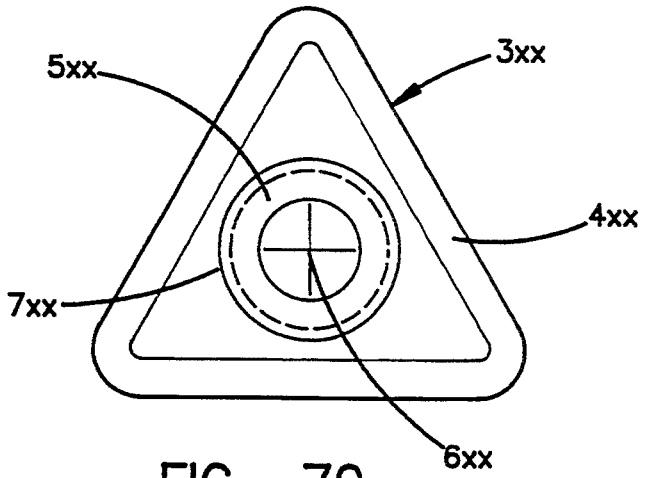
Figure 71:
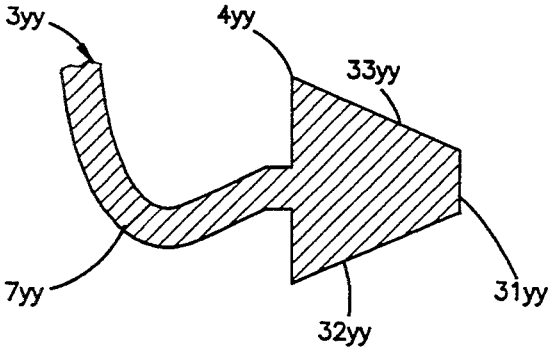
FIGS. 71–72 are enlarged, vertical cross-sectional views of additional alternative flange configurations for the self-sealing valves.
Figure 75:
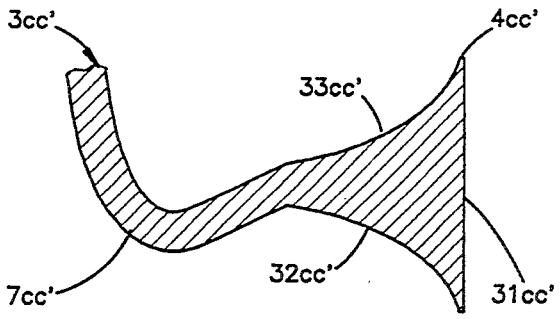
FIGS. 74–94 are enlarged, vertical cross-sectional views of additional alternative flange configurations for the self-sealing valve.
Figure 72:
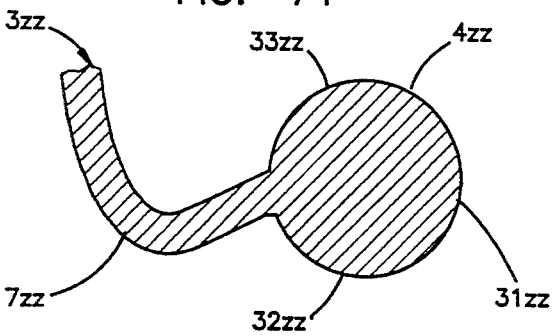
Figure 76:
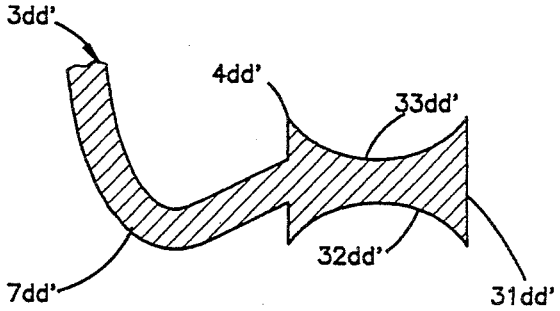
Figure 73:
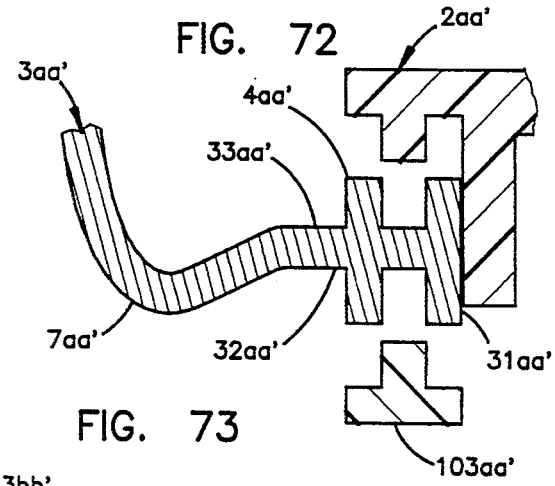
FIG. 73 is an enlarged, vertical cross-sectional view of an additional alternative flange design for the self-sealing valve, shown positioned for assembly in an associated container.
Figure 77:
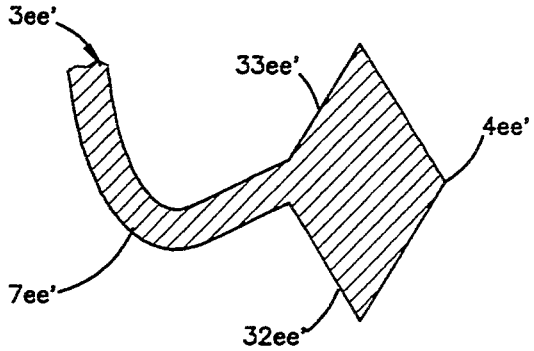
Figure 74:
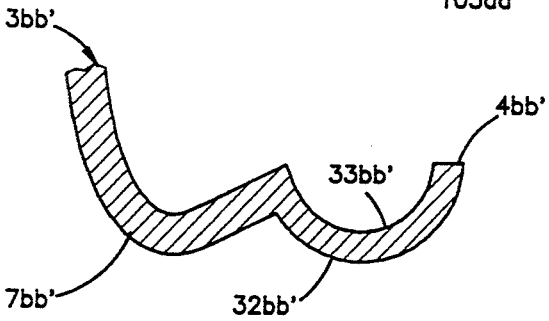
Figure 78:
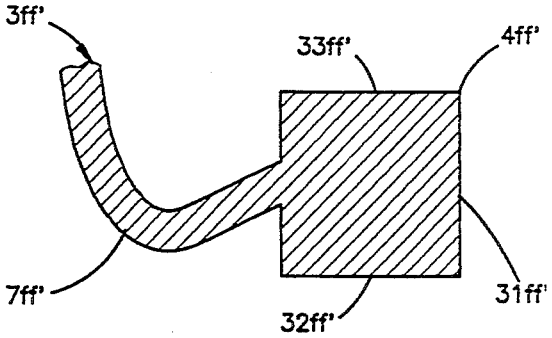
Figure 79:
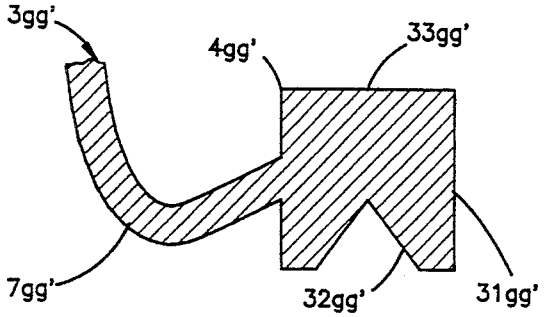
Figure 80:
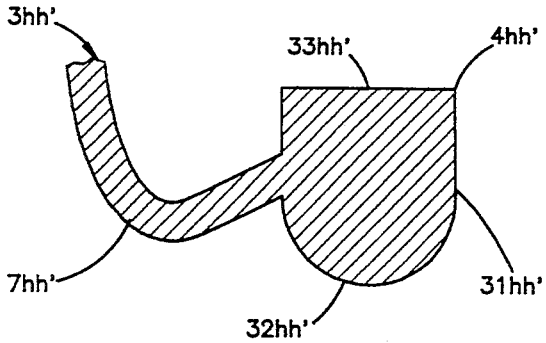
Figure 81:
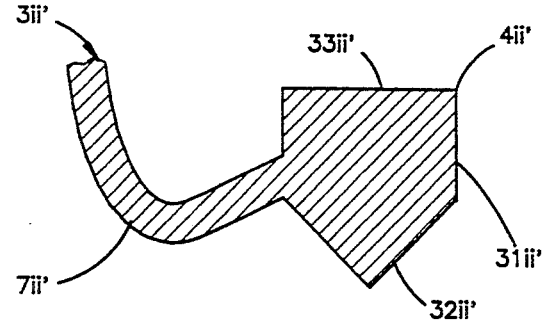
Figure 82:
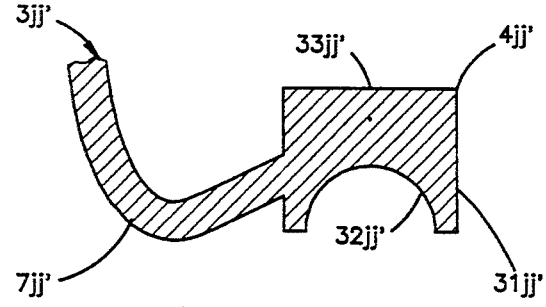
Figure 83:
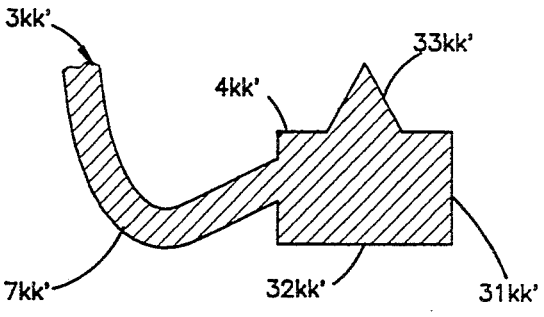
Figure 84:
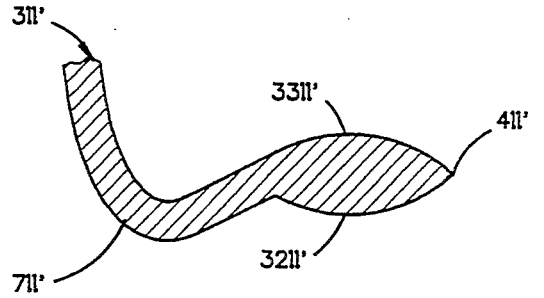
Figure 85:
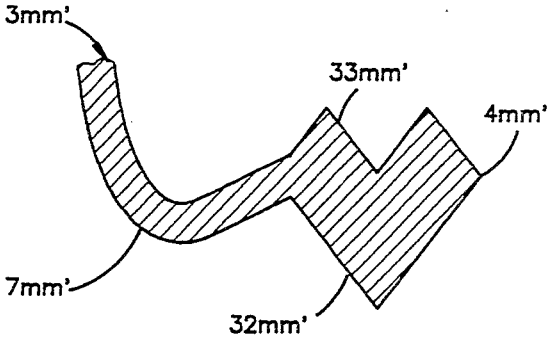
Figure 86:
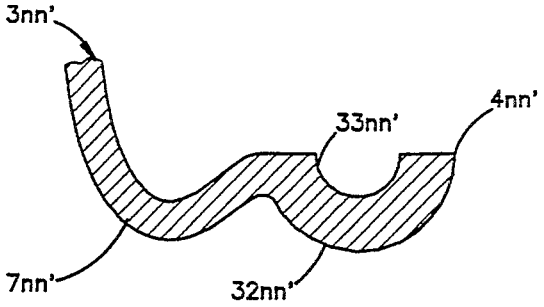
Figure 87:
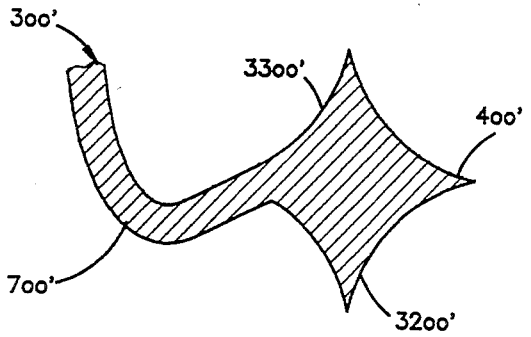
Figure 88:
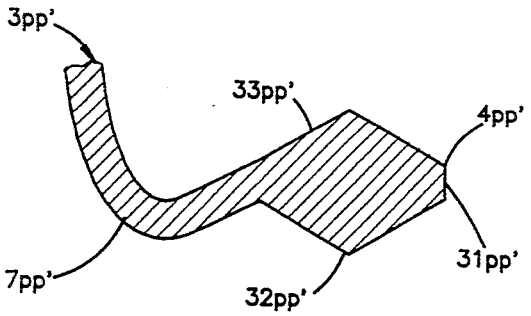
Figure 89:
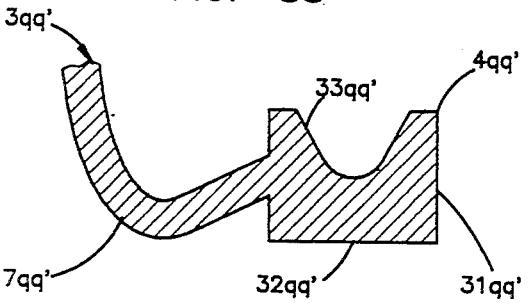
Figure 90:
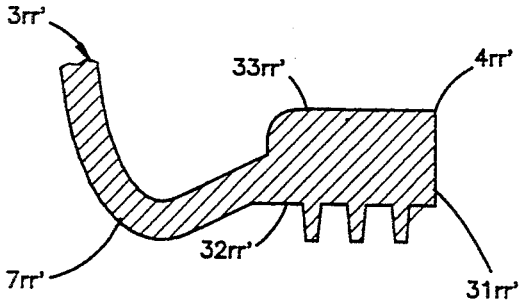
Figure 91:
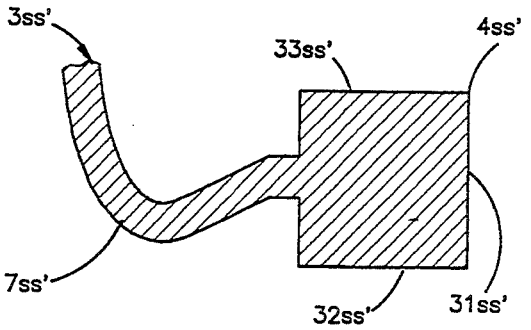
Figure 92:
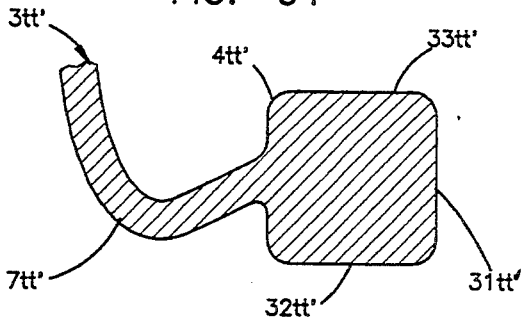
Figure 93:
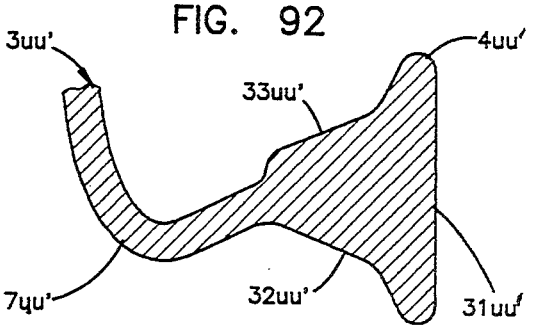
Figure 94:
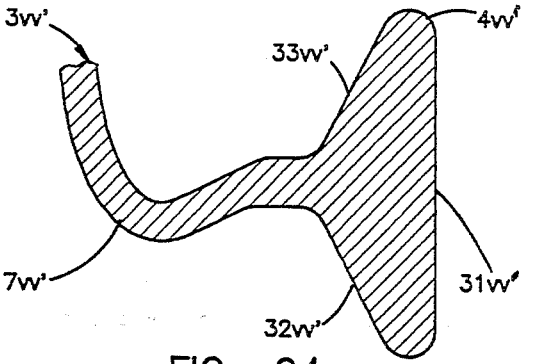
Figure 95:
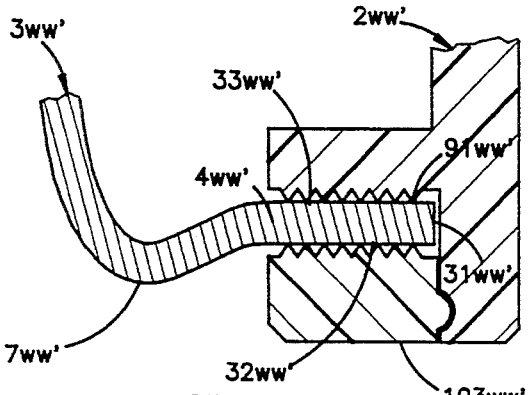
FIGS. 95–96 are enlarged, vertical cross-sectional views of additional alternative flange configurations for the self-sealing valve, shown installed in an associated container.
Figure 96:
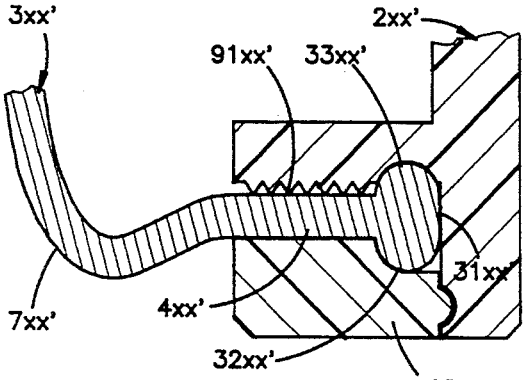

In the valve 3*bb* illustrated in FIG. 48, the flange inner surface 33*bb* is convex, while the outer surface 32*bb* has a waved shape. The valve 3*ii* illustrated in FIG. 55 has an arcuate groove extending along both the inner flange face 33*ii* and the outer flange face 32*ii*. The valve 3*jj* illustrated in FIG. 56 has a plurality of V-shaped grooves on both the inner flange face 33*jj* and the outer flange face 32*jj*. The valve 3*mm* illustrated in FIG. 59 includes outwardly protruding V-shaped ribs on both the inner flange face 33*mm* and the outer flange face 32*mm*. Hence, the various alternative flange configurations illustrated in FIGS. 46–96 are believed to be disclosed from their associated drawings.

Figure 97:
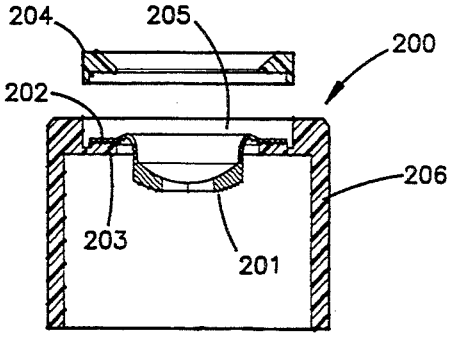
FIG. 97 is an exploded, cross-sectional view of yet another embodiment of the present dispensing package, having an exterior retainer ring which is integrally fixed in place.

The reference numeral 200 (FIG. 97) generally designates yet another dispensing package embodying the present invention. In dispensing package 200, valve 201 is similar to valve 3, but has a generally flat marginal flange 202, which is positioned on a similarly shaped valve seat 203. A retainer ring 204 is received within a mating recess 205 in the upper surface of container 206, and is fixedly retained in place by adhesives, sonic welding, or other similar attachment means.

Figure 98:
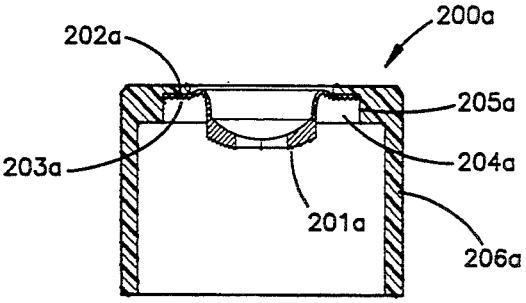
FIG. 98 is a partially schematic, cross-sectional view of yet another embodiment of the present dispensing package, having an interior retainer ring which is integrally fixed in place.

The reference numeral 200*a* (FIG. 98) generally designates yet another dispensing package embodying the present invention. Since the dispensing package 200*a* is similar to the previously described dispensing package 200, similar parts appearing in FIG. 98 and FIG. 99 respectively are represented by the same, corresponding reference numeral, except for the suffix "a" in the numerals of the latter. In dispensing package 200*a*, recess 205*a* is formed in the inside of container 206*a*, and retainer ring 204*a* is mounted therein.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of an invention in which an exclusive property or privilege is claimed are defined as follows.

1. A dispensing package for fluid products, comprising:

a container shaped to retain a selected fluid product therein, and having a discharge opening;

a dispensing valve for controlling the flow of the fluid product from said container, including a marginal valve portion sealing about the discharge opening of said container;

a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped for shifting generally centrally with respect to said marginal valve portion; and a connector sleeve portion having a resiliently flexible construction, with one end area thereof connected with said marginal valve portion, and an opposite end area thereof connected with said valve head portion, wherein said connector sleeve portion has a sidewall with a configuration which extends rollingly to shift said valve head portion outwardly to a fully extended position when pressure within said container is raised above the predetermined discharge pressure to open said orifice and dispense fluid product from said container; and a valve stop selectively connected with said container, and positioned generally opposite said dispensing valve to positively prevent said valve head portion from shifting to the fully extended position to thereby retain said orifice fully closed.

2. A dispensing package as set forth in claim 1, wherein;

said container includes a neck disposed adjacent said discharge opening, with a radially outwardly extending lip; and said valve stop comprises a removable cap having a radially inwardly protruding rib which selectively engages the lip of said container to detachably interconnect said cap and said container, and an inwardly extending tower with an arcuate end wall positioned adjacent and shaped similar to an exterior side of said valve head portion.

3. A dispensing package as set forth in claim 2, wherein:

said cap includes a tab projecting radially outwardly from a marginal portion of said cap to facilitate manually grasping the same.

4. A dispensing package as set forth in claim 1, wherein:

said container includes a neck disposed adjacent said discharge opening, having an internally facing rim with a groove thereabout; and said valve stop comprises a removable cap having a radially outwardly protruding rib which selectively engages the groove in said rim to detachably interconnect the same, and an inwardly extending protuberance shaped similar to an exterior side of said valve head portion.

5. A dispensing package as set forth in claim 4, wherein:

said cap includes a tab projecting radially outwardly from a marginal portion of said cap to facilitate manually grasping the same.

6. A dispensing package as set forth in claim 1, wherein:

said valve stop comprises an L-shaped arm having one end thereof pivotally connected with said container for shifting said arm between open and closed positions, and an opposite end thereof shaped for positioning adjacent the valve head portion of said dispensing valve when said arm is in the closed position.

7. A dispensing package as set forth in claim 1, wherein:

said valve stop comprises a disc-shaped cap having a marginal portion thereof pivotally connected with said container for rotation between open and closed positions.

8. A dispensing package as set forth in claim 7, wherein:

said cap includes a snap lock for detachably retaining the same in the closed position.

9. A dispensing package for fluid products, comprising:

a container shaped to retain a selected fluid product therein, and having a discharge opening;

a dispensing valve for controlling the flow of the fluid product from said container, including a marginal valve portion sealing about the discharge opening of said container;

a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped for shifting generally centrally with respect to said marginal valve portion; and a connector sleeve portion having a resiliently flexible construction, with one end area thereof connected with said marginal valve portion, and an opposite end area thereof connected with said valve head portion, wherein said connector sleeve portion has a sidewall with a configuration which extends to shift said valve head portion outwardly to a fully extended position when pressure within said container is raised above the predetermined discharge pressure to open said orifice and dispense fluid product from said container;

a valve stop selectively connected with said container, and positioned generally opposite said dispensing valve to positively prevent said valve head portion from shifting to the fully extended position to thereby retain said orifice fully closed; and wherein said container includes a neck disposed adjacent said discharge opening, with an outwardly oriented lip; and said valve stop comprises a removable patch adhered to the lip of said container.

10. A dispensing package for fluid products, comprising:

a container shaped to retain a selected fluid product therein, and having a discharge opening;

a dispensing valve for controlling the flow of the fluid product from said container, including a marginal valve portion sealing about the discharge opening of said container;

a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped for shifting generally centrally with respect to said-marginal valve portion; and a connector sleeve portion having a resiliently flexible construction, with one end area thereof connected with said marginal valve portion, and an opposite end area thereof connected with said valve head portion, wherein said connector sleeve portion has a sidewall with a configuration which extends rollingly to shift said valve head portion outwardly when pressure within said container is raised above the predetermined discharge pressure;

a vent mounted in said container, and permitting ambient air to be drawn into an interior portion of said container after fluid product is dispensed therefrom.

11. A dispensing package for fluid products, comprising:

a container shaped to retain a selected fluid product therein, and having a discharge opening;

a dispensing valve for controlling the flow of the fluid product from said container, including a marginal valve portion sealing about the discharge opening of said container;

a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped for shifting generally centrally with respect to said marginal valve portion; and a connector sleeve portion having a resiliently flexible construction, with one end area thereof connected with said marginal valve portion, and an opposite end area thereof connected with said valve head portion, wherein said connector sleeve portion has a sidewall with a configuration which extends to shift said valve head portion outwardly when pressure within said container is raised above the predetermined discharge pressure;

a vent mounted in said container, and permitting ambient air to be drawn into an interior portion of said container after fluid product is dispensed therefrom; and wherein said marginal valve portion is configured to form a check valve for said vent to prevent the liquid product in said container from escaping through said vent.

12. A dispensing package as set forth in claim 11, including:

a snap ring retaining said dispensing valve in said container, and including a vent aperture therethrough which selectively communicates with said vent.

13. A dispensing package as set forth in claim 12, wherein:

said container includes an enlarged seat in which said marginal valve portion is retained to permit selected flexure of the same to vent air into the interior portion of said container.

14. A dispensing package as set forth in claim 13, wherein:

said marginal valve portion includes a tapered inner area, and a flat outer area.

15. A dispensing package for fluid products, comprising:

a container shaped to retain a selected fluid product therein, and having a discharge opening;

a dispensing valve for controlling the flow of the fluid product from said container, including a marginal valve portion sealing about the discharge opening of said container;

a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped for shifting generally centrally with respect to said marginal valve portion; and a connector sleeve portion having a resiliently flexible construction, with one end area thereof connected with said valve flange, and an opposite end area thereof connected with said valve head portion, wherein said connector sleeve portion has a sidewall with a configuration which extends rollingly to shift said valve head portion outwardly when pressure within said container is raised above the predetermined discharge pressure; and wherein said marginal valve portion includes opposite inner and outer faces which are curved, and diverge from one another to a flat outer marginal edge.

16. A dispensing package as set forth in claim 15, wherein:

said inner face has a first concave shape and said outer face has a second concave shape.

17. A dispensing package as set forth in claim 16, wherein:

said first concave shape of said inner face is different from said second concave shape of said outer face.

18. A dispensing package as set forth in claim 15, wherein:

said inner face has a convex shape, and said outer face has a waved shape.

19. A dispensing package as set forth in claim 15, wherein:

said inner and outer faces have a convex shape.

20. A dispensing package as set forth in claim 19, wherein:

said convex shape of said inner face is different from the convex shape of said outer face.

21. A dispensing package as set forth in claim 15, wherein:

said inner face has a concave shape, and said outer face has a convex shape.

22. A dispensing package as set forth in claim 15, wherein:

said inner and outer faces have a wavy shape.

23. A dispensing package as set forth in claim 22, wherein:

said wavy shape of said inner face is different from the wavy shape of said outer face.

24. A dispensing package as set forth in claim 15, wherein:

one of said inner and outer faces includes a groove extending circumferentially about said marginal valve portion.

25. A dispensing package as set forth in claim 15, wherein:

said inner and outer faces each include a groove extending circumferentially about said marginal valve portion.

26. A dispensing package as set forth in claim 15, wherein:

said inner and outer faces each include a plurality of grooves extending circumferentially about said marginal valve portion.

27. A dispensing package as set forth in claim 26, wherein:

said grooves have a V-shaped transverse cross-sectional configuration.

28. A dispensing package as set forth in claim 26, wherein:

said grooves have a U-shaped transverse cross-sectional configuration.

29. A dispensing package as set forth in claim 15, wherein:

said inner and outer faces each include a plurality of ribs protruding outwardly from said marginal valve portion.

30. A dispensing package as set forth in claim 29, wherein:

said ribs are disposed concentrically.

31. A dispensing package as set forth in claim 30, wherein:

said ribs have a V-shaped transverse cross-sectional configuration.

32. A dispensing package as set forth in claim 30, wherein:

said ribs have a U-shaped transverse cross-sectional configuration.

33. A dispensing package as set forth in claim 15, wherein:

said inner and outer faces collectively assume an hour glass shaped transverse cross-sectional configuration.

34. A dispensing package as set forth in claim 15, wherein:

said inner and outer faces each have a three-quarter circle shaped transverse cross-sectional configuration.

35. A dispensing package as set forth in claim 15, wherein:

said marginal valve portion has a rectangular plan configuration.

36. A dispensing package as set forth in claim 15, wherein:

said marginal valve portion has an ovate plan configuration.

37. A dispensing package as set forth in claim 15, wherein:

said marginal valve portion has a triangular plan configuration.

38. A dispensing package for fluid products, comprising:

a container shaped to retain a selected fluid product therein, and having a discharge opening;

a dispensing valve for controlling the flow of the fluid product from said container, including a marginal valve portion sealing about the discharge opening of said container;

a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped for shifting generally centrally with respect to said marginal valve portion; and a connector sleeve portion having a resiliently flexible construction, with one end area thereof connected with said valve portion, and an opposite end area thereof connected with said valve head portion, wherein said connector sleeve portion has a sidewall with a configuration which extends rollingly to shift said valve head portion outwardly when pressure within said container is raised above the predetermined discharge pressure; and wherein said marginal valve portion includes opposite inner and outer faces which extend to an outer marginal edge; and said inner and outer faces are generally flat, with first and second arcuately shaped ribs projecting oppositely therefrom in a staggered configuration.

39. A dispensing package as set forth in claim 38, wherein:

said inner and outer faces are generally flat, with a V-shaped rib projecting from said inner face, and a V-shaped groove, aligned with said rib, disposed in said outer face.

40. A dispensing package as set forth in claim 38, wherein:

said marginal valve portion has a trapezoidal transverse cross-sectional configuration, with said connector sleeve attached centrally at a base portion thereof.

41. A dispensing package as set forth in claim 38, wherein:

said marginal valve portion has a circular transverse cross-sectional configuration.

42. A dispensing package as set forth in claim 38, wherein:

said marginal valve portion has a H-shaped transverse cross-sectional configuration.

43. A dispensing package as set forth in claim 38, wherein:

said marginal valve portion has a U-shaped transverse cross-sectional configuration.

44. A dispensing package as set forth in claim 38, wherein:

said marginal valve portion has a double concave transverse cross-sectional configuration.

45. A dispensing package as set forth in claim 38, wherein:

said marginal valve portion has a diamond-shaped transverse cross-sectional configuration.

46. A dispensing package as set forth in claim 38, wherein:

said marginal valve portion has a square shaped transverse cross-sectional configuration.

47. A dispensing package as set forth in claim 38, wherein:

said marginal valve portion has an inner half and an oppositely oriented outer half;

at least one of said inner and outer halves has a rectangular transverse cross-sectional configuration.

48. A dispensing package as set forth in claim 47, wherein:

at least one of said inner and outer halves has an inwardly oriented V-shaped groove.

49. A dispensing package as set forth in claim 47, wherein:

at least one of said inner and outer halves has a semicircular transverse cross-sectional configuration.

50. A dispensing package as set forth in claim 47, wherein:

at least one of said inner and outer halves has an outwardly protruding V-shaped rib.

51. A dispensing package as set forth in claim 47, wherein:

at least one of said inner and outer halves includes a plurality of enlarged head anchors protruding therefrom.

52. A dispensing package as set forth in claim 38, wherein:

said marginal valve portion is generally flat;

said container includes a seat with a plurality of outwardly protruding V-shaped ribs against which said marginal valve portion is positioned.

53. A dispensing package as set forth in claim 52, including:

a snap ring retaining said dispensing valve in said container, and including a seat against which said marginal valve portion is positioned.

54. A dispensing package as set forth in claim 53, wherein:

said marginal valve portion includes an enlarged marginal bead positioned in a mating groove in said container seat.

55. A dispensing package as set forth in claim 53, wherein:

said snap ring seat includes a plurality of outwardly protruding V-shaped ribs.

56. A dispensing package as set forth in claim 38, wherein:

said marginal valve portion is generally flat;

said container includes a seat against which said marginal valve portion is positioned; and including a ring retaining said valve in said container.

57. A dispensing package as set forth in claim 56, wherein:

said marginal valve portion has an L-shaped marginal edge; and said ring is threadedly mounted in said container.

58. A dispensing package as set forth in claim 56, wherein:

said ring has an L-shaped seat against which said marginal valve portion is positioned; and said ring has a snap lock mounting the same in said container.

* * * * *

UNITED STATES PATENT AND TRADEMARK OFFICE

CERTIFICATE OF CORRECTION

PATENT NO. : 5,409,144
DATED : April 25, 1995
INVENTOR(S) : Paul E. Brown

It is certified that error appears in the above-identified patent and that said Letters Patent is hereby corrected as shown below:

Title page,
Item [*] Notice, "May 25, 2010" should read -- the expiration date of the full statutory term of U.S. Patent No. 5,213,236 --.

Signed and Sealed this

Third Day of May, 2005

JON W. DUDAS
*Director of the United States Patent and Trademark Office*

UNITED STATES PATENT AND TRADEMARK OFFICE
Certificate

Patent No. 5,409,144 Patented: April 25, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Paul E. Brown, Midland, Michigan; and Timothy R. Socier, Essexville, Michigan.

Signed and Sealed this Tenth Day of January 2006.

MICHAEL Y. MAR
*Supervisory Patent Examiner*
Art Unit 3754